US007940232B2

(12) United States Patent
Mashita et al.

(10) Patent No.: US 7,940,232 B2
(45) Date of Patent: May 10, 2011

(54) PLASMA DISPLAY PANEL DRIVING METHOD

(75) Inventors: Takashi Mashita, Chuo (JP); Hajime Homma, Chuo (JP)

(73) Assignee: Panasonic Corporation, Kadoma-shi, Osaka (JP)

( * ) Notice: Subject to any disclaimer, the term of this patent is extended or adjusted under 35 U.S.C. 154(b) by 659 days.

(21) Appl. No.: 12/048,893

(22) Filed: Mar. 14, 2008

(65) Prior Publication Data

US 2008/0224954 A1 Sep. 18, 2008

(30) Foreign Application Priority Data

Mar. 16, 2007 (JP) ..... 2007-068194

(51) Int. Cl.
*G09G 3/28* (2006.01)

(52) U.S. Cl. ..... 345/60; 345/66

(58) Field of Classification Search ..... 345/37, 345/42, 55, 60–68; 315/169.4
See application file for complete search history.

(56) References Cited

U.S. PATENT DOCUMENTS

| | | | | |
|---|---|---|---|---|
| 6,144,349 | A * | 11/2000 | Awata et al. | 345/67 |
| 7,333,075 | B2 * | 2/2008 | Chung et al. | 345/60 |
| 7,688,287 | B2 * | 3/2010 | Tokunaga et al. | 345/63 |
| 7,768,477 | B2 * | 8/2010 | Jung et al. | 345/60 |
| 2003/0011543 | A1 * | 1/2003 | Hosoi et al. | 345/63 |
| 2008/0150835 | A1 * | 6/2008 | Paik et al. | 345/60 |

FOREIGN PATENT DOCUMENTS

JP 2003-29698 1/2003

* cited by examiner

*Primary Examiner* — Quan-Zhen Wang
*Assistant Examiner* — Mansour M Said
(74) *Attorney, Agent, or Firm* — Drinker Biddle & Reath LLP

(57) ABSTRACT

A driving method includes generating an address discharge in selected cells out of discharge cells and setting the selected cells to either an emission enable state or a non-emission state in an address period which is set in each subfield period. The driving method also includes generating sustaining discharge in discharge cells being set to the emission enable state by applying at least one discharge sustaining pulse $P^+$ between a scanning electrode and a common electrode constituting each row electrode pair, in a discharge sustaining period following the address period. The driving method also includes decreasing the applied voltage between the scanning electrode and common electrode in steps when a final applied pulse $P^+$ out of the discharge sustaining pulses falls.

29 Claims, 26 Drawing Sheets

FIG. 15

| GRAYSCALE LEVEL | CONVERSION TABLE | | EMISSION PATTERN | | | | | | | | | | | | | | BRIGHTNESS |
|---|---|---|---|---|---|---|---|---|---|---|---|---|---|---|---|---|---|
| | VSb | DD | $SF_1$ | $SF_2$ | $SF_3$ | $SF_4$ | $SF_5$ | $SF_6$ | $SF_7$ | $SF_8$ | $SF_9$ | $SF_{10}$ | $SF_{11}$ | $SF_{12}$ | $SF_{13}$ | $SF_{14}$ | |
| 1 | 0000 | 0 0 0 0 0 0 0 0 0 0 0 0 0 0 | | | | | | | | | | | | | | | 0 |
| 2 | 0001 | 1 1 0 0 0 0 0 0 0 0 0 0 0 0 | ◎ | ● | | | | | | | | | | | | | 1 |
| 3 | 0010 | 1 0 1 0 0 0 0 0 0 0 0 0 0 0 | ◎ | ○ | ● | | | | | | | | | | | | 3 |
| 4 | 0011 | 1 0 0 1 0 0 0 0 0 0 0 0 0 0 | ◎ | ○ | ○ | ● | | | | | | | | | | | 9 |
| 5 | 0100 | 1 0 0 0 1 0 0 0 0 0 0 0 0 0 | ◎ | ○ | ○ | ○ | ● | | | | | | | | | | 17 |
| 6 | 0101 | 1 0 0 0 0 1 0 0 0 0 0 0 0 0 | ◎ | ○ | ○ | ○ | ○ | ● | | | | | | | | | 27 |
| 7 | 0110 | 1 0 0 0 0 0 1 0 0 0 0 0 0 0 | ◎ | ○ | ○ | ○ | ○ | ○ | ● | | | | | | | | 39 |
| 8 | 0111 | 1 0 0 0 0 0 0 1 0 0 0 0 0 0 | ◎ | ○ | ○ | ○ | ○ | ○ | ○ | ● | | | | | | | 55 |
| 9 | 1000 | 1 0 0 0 0 0 0 0 1 0 0 0 0 0 | ◎ | ○ | ○ | ○ | ○ | ○ | ○ | ○ | ● | | | | | | 73 |
| 10 | 1001 | 1 0 0 0 0 0 0 0 0 1 0 0 0 0 | ◎ | ○ | ○ | ○ | ○ | ○ | ○ | ○ | ○ | ● | | | | | 95 |
| 11 | 1010 | 1 0 0 0 0 0 0 0 0 0 1 0 0 0 | ◎ | ○ | ○ | ○ | ○ | ○ | ○ | ○ | ○ | ○ | ● | | | | 119 |
| 12 | 1011 | 1 0 0 0 0 0 0 0 0 0 0 1 0 0 | ◎ | ○ | ○ | ○ | ○ | ○ | ○ | ○ | ○ | ○ | ○ | ● | | | 147 |
| 13 | 1100 | 1 0 0 0 0 0 0 0 0 0 0 0 1 0 | ◎ | ○ | ○ | ○ | ○ | ○ | ○ | ○ | ○ | ○ | ○ | ○ | ● | | 179 |
| 14 | 1101 | 1 0 0 0 0 0 0 0 0 0 0 0 0 1 | ◎ | ○ | ○ | ○ | ○ | ○ | ○ | ○ | ○ | ○ | ○ | ○ | ○ | ● | 215 |
| 15 | 1110 | 1 0 0 0 0 0 0 0 0 0 0 0 0 0 | ◎ | ○ | ○ | ○ | ○ | ○ | ○ | ○ | ○ | ○ | ○ | ○ | ○ | ○ | 255 |

◎ : SELECTIVE WRITE DISCHARGE + SUSTAINING DISCHARGE
○ : SUSTAINING DISCHARGE
● : SELECTIVE ERASE DISCHARGE

FIG. 25

| GRAYSCALE LEVEL | CONVERSION TABLE | | EMISSION PATTERN | | | | | | | | | | | | | | BRIGHTNESS |
|---|---|---|---|---|---|---|---|---|---|---|---|---|---|---|---|---|---|
| | VSb | DD | $SF_1$ | $SF_2$ | $SF_3$ | $SF_4$ | $SF_5$ | $SF_6$ | $SF_7$ | $SF_8$ | $SF_9$ | $SF_{10}$ | $SF_{11}$ | $SF_{12}$ | $SF_{13}$ | $SF_{14}$ | |
| 1 | 0000 | 0 0 0 0 0 0 0 0 0 0 0 0 0 0 | | | | | | | | | | | | | | | 0 |
| 2 | 0001 | 1 0 0 0 0 0 0 0 0 0 0 0 0 0 | □ | | | | | | | | | | | | | | α |
| 3 | 0010 | 0 1 1 0 0 0 0 0 0 0 0 0 0 0 | | ◎ | ● | | | | | | | | | | | | 1 |
| 4 | 0011 | 1 1 1 0 0 0 0 0 0 0 0 0 0 0 | □ | ◎ | ● | | | | | | | | | | | | 1+α |
| 5 | 0100 | 1 1 0 1 0 0 0 0 0 0 0 0 0 0 | □ | ◎ | ○ | ● | | | | | | | | | | | 3+α |
| 6 | 0101 | 1 1 0 0 1 0 0 0 0 0 0 0 0 0 | □ | ◎ | ○ | ○ | ● | | | | | | | | | | 9+α |
| 7 | 0110 | 1 1 0 0 0 1 0 0 0 0 0 0 0 0 | □ | ◎ | ○ | ○ | ○ | ● | | | | | | | | | 17+α |
| 8 | 0111 | 1 1 0 0 0 0 1 0 0 0 0 0 0 0 | □ | ◎ | ○ | ○ | ○ | ○ | ● | | | | | | | | 27+α |
| 9 | 1000 | 1 1 0 0 0 0 0 1 0 0 0 0 0 0 | □ | ◎ | ○ | ○ | ○ | ○ | ○ | ● | | | | | | | 39+α |
| 10 | 1001 | 1 1 0 0 0 0 0 0 1 0 0 0 0 0 | □ | ◎ | ○ | ○ | ○ | ○ | ○ | ○ | ● | | | | | | 55+α |
| 11 | 1010 | 1 1 0 0 0 0 0 0 0 1 0 0 0 0 | □ | ◎ | ○ | ○ | ○ | ○ | ○ | ○ | ○ | ● | | | | | 77+α |
| 12 | 1011 | 1 1 0 0 0 0 0 0 0 0 1 0 0 0 | □ | ◎ | ○ | ○ | ○ | ○ | ○ | ○ | ○ | ○ | ● | | | | 103+α |
| 13 | 1100 | 1 1 0 0 0 0 0 0 0 0 0 1 0 0 | □ | ◎ | ○ | ○ | ○ | ○ | ○ | ○ | ○ | ○ | ○ | ● | | | 133+α |
| 14 | 1101 | 1 1 0 0 0 0 0 0 0 0 0 0 1 0 | □ | ◎ | ○ | ○ | ○ | ○ | ○ | ○ | ○ | ○ | ○ | ○ | ● | | 169+α |
| 15 | 1110 | 1 1 0 0 0 0 0 0 0 0 0 0 0 1 | □ | ◎ | ○ | ○ | ○ | ○ | ○ | ○ | ○ | ○ | ○ | ○ | ○ | ● | 209+α |
| 16 | 1111 | 1 1 0 0 0 0 0 0 0 0 0 0 0 0 | □ | ◎ | ○ | ○ | ○ | ○ | ○ | ○ | ○ | ○ | ○ | ○ | ○ | ○ | 255+α |

□ : SELECTIVE WRITE DISCHARGE + MICRO DISCHARGE
◎ : SELECTIVE WRITE DISCHARGE + SUSTAINING DISCHARGE
○ : SUSTAINING DISCHARGE
● : SELECTIVE ERASE DISCHARGE

PLASMA DISPLAY PANEL DRIVING METHOD

BACKGROUND OF THE INVENTION

1. Field of the Invention

The present invention relates to a driving technology for a plasma display panel, which divides each field of a video signal into a plurality of subfields, and displays multi-grayscale images by a combination of the subfields.

2. Description of the Related Art

A plasma display has a display panel having a plurality of discharge cells, in which a fluorescent layer is coated respectively, and which are arrayed in a matrix. Generally a display panel has a plurality of row electrode pairs which are formed on a substrate, a plurality of column electrodes which are formed facing the row electrode pairs, and a plurality of discharge cells formed at areas where the row electrode pairs and the column electrodes cross respectively. These discharge cells are arranged in a matrix, and a fluorescent layer is coated inside each discharge cell. In a plasma display, a gas discharge for initially adjusting the charge distribution in all the discharge cells (that is, a reset discharge) is executed first when an image is displayed. Then the plasma display generates a gas discharge in selected cells, out of the discharge cells (that is, an address discharge), and generates such charged particles as electrons and ions (that is, wall charges) so as to set the wall charge distribution in the selected cells to an emission enable state (that is light ON mode). Also a single or plurality of voltage pulses (that is, discharge sustaining pulses) are applied between the row electrodes constituting each row electrode pair, whereby the gas discharge is generated in the discharge cells in the emission enable state (that is a sustaining discharge). As a result, ultraviolet generated by the sustaining discharge excites the fluorescent layer, and allows light to be emitted. Multi-grayscale images can be displayed by controlling the number of times gas discharges, which are generated in the discharge cells per unit time.

A subfield method is normally used for a grayscale control method for a plasma display, dividing each field corresponding to one frame image into a plurality of subfields, assigning the weight of brightness, which is in proportion to an emission period, to each subfield, and displaying multi-grayscale images based on the combination of these subfields. The subfields are sequentially displayed along a time axis, so human eyes can perceive these subfields as one image by integrating the emission patterns. For example, if the weights of brightness to be assigned to 8 subfields constituting each field are set to the ratio of $2^0:2^1:2^2:2^3:2^4:2^5:2^6:2^7$ (=1:2:4:8:16:32:64:128), then 256 grayscales of images can be displayed by combining the subfields. This type of grayscale control technology based on the subfield method is disclosed, for example, in Japanese Patent Application Laid-Open (Kokai) No. 2003-29698 and its corresponding US Patent Application Publication No. 2003/011543.

According to the grayscale control based on the subfield method, a reset discharge, for initially adjusting the charge distribution in all the discharge cells, is executed first in the display period of the first subfield out of the subfields constituting each field. However, light generated by the reset discharge (background emission) drops the contrast, particularly the dark room contrast, of the display image, and deteriorates the image quality. Here "dark room contrast" is normally defined as the ratio (=Lg/Lb) of the emission brightness (=Lg) when a white level image is displayed and the background emission brightness (=Lb) when a black level image is displayed. Dark room contrast is one parameter which determines the level of image quality, particularly when a low brightness image is displayed.

SUMMARY OF THE INVENTION

In a conventional plasma display, it is difficult to control the wall charge distribution in the discharge cells. For example, an unexpected discharge error may occur in the discharge cells, or a desired wall charge distribution may not be acquired due to a failure in erasing the wall charges, and therefore display quality may drop. Also in some cases, a wall charge distribution, to be generated according to the address discharge, becomes unstable due to temperature fluctuation and age related deterioration of the display panel, which causes a dispersion in the intensity of a sustaining discharge in the discharge cells, and deteriorates the image quality. In other words, light generated by an address discharge, when the plasma display displays a low brightness image, may drop the dark room contrast.

It is an object of the present invention to provide a plasma display panel driving method and a plasma display device which can stably generate a desired wall charge distribution in discharge cells, so as to implement high display quality.

It is another object of the present invention to provide a plasma display panel driving method and a plasma display device which can stably generate a desired wall charge distribution in discharge cells, and also to suppress a drop in the dark room contrast.

It is still another object of the present invention to provide a plasma display panel driving method and plasma display device which can generate a desired wall charge distribution in discharge cells and suppress a drop in the dark room contrast, as well as improve the grayscale representation capability.

According to a first aspect of the present invention, there is provided a driving method for a plasma display panel. The plasma display panel has a plurality of row electrode pairs, a plurality of column electrodes formed so as to face the row electrode pairs via discharge spaces, and a plurality of discharge cells formed in areas where the row electrode pairs and the column electrodes cross respectively. A discharge gas is sealed in each discharge cell, and both a fluorescent layer and a secondary emission material, which contacts the discharge space, are formed on each column electrode. The driving method includes a step of dividing a display period in each field of an input video signal into a plurality of subfield periods. The driving method also includes a step of generating an address discharge in selected cells out of the discharge cells, and setting the selected cells to either an emission enable state or a non-emission state, in an address period which is set in each subfield period. The driving method also includes a step of generating a sustaining discharge in a discharge space of discharge cells being set to the emission enable state, by applying at least one discharge sustaining pulse between a scanning electrode and a common electrode constituting each row electrode pair, in a discharge sustaining period following the address period. The driving method also includes a step of decreasing the applied voltage between the scanning electrode and the common electrode in steps when a final applied pulse, out of the discharge sustaining pulses, falls, and then decreasing the applied voltage toward a predetermined voltage having a polarity different from that of the maximum voltage of the final applied pulse.

According to a second aspect of the present invention, there is provided another driving method for a plasma display panel. The plasma display panel has a plurality of row electrode pairs, a plurality of column electrodes formed so as to face the row electrode pairs via discharge spaces, and a plurality of discharge cells formed in areas where the row electrode pairs and the column electrodes cross respectively. Discharge gas is sealed and a fluorescent layer is formed in each discharge cell. The driving method includes a step of dividing a display period in each field of an input video signal into a plurality of subfield periods. The driving method also includes a step of generating an address discharge in selected cells out of the discharge cells, and setting the selected cells to either an emission enable state or a non-emission state, in an address period which is set in each subfield period. The driving method also includes a step of generating a sustaining discharge in a discharge space of discharge cells being set to the emission enable state, by applying at least one discharge sustaining pulse between a scanning electrode and a common electrode constituting each row electrode pair, in a discharge sustaining period following the address period. The driving method also includes a step of decreasing the applied voltage between the scanning electrode and the common electrode in steps when a final applied pulse out of the discharge sustaining pulses falls, and then decreasing the applied voltage toward a predetermined voltage having a polarity different from that of the maximum voltage of the final applied pulse. A fall edge section of the final applied pulse has a first block where the applied voltage changes from the maximum voltage of the final applied pulse to a first intermediate voltage, a second block where the applied voltage is sustained at the first intermediate voltage for a predetermined time, and a third block where the applied voltage changes from the first intermediate voltage to the predetermined voltage. The first block has a block where the applied voltage changes from the maximum voltage of the final applied pulse to a second intermediate voltage which is lower than the maximum voltage, and is higher than the first intermediate voltage, a block where the applied voltage is sustained at the second intermediate voltage for a predetermined time, and a block where the applied voltage changes from the second intermediate voltage to the first intermediate voltage.

According to a third aspect of the present invention, there is provided another driving method for a plasma display panel. The plasma display panel has a plurality of row electrode pairs, a plurality of column electrodes formed so as to face the row electrode pairs via discharge spaces, and a plurality of discharge cells formed in areas where the row electrode pairs and the column electrodes cross respectively. Discharge gas is sealed and a fluorescent layer is formed in each discharge cell. The driving method includes a step of dividing a display period in each field of an input video signal into a plurality of subfield periods. The driving method also includes a step of selectively generating an address discharge in the discharge cells by sequentially applying a scanning pulse, on which a positive polarity or a negative polarity base voltage is superimposed, to the scanning electrodes constituting the row electrode pairs, and applying a voltage pulse synchronizing with each scanning pulse to the column electrodes in an address period which is set in each subfield period, so as to generate an address discharge in selected cells out of the discharge cells and set the selected cells to either an emission enable state or a non-emission state. The driving method also includes a step of generating a sustaining discharge in a discharge space of discharge cells being set to the emission enable state, by applying at least one discharge sustaining pulse between a scanning electrode and a common electrode constituting each row electrode pair, in a discharge sustaining period following the address period. The driving method also includes a step decreasing the applied voltage between the scanning electrode and the common electrode in steps when a final applied pulse out of the discharge sustaining pulse falls, and then decreasing the applied voltage toward a predetermined voltage having a polarity different from that of the maximum voltage of the final applied pulse. The driving method also includes a step of increasing gradually the applied voltage toward a base voltage, which is to be applied in the address period of the next subfield period following the discharge sustaining period, immediately after the applied voltage reaches the predetermined voltage.

According to a fourth aspect of the present invention, there is provided another driving method for a plasma display panel. The plasma display panel has a plurality of row electrode pairs, a plurality of column electrodes formed so as to face the row electrode pairs via discharge spaces, and a plurality of discharge cells formed in areas where the row electrode pairs and the column electrodes cross respectively. Discharge gas is sealed and a fluorescent layer is formed in each discharge cell. The driving method includes a step of dividing a display period in each field of an input video signal into a plurality of subfield periods. The driving method also includes a step of selectively generating an address discharge in the discharge cells by sequentially applying a scanning pulse, on which a positive polarity or a negative polarity based voltage is superimposed, to the scanning electrodes constituting the row electrode pairs, and applying a voltage pulse synchronizing with each scanning pulse to the column electrodes in an address period which is set in each subfield period, so as to generate an address discharge in selected cells out of the discharge cells, and set the selected cells to either an emission enable state or a non-emission state. The driving method also includes a step of generating a sustaining discharge in a discharge space of discharge cells being set to the emission enable state, by applying at least one discharge sustaining pulse between a scanning electrode and a common electrode constituting each row electrode pair, in a discharge sustaining period following the address period. The driving method also includes a step of decreasing the applied voltage between the scanning electrode and the common electrode in steps when a final applied pulse out of the discharge sustaining pulses falls, and then decreasing the applied voltage toward a predetermined voltage having a polarity different from that of the maximum voltage of the final applied pulse. The driving method also includes a step of increasing the applied voltage toward a base voltage which is to be applied in the address period of the next subfield period following the discharge sustaining period in steps, immediately after the applied voltage reaches the predetermined voltage.

BRIEF DESCRIPTION OF THE DRAWINGS

FIG. 15 is a diagram depicting an emission pattern of each discharge cell that can be implemented by the driving sequence in FIG. 13 and the conversion table;

FIG. 25 is a diagram depicting an emission pattern of each discharge cell that can be implemented by the driving sequence in FIG. 23 and the conversion table;

DETAILED DESCRIPTION OF THE INVENTION

Various embodiments of the present invention will now be described.

<Configuration of Plasma Display Device>

Figure 1:
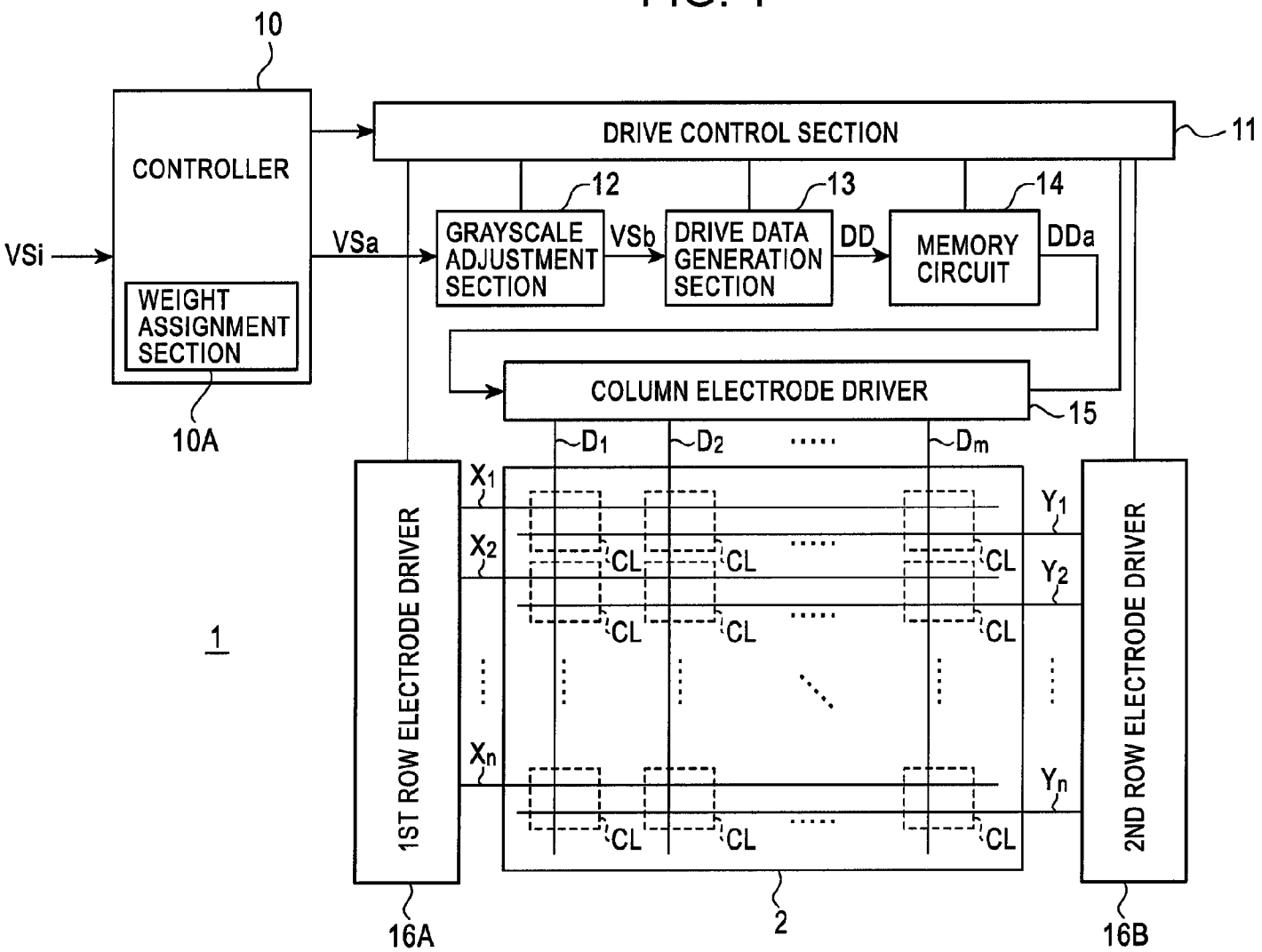
FIG. 1 is a diagram depicting a general configuration of a plasma display device according to an embodiment of the present invention.

FIG. 1 is a diagram depicting a general configuration of a plasma display device 1 according to an embodiment of the present invention. The plasma display device 1 has a plasma display panel (PDP)2, and also has a column electrode driving section 15 for driving discharge cells CL, . . . , CL in the plasma display panel 2, and a first row electrode driving section 16A and a second row electrode driving section 16B. The column electrode driving section 15, the first row electrode driving section 16A and the second row electrode driving section 16B constitute a "panel driving section" according to the present invention.

The plasma display device 1 has a controller 10, a grayscale adjustment section 12, a driving data generation section 13 and a memory circuit 14, as a signal processing section for processing video signals to be displayed on the plasma display panel 2. All or a part of these processing blocks 10 to 13 may be implemented by a hardware circuit configuration, or may be implemented by a program or program codes recorded in such a recording media as a non-volatile memory or an optical disk. Such a program or program codes have a processor, such as a CPU, execute all or a part of the processing of the processing blocks 10 to 13.

The controller 10 generates a video signal VSa by performing signal processing on an input video signal VSi, which is a digital signal, and transfers the video signal VSa to the grayscale adjustment section 12. The controller 10 also has a function to control the operation of a driving control section 11 using a synchronization signal (including a horizontal synchronization signal and a vertical synchronization signal) which is supplied from an external signal source (not illustrated), and a clock signal.

The controller 10 includes a weight assignment section 10A as a processing block. The weight assignment section 10A has a function to assign a weight of brightness according to the average brightness level of an input video signal VSi to the subfields constituting each field of the input video signal VSi respectively.

The grayscale adjustment section 12 generates a grayscale adjustment signal VSb by performing error diffusion processing and dither processing on the video signal VSa which is input from the controller 10. For example, the grayscale adjustment section 12 executes error diffusion for diffusing the lower 2 bits of the pixel data of the 8-bit video signal VSa into a higher 6 bits of the peripheral pixel data, and acquires a 6-bit signal. The grayscale adjustment section 12 can acquire a grayscale adjustment signal VSb in the higher 4 bits by adding elements of the dither matrix to the 6-bit signal acquired by error diffusion, and then performing a bit shift.

The driving data generation section 13 has a function to convert the grayscale adjustment signal VSb into a driving data signal DD according to a conversion table corresponding to the driving sequence of a subfield method. The memory circuit 14 temporarily stores the driving data signal DD, which is an output of the driving data generation section 13. At the same time, the memory circuit 14 reads the stored data in subfield units according to the control by the driving control section 11, and transfers the data signal DDa which was read to the column electrode driving section 15. In this way, the driving data generation section 13 and the memory circuit 14 in tandem have a function to divide each field of the grayscale adjustment signal VSb into a plurality of subfields, and generate data signal DDa to represent these subfields.

The column electrode driving section 15 generates an address pulse based on the data signal DDa transferred from the memory circuit 14, and applies address pulses to the column electrodes $D_1, \ldots, D_m$ (m is 2 or greater integer) of the plasma display panel 2 at a predetermined timing.

The plasma display panel 2 includes a plurality of discharge cells CL, . . . , CL which are arrayed on a plane in a matrix, m number of column electrodes (address electrodes) $D_1, \ldots, D_m$ which are extended from the column electrode driving section 15 in the column direction, n number (n is 2 or greater integer) of common electrodes $X_1, \ldots, X_n$ which are extended from the first electrode driving section 16A in the row direction, and n number of scanning electrodes $Y_1, \ldots, Y_n$ which are extended from the second row electrode driving section 16B in the row direction. A common electrode $X_j$ (j is a positive integer) and a corresponding scanning electrode $Y_j$ constitute one row electrode pair. In an area where the row electrode pair $X_j$ and $Y_j$ and the column electrode $D_k$ (k is a positive integer) cross, that is in an area corresponding to the intersection of the row electrode pair $X_j$ and $Y_j$ and the column electrode $D_k$, a discharge cell CL is formed. The row electrode pair $X_j$ and $Y_j$ and the column electrode $D_k$ are separated in the thickness direction of the substrate of the plasma display panel 2, and the discharge space in each discharge cell CL is formed between the electrode pairs $X_j$ and $Y_j$ and the column electrode $D_k$.

Figure 2:
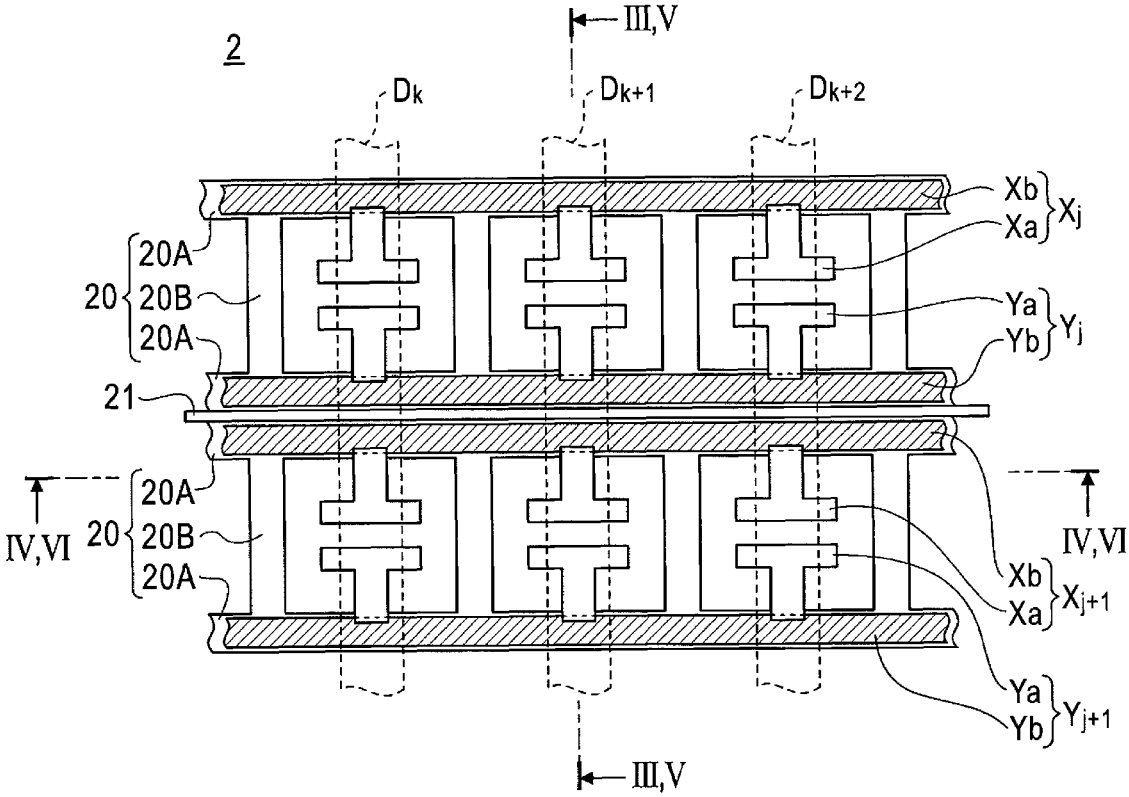
FIG. 2 is a plan view depicting a general configuration of a plasma display panel.
Figure 3:
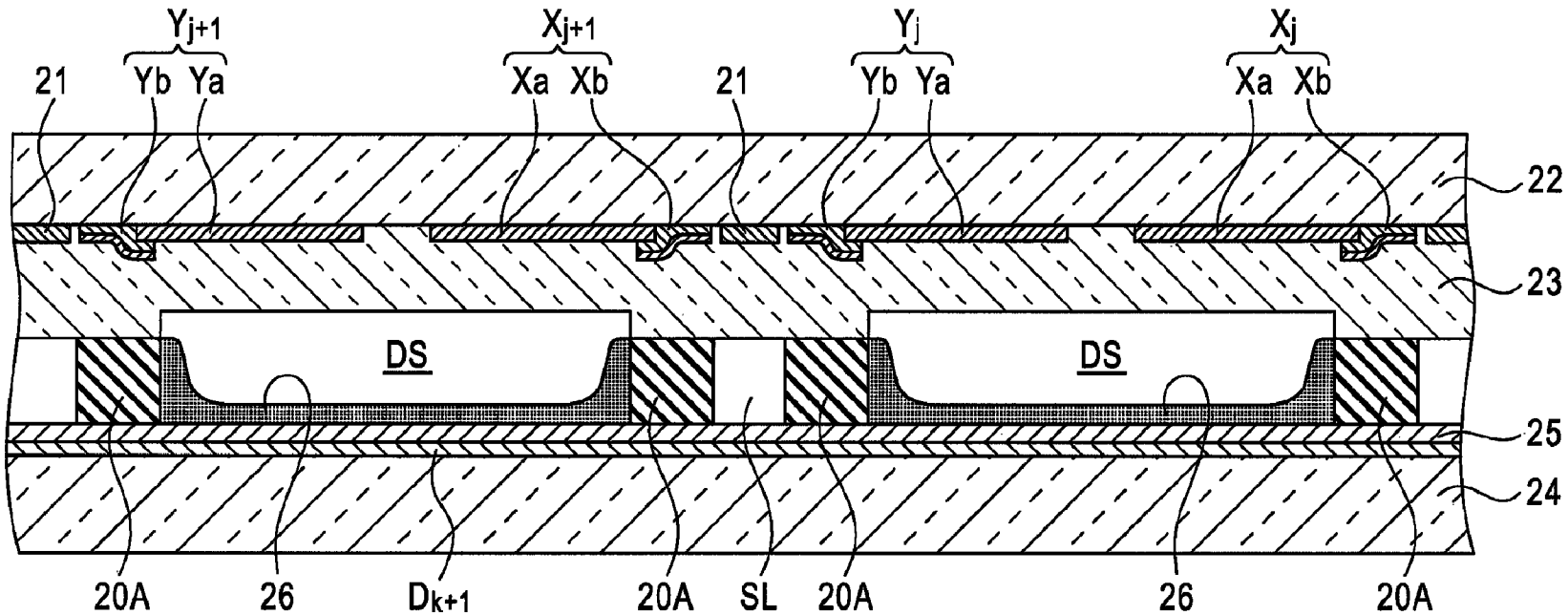
FIG. 3 is an example of a cross-sectional view of the plasma display panel in FIG. 2, sectioned at line III-III.

FIG. 2 is a plan view depicting an example of the configuration of the plasma display panel 2. FIG. 3 is a cross-sectional view of the plasma display panel 2 in FIG. 2 sectioned at line III-III, and FIG. 4 is a cross-sectional view of the plasma display panel 2 in FIG. 2 sectioned at line IV-IV.

Figure 4:
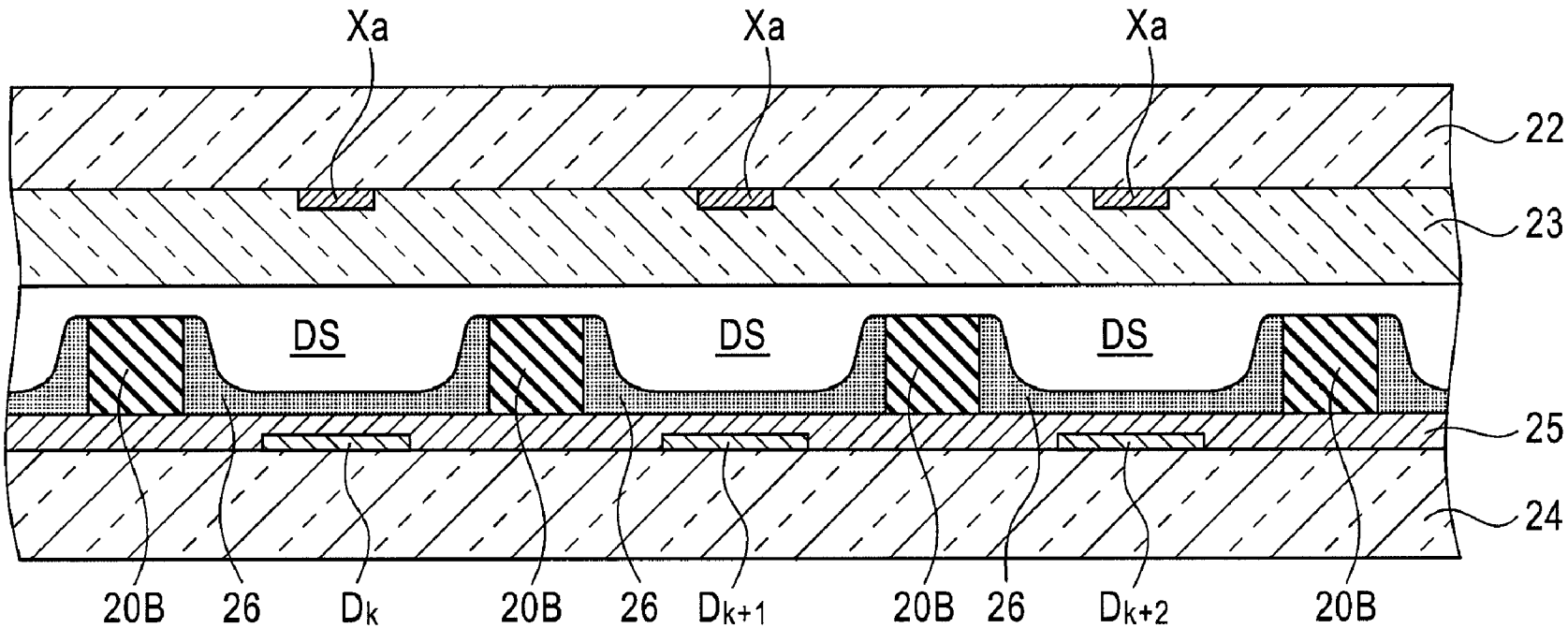
FIG. 4 is an example of a cross-sectional view of the plasma display panel in FIG. 2, sectioned at line IV-IV.

As FIG. 3 and FIG. 4 show, the plasma display panel 2 has a transparent substrate (front substrate) 22 and a back substrate 24. The row electrode pairs $X_j$, $Y_j$ and $X_{j+1}$, $Y_{j+1}$ are formed on the inner surface of the transparent substrate 22. Each common electrode $X_j$ has a first transparent electrode Xa and a first bus electrode Xb which is connected to the first transparent electrode Xa, and each scanning electrode $Y_j$ has a second transparent electrode Ya and a second bus electrode Yb which is connected to the second transparent electrode Ya. The first and second transparent electrodes Xa and Ya are formed of such transparent electrode material as ITO (Indium Tin Oxide) and $SnO_2$, and the first and second bus electrodes Xb and Yb are formed of conductive material having a relatively low electric resistance, such as Cr (chrome) and Cu (copper), to decrease the impedance of the row electrode pairs $X_j$, $Y_j$ and $X_{j+1}$, $Y_{j+1}$. Between the row electrode pair $X_j$, $Y_j$ and the row electrode pair $X_{j+1}$, $Y_{j+1}$, a black or dark color light absorption layer (black stripes) 21 is formed on the inner face of the transparent substrate 22.

A dielectric layer 23 is formed as a protective layer for covering the common electrodes $X_j$, $X_{j+1}$, scanning electrodes $Y_j$, $Y_{j+1}$ and light absorption layer 21. The dielectric layer 23 has a single layer or a multi-layer dielectric film, which is formed of a glass material, and a protective film covering this dielectric film, for example. An example of the protective film is an oxide film (e.g. MgO film) of an alkali earth material. As FIG. 2 shows, the first bus electrode Xb of the common electrode $X_j$, $X_{j+1}$ is extended in the row direction, and the first transparent electrode Xa protrudes from the first bus electrode Xb in the column direction and has a T-shaped tip. In the same manner, the second bus electrode Yb of the scanning electrode $Y_j$, $Y_{j+1}$ is extended in the row direction, and the second transparent electrode Ya protrudes from the second bus electrode Yb in the column direction and has a T-shaped tip, which faces the T-shaped tip of the first transparent electrode Xa. The light absorption layer 21, which exists between the row electrode pair $X_j$, $Y_j$ and the row electrode pair $X_{j+1}$, $Y_{j+1}$, is extended in the row direction, and has a function to improve contrast by dropping the external light reflectance.

Column electrodes $D_k$, $D_{k+1}$, $D_{k+2}$ are extended on the counter face of the back substrate 24 in the column direction, as shown in FIG. 2 to FIG. 4. A protective layer 25, which covers the column electrodes $D_k$, $D_{k+1}$, $D_{k+2}$, is formed of a white dielectric substance. Barriers 20 for forming a discharge space DS of each discharge cell CL are formed on the protective layer 25. Each barrier 20 has a pair of barriers 20A and 20A which are extended in the row direction, and a plurality of barriers 20B, 20B, . . . , which are extended in the column direction so as to connect with the pair of barriers 20A and 20A, as shown in FIG. 2. "SL" is a gap between the barriers 20A and 20A. As FIG. 3 and FIG. 4 show, a fluorescent layer 26 is coated on the side walls of the barriers 20 and the top face of the protective layer 25, below the electrode pairs $X_j$, $Y_j$ and $X_{j+1}$, $Y_{j+1}$. Each area enclosed by the barrier 20, the fluorescent layer 26 and the dielectric layer 23 constitute an individual discharge space DS. In a discharge space DS, such a discharge gas as Xenon is sealed in, and this discharge gas causes a gas discharge by an electric field which the potential difference between the common electrode $X_j$ and the scanning electrode $Y_j$, or the potential difference between one of the common electrode $X_j$ and the scanning electrode $Y_j$ and the column electrode $D_{k+1}$ forms in the discharge space DS, and generates ultraviolet. This ultraviolet excites excitons (e.g. electrons, holes) in the fluorescent layer 26, and causes the fluorescent layer 26 to emit visible light having a luminescent color (red, green or blue) of the fluorescent layer 26.

One pixel cell has a plurality of display cells CL, . . . , CL. For example, one pixel cell has a display cell CL having a red emitting fluorescent layer, a display cell CL having a green emitting fluorescent layer, and a display CL having a blue emitting fluorescent layer. Displaying grayscales for one pixel may be implemented by a plurality of display cells CL, . . . , CL according to an area grayscale method.

Figure 5:
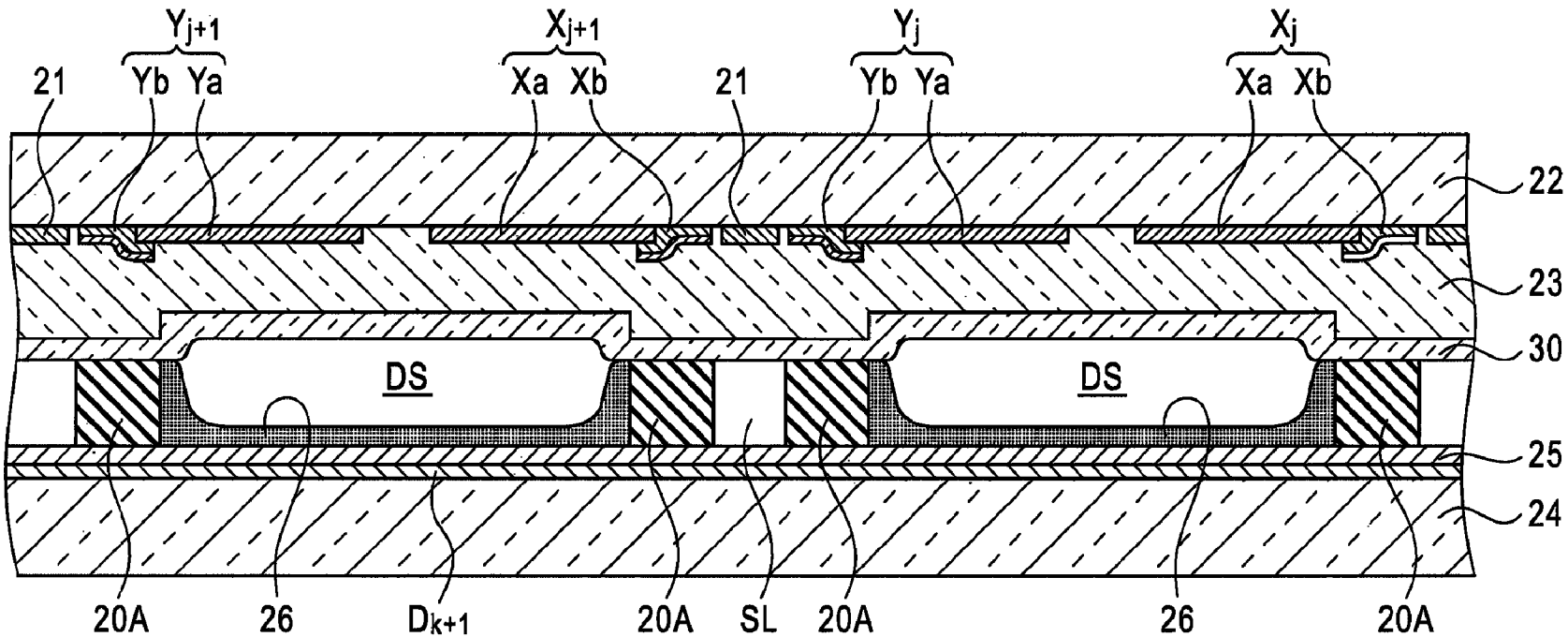
FIG. 5 is another example of a cross-sectional view of the plasma display panel in FIG. 2, sectioned at line V-V.
Figure 6:
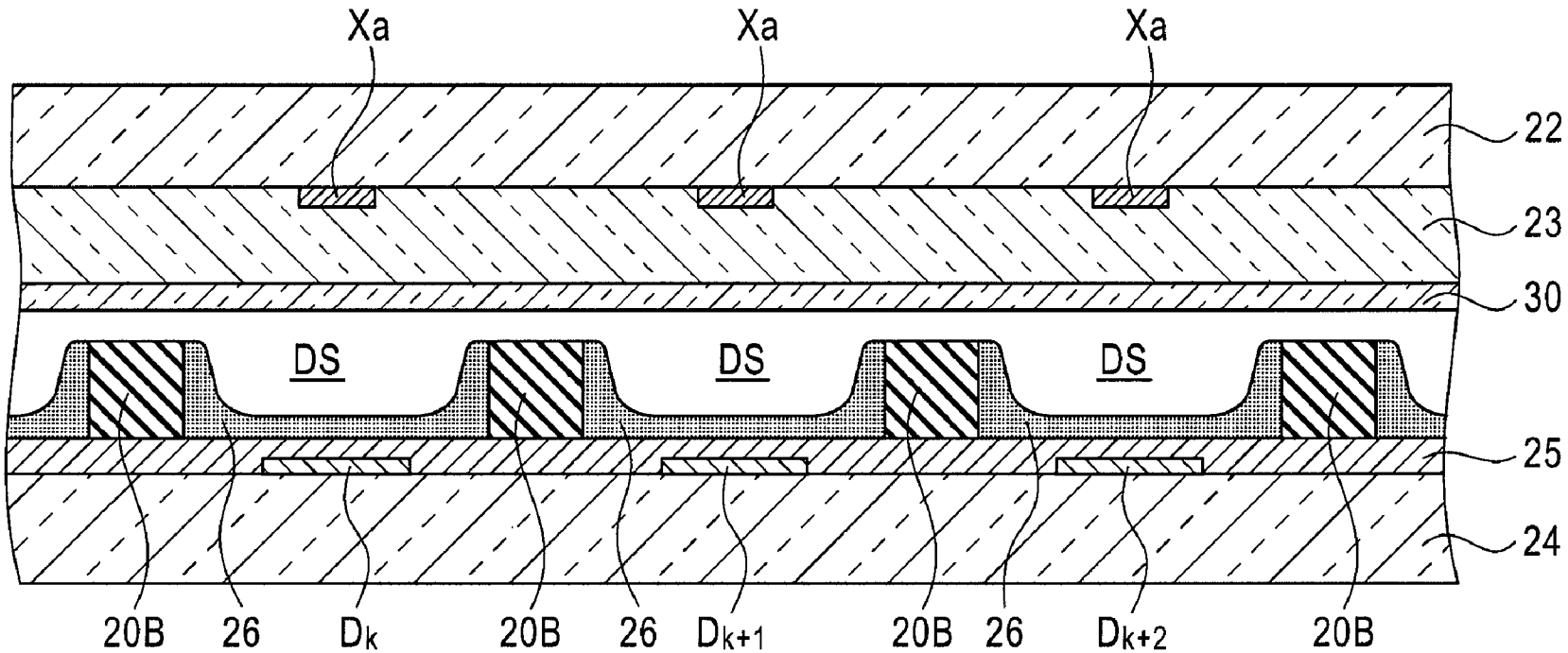
FIG. 6 is another example of a cross-sectional view of the plasma display panel in FIG. 2, sectioned at line VI-VI.

FIG. 5 and FIG. 6 are cross-sectional views depicting another configuration example of the plasma display panel 2. FIG. 5 is a cross-sectional view of the plasma display panel 2 in FIG. 2 sectioned at line V-V, and FIG. 6 is a cross-sectional view of the plasma display panel 2 in FIG. 2 sectioned at line VI-VI. In the plasma display panel 2 in FIG. 5 and FIG. 6, an electron emission layer 30 is formed so as to cover a dielectric layer 23. A configuration other than the electron emission layer 30 is roughly the same as the configuration in FIG. 3 and FIG. 4. The electron emission layer 30 can be formed by a sputtering method, for example.

The electron emission layer 30 emits ion-induced secondary electrons at a high secondary emission rate (γ value) by receiving the irradiation of charged particles, such as ions and electrons, and contains electron emission material which emits electrons by receiving an electric field (hereafter called "initial electrons"). As the discharge cells CL become smaller to implement a high precision plasma display device 1, a drop in emission efficiency and an increase in discharge delay become problems. The ion-induced secondary electrons and initial electrons are for improving the discharge delay by causing a priming effect to drop the discharge start voltage. In particular, if magnesium oxide crystals are used as the electron emission material, the discharge delay can be improved. Magnesium oxide crystals can be obtained by a process of generating a crystalline nucleus by a vapor oxidation reaction of magnesium oxide vapor and oxygen, and allowing this generated crystalline nucleus to grow.

Figure 7:
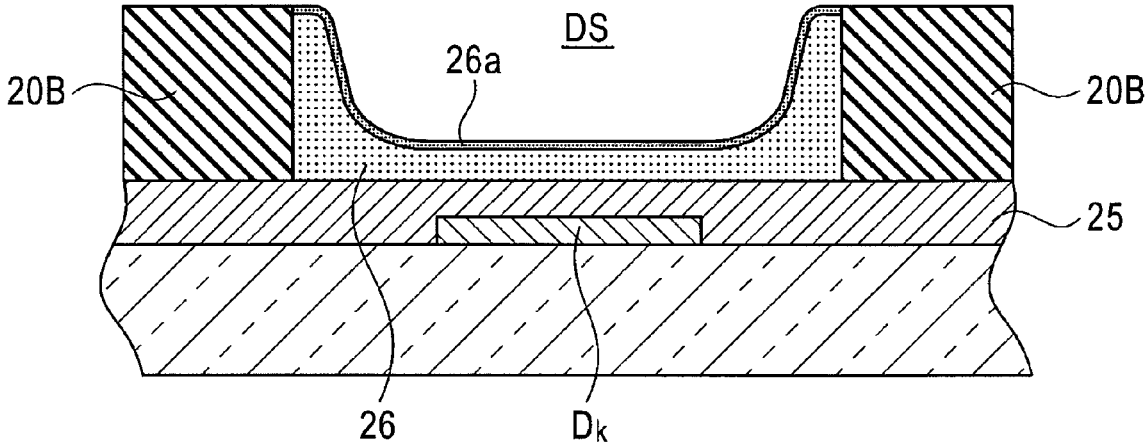
FIG. 7 is a diagram depicting an electron emission film formed on a fluorescent layer of a discharge cell.
Figure 8:
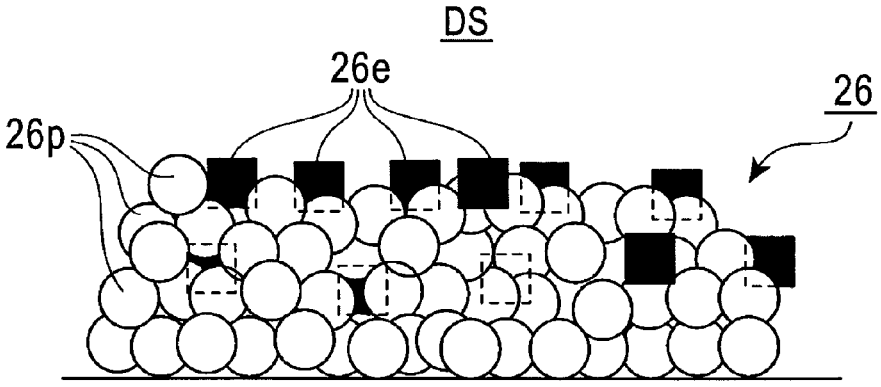
FIG. 8 is a diagram depicting crystal particles of an electron emission material, which scatter in the fluorescent layer of the discharge cell.

To further improve the discharge delay, a thin film of electron emission material may be formed on the fluorescent layer 26, or crystal particles of the electron emission material may be mixed in the fluorescent layer 26 so as to be exposed to the discharge space DS. FIG. 7 is a diagram depicting an electron emission film 26*a* which is formed on the fluorescent layer 26, and FIG. 8 is a diagram depicting crystal particles 26*e*, 26*e*, . . . , of electron emission material which are scattered throughout the fluorescent layer 26. As FIG. 8 shows, crystal particles 26*e*, . . . , and fluorescent material particles 26*p*, 26*p* . . . , constitute the fluorescent layer 26 in a state exposed to the discharge space DS. If the electron emission film 26*a* in FIG. 7 and the crystal particles 26*e* of the electron emission material in FIG. 8 are used, when a counter-discharge is caused in the discharge space DS by applying a pulse having a negative voltage polarity to the column electrode $D_k$ and applying a pulse having a positive voltage polarity to the common electrode $X_j$ or the scanning electrode $Y_j$, ion-induced secondary electrons and initial electrons (priming particles) are emitted from the electron emission film 26*a* and the crystal particles 26*e* which causes the priming effect, and the discharge delay improves.

Figure 9:
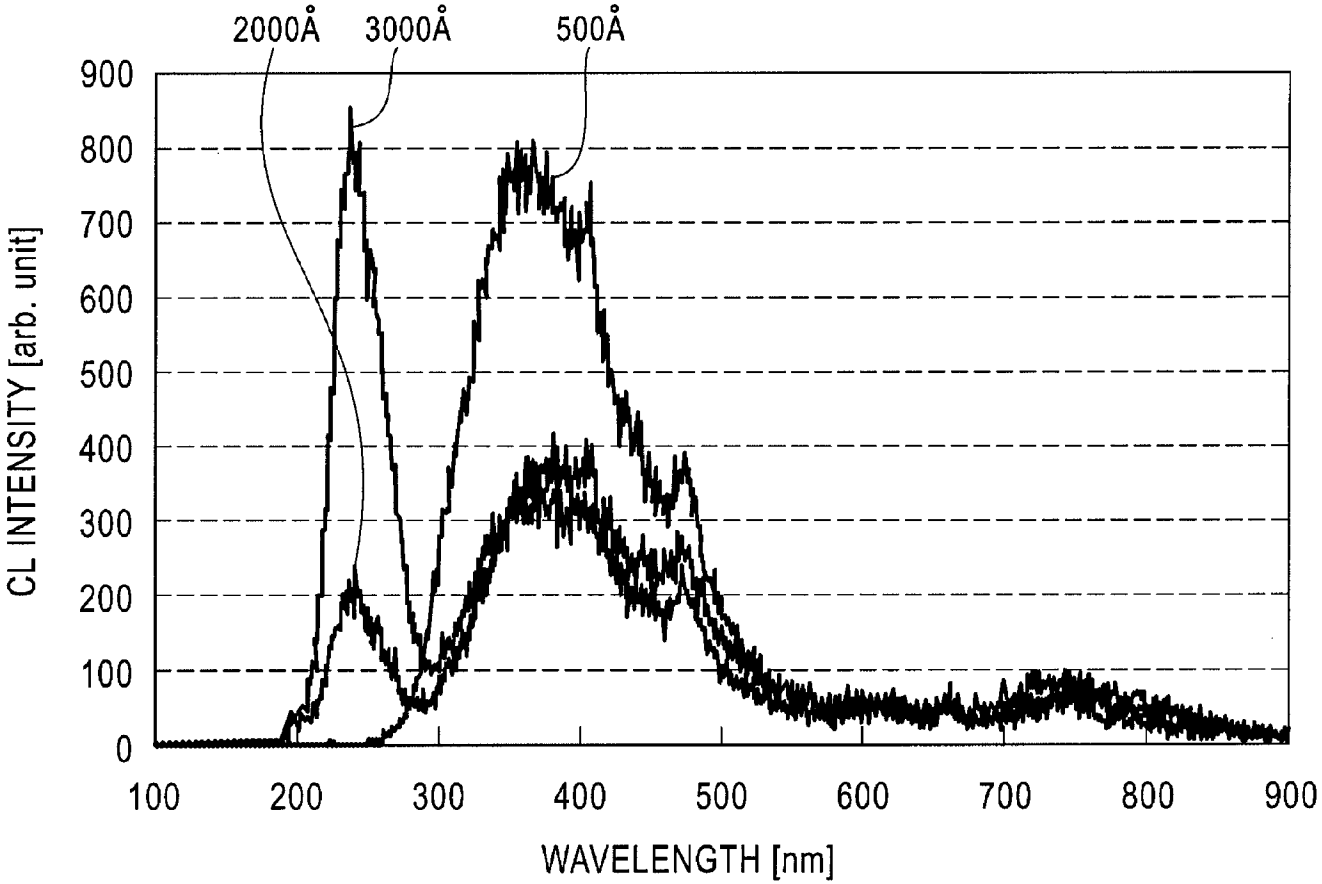
FIG. 9 is a graph depicting a measured example of a spectrum (emission intensity with respect to wavelength) of a magnesium oxide crystal.

In terms of improving the discharge delay considerably, it is preferable to use a crystal material containing a cathode luminescence material, which is excited by electron beam irradiation and has an emission peak in the wavelength range of 200 to 300 nm, as the magnesium oxide crystal, and it is more preferable to use a crystal material containing a cathode luminescence material, which has an emission peak in the wavelength range of 230 to 250 nm. FIG. 9 shows a measurement example of a spectrum (emission intensity with respect to wavelength) of a magnesium oxide crystal. The graph in FIG. 9 shows a measurement result of a crystalline sample having a 500 angstrom, 2000 angstrom and 3000 angstrom average particle size, measured by a BET method. FIG. 9 also shows the first CL emission (cathode luminescence emission) which has a peak in the wavelength range of about 300 to 400 nm, and the second CL emission which has a peak at about 200 to 300 nm, particularly in the wavelength range of 230 to 250 nm. FIG. 9 shows that the second CL emission has a peak at about 235 nm. Such a magnesium oxide crystal has not only a high secondary electron emission rate (γ value), but also a high initial electron emission rate, and this results in improving the priming effect.

Figure 10:
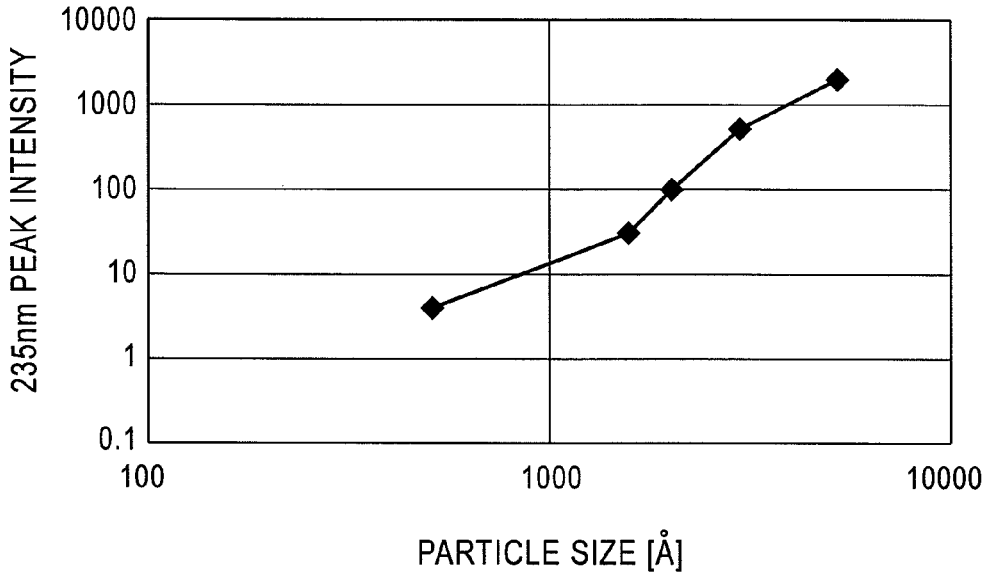
FIG. 10 is a graph depicting a relationship between the particle size of a mono-crystal of magnesium oxide, and a peak intensity corresponding to a 235 nm emission wavelength.

It is preferable that the magnesium oxide crystals have a poly-crystalline structure having inter-fitting cubic crystals, or have a cubic mono-crystalline structure, and is more preferable to have more crystals having an average particle size of 2000 angstrom or larger. The average particle size of the crystals can be measured by a BET (Brunauer-Emmette-Teller) method, based on the measurement result of the gas absorption amount to a sample. In order to generate magnesium oxide crystals of which the average particle size is 2000 angstrom or larger, the heating temperature required for the vapor phase oxidation reaction must be set high. By making the length of the flame longer to generate this heating temperature, and increasing the difference between this flame temperature and the ambient temperature, the amount of magnesium to be evaporated per unit time is increased, and the reaction area between the magnesium vapor and oxygen is increased, whereby many crystals which have a large particle size and many emission peaks in the above mentioned wavelength range can be obtained. FIG. 10 is a graph depicting a relationship of a particle size (unit: angstrom) of a mono-crystal of magnesium oxide and the peak intensity (unit: arbitrary (arb. unit)) corresponding to a 235 nm emission wavelength. As FIG. 10 shows, the peak intensity tends to become higher as the particle size of a mono-crystal increases.

Figure 11:
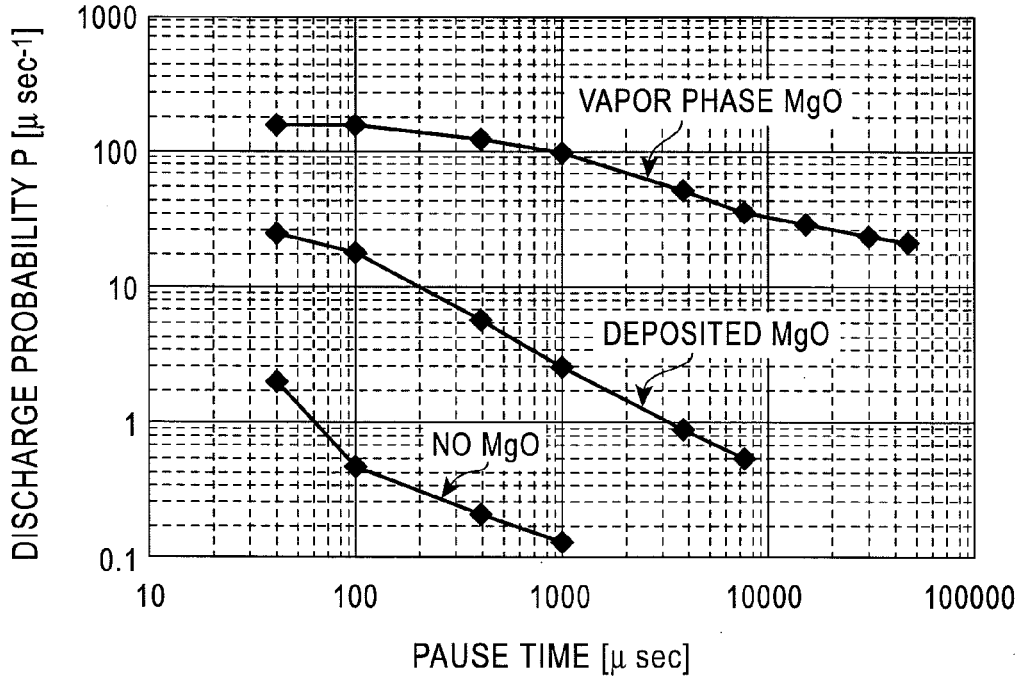
FIG. 11 is a graph depicting a relationship of a pause time of a discharge and a discharge probability in a discharge cell.
Figure 12:
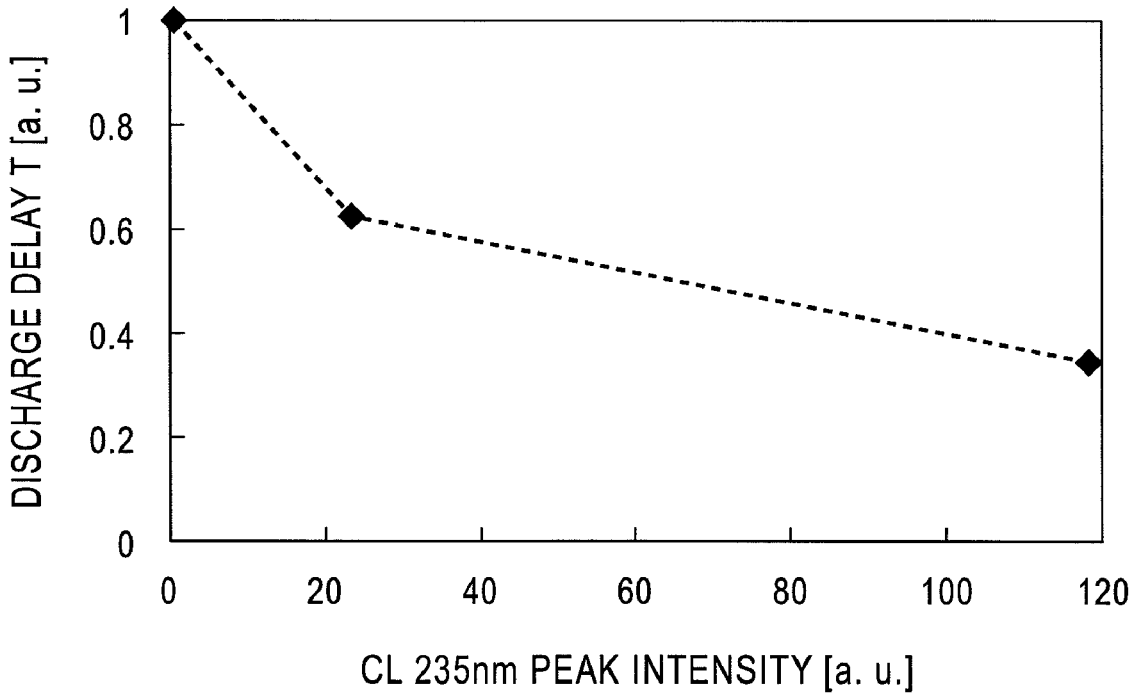
FIG. 12 is a graph depicting a relationship of a peak intensity at about 235 nm emission wavelength and a discharge delay when a crystal of magnesium oxide is used.

FIG. 11 is a graph depicting the relationship of discharge pausing time and discharge probability in the discharge cell CL. FIG. 11 shows a graph when the electron emission layer 30, formed of magnesium oxide crystals having an emission peak in the wavelength range of 200 to 300 nm (FIG. 5), is formed in the discharge cell CL (in the case of "vapor phase MgO"), a graph when only the conventional protective layer formed of magnesium oxide is formed in the discharge cell CL by a deposition method (in the case of "deposited MgO"), and a graph when a magnesium oxide layer is not formed in the discharge cell CL (in the case of "no MgO"). According to FIG. 11, in the discharge cell CL which has the electron emission layer 30 formed of magnesium oxide crystals, the discharge delay is improved compared with other discharge cells CL. FIG. 12 is a graph depicting the relationship between the peak intensity (unit: arb. unit) in about a 235 nm emission wavelength and the discharge delay (unit: arb. unit) when the above mentioned magnesium oxide crystals are used. As FIG. 12 shows, the discharge delay decreases as the peak intensity in about a 235 nm emission wavelength increases.

The operation of the plasma display device 1 having the above configuration will now be described.

First Embodiment

Figure 13:
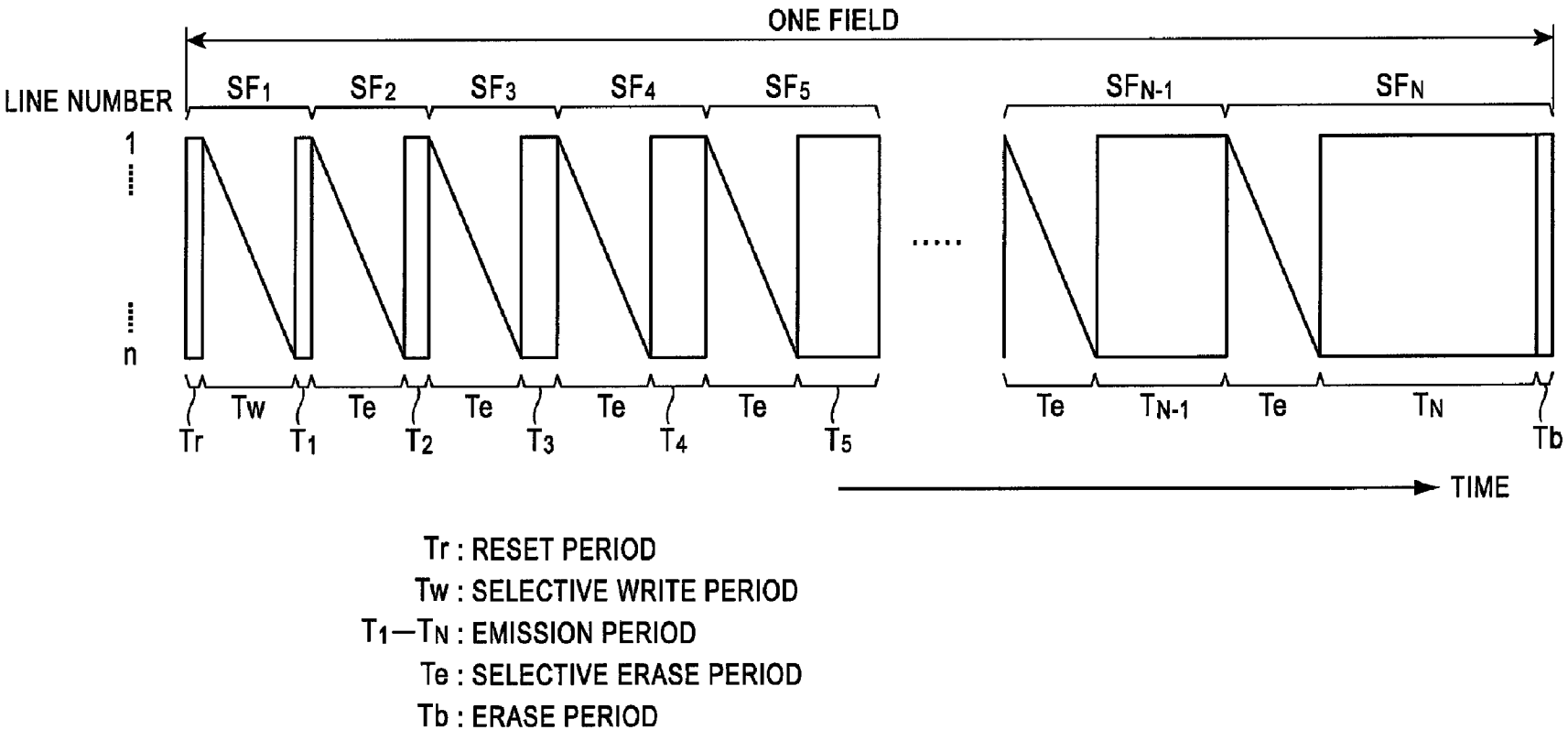
FIG. 13 is a diagram depicting a driving sequence according to the first embodiment of the present invention.
Figure 14:
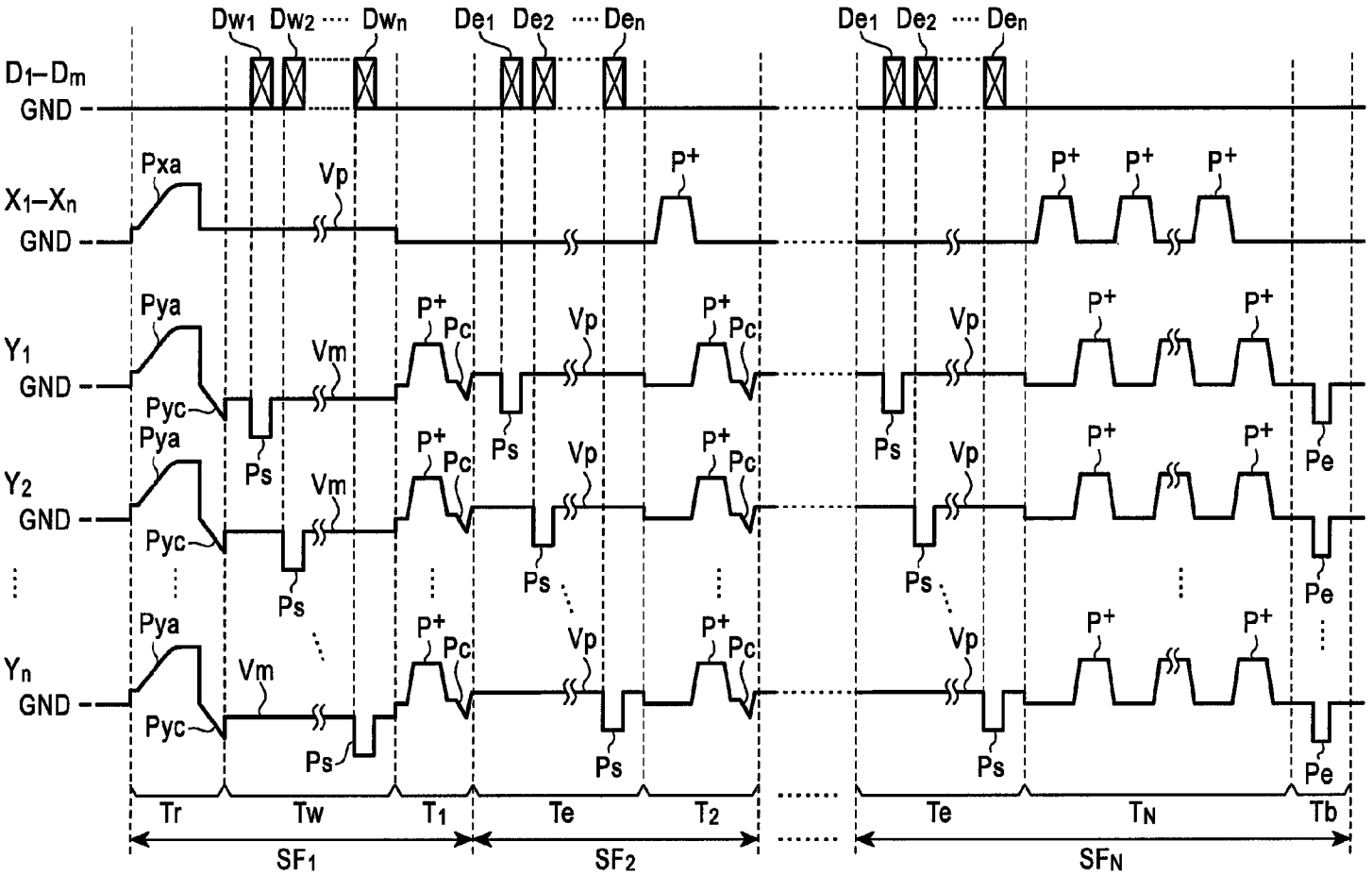
FIG. 14 is a timing chart depicting a waveform of a driving signal based on the driving sequence in FIG. 13.

FIG. 13 is a diagram depicting a driving sequence according to a first embodiment of the present invention. In this driving sequence, one field of a video signal is divided into N number (N is 2 or greater integer) of subfields $SF_1, \ldots, SF_N$, which are arrayed continuously in the display sequence. The plasma display device 1 displays these subfields $SF_1, \ldots, SF_N$ sequentially on the plasma display panel 2 whereby human eyes can recognize one multi-grayscale image. FIG. 14 is a timing chart depicting waveforms of driving signals according to the driving sequence in FIG. 13. FIG. 14 shows a signal waveform which is applied to the column electrodes $D_1$ to $D_n$, a signal waveform which is applied to the common electrodes $X_1$ to $X_n$, and a signal waveform which is applied to the scanning electrodes $Y_1, \ldots, Y_n$ respectively.

FIG. 15 is a diagram depicting an emission pattern of each discharge cell CL which can be implemented by the driving sequence in FIG. 13 and the conversion table. FIG. 15 shows the relationship between the grayscale level of the video signal and the corresponding emission pattern when each field of the video signal is divided into 14 subfields $SF_1$ to $SF_{14}$. The conversion table shows the correspondence of the 4-bit value of the grayscale adjustment signal VSb and the 14-bit value of the driving data signal DD. The driving data generation section 13 can convert the grayscale adjustment signal VSb into the driving data signal DD according to this conversion table.

As FIG. 13 shows, in the display period of the first subfield $SF_1$, a reset period Tr, selective write period (address period)

Tw, and emission period (discharge sustaining period) $T_1$ are set. In each display period of the second or later subfields $SF_2$ to $SF_N$, a selective erase period Te and emission period $T_q$ (q is an integer in 2 to N) are set. In the display period of the last subfield $SF_N$, an erase period Tb is set in addition to the selective erase period Te and emission period $T_N$. The weight assignment section 10A in FIG. 1 assigns a respective weight of brightness to the subfields $SF_1$ to $SF_N$, and the lengths of the emission periods $T_1$ to $T_N$ of the subfields $SF_1$ to $SF_N$ are controlled to have a time length, which is in proportion to the weight of brightness respectively.

As FIG. 14 shows, in the reset period Tr of the display period of the first subfield $SF_1$, the column electrode driving section 15 in FIG. 1 clamps the potentials of the column electrodes $D_1$ to $D_m$ to the ground potential (GND). In this state, the first row electrode driving section 16A gradually and gently increases the applied voltage to the common electrodes $X_1$ to $X_n$ from a predetermined level as time elapses, so that a reset pulse Pxa having a positive voltage polarity is applied to the common electrodes $X_1$ to $X_n$. The second row electrode driving section 16B gradually and gently increases the applied voltage to the scanning electrodes $Y_1$ to $Y_n$ from a predetermined level as time elapses, so that a reset pulse Pya having a positive voltage polarity is applied to the scanning electrodes $Y_1$ to $Y_n$. By this, a voltage of which anode is the scanning electrode $Y_j$ and cathode is the column electrode $D_k$ is applied between the scanning electrode $Y_j$ and the column electrode $D_k$ in each discharge cell CL, and a rest discharge is generated in the discharge space DS of the discharge cell CL, thereby such charged particles as ions and electrons are generated. Out of the generated charged particles, positive charge particles are attracted to a wall face close to the cathode $D_k$, and negative charge particles are attracted to a wall face close to the anode $Y_k$, so current flows from the anode $Y_j$ to the cathode $D_k$, and the reset discharge stops. As a result, negative charge particles are stored on the wall face of the dielectric layer 23 close to the scanning electrodes $Y_1$ to $Y_n$, and positive charge particles are stored on the wall face of the fluorescent layer 26 (FIG. 3 or FIG. 5) close to the column electrodes $D_1$ to $D_m$.

In the remaining time of the reset period Tr, the column electrode driving section 15 clamps the potentials of the column electrodes $D_1$ to $D_m$ to the ground potential, and the first row electrode driving section 16A applies a positive polarity base voltage Vp, which is higher than the ground potential, to the common electrodes $X_1$ to $X_n$. The second row electrode driving section 16B decreases the applied voltage to the scanning electrodes $Y_1$ to $Y_n$ as time elapses, so that the charge adjustment pulse Pyc having a negative voltage polarity to the scanning electrodes $Y_1$ to $Y_n$ is applied. By this, the migration of charged particles or weak discharge between the scanning electrode $Y_j$ and column electrode $D_k$ is generated in the discharge cell CL, and wall charge distribution is adjusted. As a result, all the discharge cells CL are set to the non-emission state (light OFF mode) and have wall charge distribution, which can generate an address discharge with certainty in the later mentioned selective write period Tw.

In the selective write period Tw, the first row electrode driving section 16A applies a positive polarity base voltage Vp, which is higher than the ground potential, to the common electrodes $X_1$ to $X_n$, and the second row electrode driving section 16B applies a negative polarity base voltage Vm, which is lower than the ground potential, to the scanning electrodes $Y_1$ to $Y_n$. In this state, the second row electrode driving section 16B sequentially applies a scanning pulse Ps, which is superimposed on the base voltage Vm, to the scanning electrodes $Y_1, \ldots, Y_n$. The column electrode driving section 15 applies the write pulse group $Dw_1, \ldots, Dw_n$, having a positive voltage polarity, to the column electrodes $D_1, \ldots, D_m$, synchronizing with each scanning pulse Ps respectively. For example, while the scanning pulse Ps is being applied to the first scanning electrode $Y_1$, the write pulse group $Dw_1$ synchronizing with this scanning pulse Ps is applied to the column electrodes $D_1, \ldots, D_m$. Then while the scanning pulse Ps is being applied to the second scanning electrode $Y_2$, the write pulse group $Dw_2$ synchronizing with this scanning pulse Ps is applied to the column electrodes $D_1, \ldots, D_m$. Generally while the scanning pulse Ps is being applied to the j-th scanning electrode $Y_j$, the write pulse group $Dw_j$ synchronizing with this scanning pulse Ps is applied to the column electrodes $D_1, \ldots, D_m$. By this, a write discharge is selectively generated in the discharge cells CL, . . . , CL of the plasma display panel 2, and only selected cells CL out of the discharge cells CL are set to the emission enable state (light ON mode).

More specifically, when the write pulse synchronizing with the scanning pulse Ps, which is applied to the scanning electrode $Y_j$, is applied to the column electrode $D_k$, voltage, of which cathode is the scanning electrode $Y_j$ and anode is the column electrode $D_k$, is applied between the scanning electrode $Y_j$ and the column electrode $D_k$, thereby a write discharge is generated in the discharge space DS, and such charged particles as ions and electrons are generated. Out of the generated charged particles, positive charge particles are attracted to a wall face close to the cathode $Y_j$, and negative charge particles are attracted to a wall face close to the anode $D_k$, and the write discharge stops. As a result, charged particles, that is wall charges, having a different charge polarity from each other, are stored on the wall face close to the common electrode $X_j$ and the wall face close to the scanning electrode $Y_j$. The discharge cells CL having such a wall charge distribution are set to the emission enable state (light ON mode). On the other hand, the write discharge is not generated in the discharge cells CL where the write pulse synchronizing with the scanning pulse Ps is not applied to the column electrode $D_k$. Such a discharge cell CL is in the non-emission state.

In the emission period (discharge sustaining period) $T_1$ of the first subfield $SF_1$, the potentials of the column electrodes $D_1$ to $D_m$ are clamped to the ground potential, and the potentials of the common electrodes $X_1$ to $X_n$ are also clamped to the ground potential, as shown in FIG. 14. In this state, the second row electrode driving section 16B applies a voltage pulse, of which anode is the scanning electrode $Y_j$ and cathode is the common electrode $X_j$, between the scanning electrode $Y_j$ and common electrode $X_j$ constituting each row electrode pair, as a discharge sustaining pulse $P^+$. This discharge sustaining pulse $P^+$ is superimposed on the voltage formed by existing wall charges in the discharge cell CL in the emission enable state. By this, a surface discharge is generated between the scanning electrode $Y_j$ and common electrode $X_j$, and a counter-discharge is generated between the scanning electrode $Y_j$ and column electrode $D_k$. Ultraviolet generated by these gas discharges excite the excitons in the fluorescent layer 26, and allows visible light to be emitted. Out of the charged particles generated by these discharges, positive charge particles are attracted to the cathode $X_j$, and negative charge particles are attracted to the anode $Y_j$ and column electrode $D_k$. As a result, the charge polarity of the wall face close to the common electrode $X_j$ and the charge polarity of the wall face close to the scanning electrode $Y_j$ are reversed.

Figure 16A:
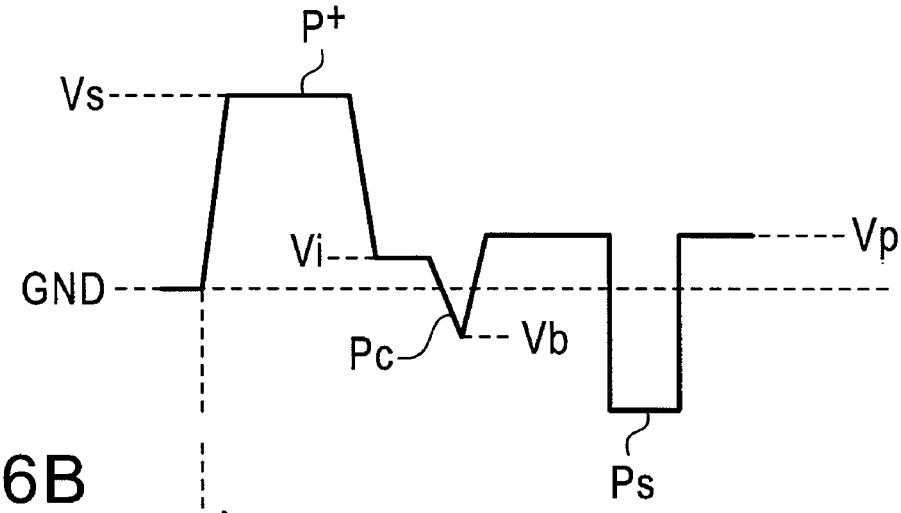
FIG. 16A is a timing chart depicting a waveform of a discharge sustaining pulse and a waveform of a charge adjustment pulse which continues therefrom.
Figure 16B:
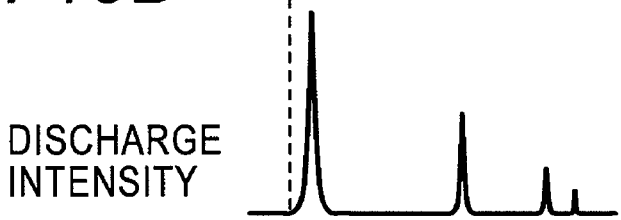
FIG. 16B is a graph depicting the intensity of a gas discharge which is generated in the discharge cell corresponding to the waveform of FIG. 16A.

In the emission period $T_1$, the second row electrode driving section 16B decreases the applied voltage between the scanning electrode $Y_j$ and common electrode $X_j$ in steps (stepwise) when the discharge sustaining pulse $P^+$ falls, then decreases this applied voltage toward a predetermined setting voltage Vb having a polarity different from that of the maximum voltage of the discharge sustaining pulse $P^+$. FIG. 16A is a timing chart depicting a waveform of the discharge sustaining pulse $P^+$ and a waveform of a charge adjustment pulse Pc which continues therefrom. FIG. 16B is a graph depicting the intensity of the gas discharge generated in the discharge cell CL corresponding to the waveform of FIG. 16A. The discharge intensity shown in FIG. 16B can be measured by detecting the light emitted from the fluorescent layer 26 according to the gas discharge by a high sensitivity camera device, for example.

As FIG. 16A shows, the voltage value of the discharge sustaining pulse $P^+$ increases from the ground potential (GND) at a rise, and sustains the maximum voltage Vs for a predetermined time, and decreases toward the ground potential at a fall. When the discharge sustaining pulse $P^+$ rises, a relatively strong sustaining discharge is generated when the voltage value of the discharge sustaining pulse $P^+$ is rising from the ground potential to the maximum voltage, or immediately after reaching the maximum voltage.

Then as FIG. 16A shows, the second row electrode driving section 16B sustains the applied voltage at an intermediate voltage Vi, which is higher than the ground potential and is lower than the maximum voltage Vs, then decreases this applied voltage toward a setting voltage Vb, which is lower than the intermediate voltage Vi and has a polarity that is different from the voltage polarity of this intermediate voltage Vi. The second row electrode driving section 16B can sustain the applied voltage between the common electrode $X_j$ and scanning electrode $Y_j$ at a roughly constant intermediate voltage Vi for a predetermined time by setting the potential of the scanning electrode $Y_j$ to high impedance (HiZ), that is a floating potential for a predetermined time.

After allowing this applied voltage to transit from the intermediate voltage Vi to the setting voltage Vb, the second row electrode driving section 16B increases this applied voltage to a positive polarity base voltage Vp which is higher than the ground potential, whereby the charge adjustment pulse Pc, having a wedge type waveform, is applied. When wall charge distribution disperses among the discharge cells CL due to the dispersion of discharge start voltage among the discharge cells CL, the charge adjustment pulse Pc can decrease the dispersion, and can therefore expand the margin of the driving voltage. As mentioned later, the base voltage Vp is for preventing the generation of a discharge (address discharge) in the discharge cells CL on lines other than the line currently being scanned in an address period Te in the next subfield $SF_2$. As FIG. 16B shows, a weak discharge is generated at the fall of the charge adjustment pulse Pc (that is the period where the voltage value of the charge adjustment pulse Pc transits from the ground potential to the setting voltage Vb), and a weaker discharge is also generated at the rise of the charge adjustment pulse Pc (that is the period where the voltage value of the charge adjustment pulse Pc transits from the setting voltage Vb to the base voltage Vp).

Therefore the fall edge section (rear edge section) of the discharge sustaining pulse $P^+$ has a first block where the applied voltage between the common electrode $X_j$ and scanning electrode $Y_j$ changes from the maximum voltage Vs of the discharge sustaining pulse $P^+$ to the intermediate voltage Vi, a second block where this applied voltage is sustained at a roughly constant intermediate voltage Vi for a predetermined time, and a third block where this applied voltage changes from the intermediate voltage Vi to the setting voltage Vb.

In the emission period $T_1$, the number of discharge sustaining pulses $P^+$ is one, in order to improve the grayscales representation capability for low brightness images, but this is not limited to one. Just like the cases of the later mentioned other emission periods, the discharge sustaining pulse $P^+$ may be repeatedly applied between the scanning electrode $Y_j$ and common electrode $X_j$ constituting each row electrode pair.

Then in the selective erase period Te in the subfield $SF_2$, the first row electrode driving section 16A applies the ground potential to the common electrodes $X_1$ to $X_n$, and the second row electrode driving section 16B applies the positive polarity base voltage Vp, which is higher than the ground potential, to the scanning electrodes $Y_1$ to $Y_n$. In this state, the second row electrode driving section 16B sequentially applies the scanning pulse Ps, which is superimposed on the base voltage Vp, to the scanning electrodes $Y_1, \ldots, Y_n$. The column electrode driving section 15 applies each erase pulse group $De_1, \ldots, De_n$ having a positive voltage polarity to the column electrodes $D_1$ to $D_m$, synchronizing with each scanning pulse Ps. For example, when the scanning pulse Ps is applied to the first scanning electrode $Y_1$, the erase pulse group $De_1$, synchronizing with this scanning pulse Ps, is applied to the column electrodes $D_1$ to $D_m$, and when the scanning pulse Ps is applied to the second scanning electrode $Y_2$, the erase pulse group $De_2$, synchronizing with this scanning pulse Ps, is applied to the column electrodes $D_1$ to $D_m$. Generally, when the scanning pulse Ps is applied to the j-th scanning electrode $Y_j$, the erase pulse group $De_j$ synchronizing with this scanning pulse Ps is applied to the column electrodes $D_1$ to $D_m$. By this, an erase discharge (address discharge) is selectively generated in the selected cells CL out of the discharge cells CL, . . . , CL in the emission enable state, and the selected cells CL are set to the non-emission state (light OFF mode). As FIG. 14 shows, the base voltage Vp is applied to all the scanning electrodes $Y_1$ to $Y_n$ while the scanning pulse Ps is sequentially applied, so when the scanning pulse Ps is being applied to a certain scanning electrode $Y_j$, an erase discharge is generated only in the discharge cells CL on this scanning electrode $Y_j$, and the generation of a discharge error is prevented in the discharge cells CL on the other scanning electrodes $Y_j$ to which the scanning pulse Ps is not applied.

In the emission period (discharge sustaining period) $T_2$ following the selective erase period Te, the potential of the column electrodes $D_1$ to $D_m$ are clamped to the ground potential, as shown in FIG. 14. In this state, the first row electrode driving section 16A applies the discharge sustaining pulse $P^+$, of which cathode is the scanning electrode $Y_j$ and the anode is the common electrode $X_j$, between the scanning electrode $Y_j$ and the common electrode $X_j$ constituting each row electrode pair. By this, a surface discharge is generated between the scanning electrode $Y_j$ and common electrode $X_j$, and the charge polarity on the wall face close to the scanning electrode $Y_j$ and the charge polarity on the wall face close to the common electrode $X_j$ are reversed. Ultraviolet generated by the gas discharge excites the excitons in the fluorescent layer 26, and allows visible light to be emitted. Out of the charged particles generated by the discharge, negative charge particles are attracted to the anode $X_j$ and positive charge particles are attracted to the cathode $Y_j$. Then the second row electrode driving section 16B applies the discharge sustaining pulse $P^+$, of which anode is the scanning electrode $Y_j$ and the cathode is the common electrode $X_j$, between the scanning electrode $Y_j$ and the common electrode $X_j$ constituting each row electrode pair. By this, a surface discharge is generated between the scanning electrode $Y_j$ and the common electrode $X_j$, and the charge polarity on the wall face close to the scanning electrode $Y_j$ and the charge polarity on the wall face close to the common electrode $X_j$ are reversed.

At the fall of the final applied pulse $P^+$, out of the discharge sustaining pulses $P^+$ which are applied in the emission period $T_2$, the second row electrode driving section 16B decreases the applied voltage between the scanning electrode $Y_j$ and common electrode $X_j$ constituting each row electrode pair in steps (stepwise), then decreases this applied voltage toward the setting voltage Vb having a polarity different from that of the maximum voltage of the final applied pulse $P^+$, and applies the charge adjustment pulse Pc to the scanning electrodes $Y_1$ to $Y_n$. The waveforms of the fall edge section of the final applied pulse $P^+$ and the charge adjustment pulse Pc are the same as the waveform shown in FIG. 16A.

Then in each selective erase period Te of the subfields $SF_3$ to $SF_N$, the first row electrode driving section 16A applies the ground potential to the common electrodes $X_1$ to $X_n$, and the second row electrode driving section 16B applies a positive polarity base voltage Vp, which is higher than the ground potential, to the scanning electrodes $Y_1$ to $Y_n$, just like the case of the selective erase period Te of the subfield $SF_2$. The second row electrode driving section 16B sequentially applies the scanning pulse Ps, which is superimposed on the base voltage Vp, to the scanning electrodes $Y_1, \ldots, Y_n$. The column electrode driving section 15 applies each erase pulse group $De_1, \ldots, De_n$ having a positive voltage polarity, to the column electrodes $D_1, \ldots, D_m$, synchronizing with each scanning pulse Ps. By this, an erase discharge is selectively generated in the selected cells CL out of the discharge cells CL, . . . , CL in the emission enable state, and the selected cells CL are set to the non-emission state.

In the emission period (discharge sustaining period) $T_q$ (q is one of 3 to N) following each selective erase period Te, the ground potential is applied to the column electrodes $D_1$ to $D_m$. The first row electrode driving section 16A applies an even number of discharge pulses $P^+$ assigned to the subfield $SF_q$ between the scanning electrode $Y_j$ and the common electrode $X_j$ constituting each row electrode pair. For the discharge sustaining pulse $P^+$, two types of voltage pulses, that is a first discharge sustaining pulse of which cathode is the scanning electrode $Y_j$ and anode is the common electrode $X_j$, and a second discharge sustaining pulse of which anode is the scanning electrode $Y_j$ and cathode is the common electrode $X_j$, are generated. The first and second row electrode driving sections 16A and 16B alternately apply the first discharge sustaining pulse and the second discharge sustaining pulse between the scanning electrode $Y_j$ and the common electrode $X_j$ constituting each row electrode pair.

In the emission period Tp (p is one of 3 to N−1) of each of the subfields $SF_3$ to $SF_{N-1}$, the second row electrode driving section 16B decreases the applied voltage between the scanning electrode $Y_j$ and the common electrode $X_j$ constituting each row electrode pair in steps (stepwise) at the fall of the final applied pulse $P^+$ out of the discharge sustaining pulses $P^+$ applied in the emission period Tp, then decreases this applied voltage toward the setting voltage Vb having a polarity different from that of the maximum voltage of the final applied pulse $P^+$, and applies the charge adjustment pulse Pc to the scanning electrodes $Y_1$ to $Y_n$. The waveforms of the fall edge section of the final applied pulse $P^+$ and the charge adjustment pulse Pc are the same as the waveforms shown in FIG. 16A.

When the emission period $T_N$ of the final subfield $SF_N$ ends, the second row electrode driving section 16B applies the erase pulse Pe having a negative polarity minimum voltage to all the scanning electrodes $Y_1$ to $Y_n$ in the erase period Tb. As this erase pulse Pe is applied, an erase discharge is generated only in the discharge cells CL in the emission enable state. By this erase discharge, the discharge cells CL in the emission enable state transits to the non-emission state.

Figure 17:
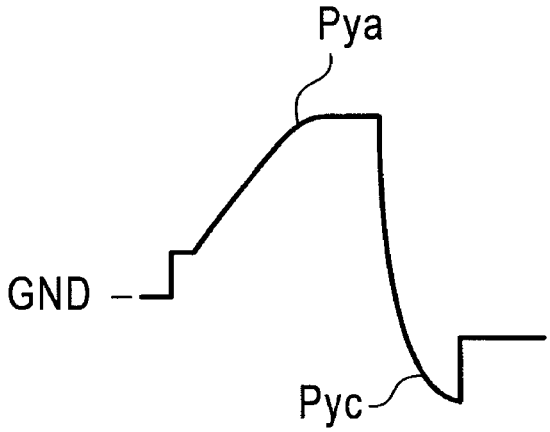
FIG. 17 is a diagram depicting an example of a reset pulse and a charge adjustment pulse.

As FIG. 14 shows, in the reset period Tr of the first subfield $SF_1$, the reset pulse Pya, which suddenly drops at the fall, is applied to the scanning electrodes $Y_1$ to $Y_n$, and after this reset pulse Pya, the charge adjustment pulse Pyc, of which inclination (time-based change rate of voltage) is roughly constant and which has a negative voltage polarity, is applied. Instead of the reset pulse Pya and charge adjustment pulse Pyc, the reset pulse Pya, which has an inclination that gradually changes at the fall and which is smoothly connected with the waveform of the charge adjustment pulse Pyc, may be applied, and then the charge adjustment pulse Pyc, having an inclination that gradually changes, may be applied, as shown in FIG. 17.

FIG. 15 is a diagram depicting an emission pattern of each discharge cell CL which can be implemented by the above mentioned driving sequence. In FIG. 15, the symbol "◎" indicates that the write discharge is generated in the selective write period Tw of the first subfield $SF_1$, and a sustaining discharge is generated in the emission period $T_1$ following the selective write period Tw, the symbol "●" indicates that an erase discharge is generated in the selective erase period Te of one of the subfields $SF_i$ (i is one of 2 to 14), and "○" indicates that a sustaining discharge is generated in the emission period Ti following the selective erase period Te without generating an erase discharge in the selective erase period Te of one of the subfields $SF_i$ (i is one of 2 to 14). The emission pattern in FIG. 15 forms the display brightness corresponding to the respective emission pattern, and the display brightness corresponds to each grayscale level. If the display brightness of the grayscale level g of the video signal is $L_1(g)$, then the display brightness $L_1(g)$ is given by the following expression.

$$L_1(g) = \sum_{i=1}^{N} B(g;\, i) x W(i) \qquad \text{[Expression 1]}$$

Here N is a total number of subfields $SF_1$ to $SF_N$, and is N=14 in the case of FIG. 15. B(g;i) is a value "1" if the discharge cell CL is set to the emission enable state in the i-th subfield $SF_i$ for a grayscale level g, and is a value "0" if the discharge cell CL is set to the non-emission state. W(i) is a weight of brightness assigned to the i-th subfield $SF_i$. For example, if the brightness weight is set as W(1)=1, W(2)=2, W(3)=6, W(4)=8, W(5)=10, W(6)=12, W(7)=16, W(8)=18, W(9)=22, W(10)=24, W(11)=28, W(12)=32, W(13)=36, and W(14)=40, then the display brightness $L_1(g)$ shown in FIG. 15 is implemented.

The above mentioned driving sequence can be applied to any of the first panel structure shown in FIG. 3 and FIG. 4, the second panel structure shown in FIG. 5 and FIG. 6, and the third panel structure shown in FIG. 7 and FIG. 8. As mentioned above, the second panel structure improves the discharge delay by the priming effect, so a wide margin of driving voltage can be secured. If both the second panel structure and the third panel structure are used, a further improvement of the discharge delay and a wider margin of the driving voltage can be implemented.

As mentioned above, according to the driving sequence of the first embodiment, a single or a plurality of discharge sustaining pulses $P^+$ are applied in each of the emission periods $T_1$ to $T_N$ of the subfields $SF_1$ to $SF_N$, and at the fall of the final applied pulse $P^+$ out of the discharge sustaining pulses $P^+$, the applied voltage between the scanning electrode $Y_j$ and the common electrode $X_j$ constituting each row electrode pair decreases in steps, as shown in FIG. 16A. The discharge generated at the fall of the final applied pulse $P^+$ (hereafter called "fall discharge") makes it difficult to control the wall charge distribution in the discharge cells CL, and causes a dispersion of discharge start voltage among the discharge cells CL, but the discharge intensity of the fall discharge can be weakened by decreasing the applied voltage in steps at the fall of the final applied pulse $P^+$. Therefore the dispersion of the wall charge distribution among the discharge cells CL can be suppressed, and wall charge distribution can be easily controlled.

In particular, when the second panel structure (FIG. 5 and FIG. 6) and the third panel structure (FIG. 7 or FIG. 8) are used, the discharge probability increases due to the priming effect, and the above mentioned fall discharge is easily generated. For the second and third panel structures as well, the dispersion of the wall charge distribution among the discharge cells CL can be suppressed, and wall charge distribution can be easily controlled by decreasing the applied voltage in steps (stepwise) at the fall of the final applied pulse $P^+$.

The voltage waveform shown in FIG. 16A has a voltage sustaining block where the applied voltage is sustained roughly at the intermediate voltage Vi for a predetermined time at the fall of the discharge sustaining pulse $P^+$, and this voltage sustaining block is created in only one step. If the third panel structure (FIG. 7 or FIG. 8) is used, or if magnesium oxide crystals of which secondary emission rate and initial electron emission rate are very high are used, the emission probability becomes very high, and in some cases the discharge intensity of the fall discharge by the final applied pulse $P^+$ may not be sufficiently suppressed by only one step of a voltage sustaining block. In such a case, control of the wall charge distribution in the discharge cells CL becomes difficult, and dispersion of discharge start voltage may be generated among the discharge cells CL. Therefore if a panel structure having a very high discharge probability is used, it is preferable to decrease the applied voltage in steps by creating two or more steps of voltage sustaining blocks at the fall of the final applied pulse $P^+$, so as to suppress the discharge intensity of the fall discharge generated by the final applied pulse $P^+$.

Figure 18A:
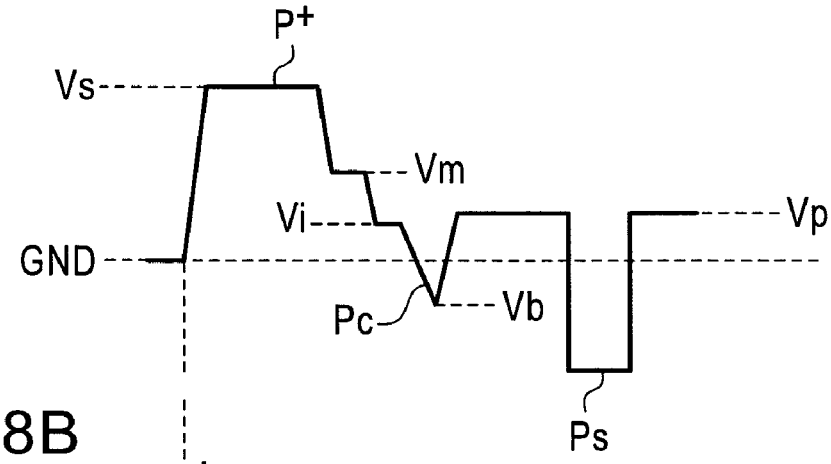
FIG. 18A is a flow chart depicting a waveform of a final applied pulse having two steps of voltage sustaining blocks and a waveform of a charge adjustment pulse which continues therefrom.
Figure 18B:
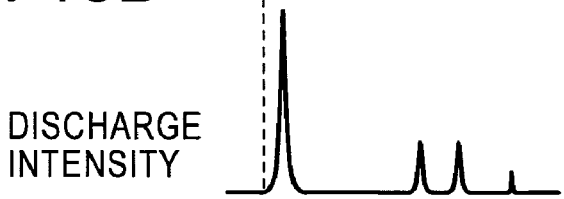
FIG. 18B is a graph depicting an intensity of a gas discharge generated in the discharge cell corresponding to the waveform of FIG. 18A.

FIG. 18A is a flow chart depicting the waveform of the final applied pulse $P^+$ having two steps of voltage sustaining blocks and the waveform of the charge adjustment pulse Pc which continues therefrom. FIG. 18B is a graph depicting the intensity of a gas discharge generated in the discharge cell CL, corresponding to the waveform of FIG. 18A. As FIG. 18A shows, at the fall of the final applied pulse $P^+$, the second row electrode driving section 16B maintains the applied voltage between the scanning electrode $Y_j$ and the common electrode $X_j$ constituting each row electrode pair at an intermediate voltage Vm, which is lower than the maximum voltage Vs of the final applied pulse $P^+$ and is higher than the ground potential, for a predetermined time. Then the second row electrode driving section 16B decreases this applied voltage toward an intermediate voltage Vi, which is lower than the above mentioned intermediate voltage Vm. After sustaining this applied voltage at the intermediate voltage Vi for a predetermined time, the second row electrode driving section 16B decreases this applied voltage toward a setting voltage Vb having polarity which is different from the voltage polarity of the intermediate voltage Vi. Here the second row electrode driving section 16B can sustain this applied voltage at a roughly constant intermediate voltage Vm or Vi by setting the potential of the scanning electrode $Y_j$ to high impedance (HiZ), that is to a floating potential, for a predetermined time.

Therefore the fall edge section of the final applied pulse $P^+$ shown in FIG. 18A has: a first block where the applied voltage changes from the maximum voltage Vs of the final applied pulse $P^+$ to the intermediate voltage Vm, a second block where this applied voltage is sustained at a roughly constant intermediate voltage Vm for a predetermined time (first voltage sustaining block), a third block where this applied voltage changes from the intermediate voltage Vm to the intermediate voltage Vi which is lower than the intermediate voltage Vm, a fourth block where this applied voltage is sustained at roughly a constant intermediate voltage Vi for a predetermined time (second voltage sustaining block), and a fifth block where this applied voltage changes from the intermediate voltage Vi to the setting voltage Vb.

As FIG. 18B shows, a weak discharge is generated in a period when the voltage value of the final applied pulse $P^+$ transits from the maximum voltage Vs to the intermediate voltage Vm, or immediately after this voltage value reaches the intermediate voltage Vm, and a weak discharge is also generated in a period when this voltage value transits from the intermediate voltage Vm to the intermediate voltage Vs, or immediately after this voltage value reaches the intermediate voltage Vs. Therefore compared with the fall discharge due to applying the final applied pulse $P^+$ shown in FIG. 16B, the discharge intensity of the fall discharge shown in FIG. 18B is low, and even if a panel structure of which discharge probability is very high is used, the dispersion of the wall charge distribution among the discharge cells CL can be suppressed. Also the discharge intensity of a discharge generated at the fall of the charge adjustment pulse Pc can be suppressed so that the discharge does not become too strong. Hence wall charge distribution can be easily controlled.

In order to weaken the intensity of the fall discharge, it is preferable to set the potential difference between the maximum voltage Vs and the intermediate voltage Vm (=Vs−Vm) is set to half of the potential difference of the maximum voltage Vs and the ground potential (=Vs−GND) or less.

As FIG. 16A shows, the voltage value of the charge adjustment pulse Pc is increased up to the base voltage Vp immediately after reaching the setting voltage Vb. However a discharge generated at the rise of this charge adjustment pulse Pc (hereafter called "rise discharge") makes control of wall charge distribution in the discharge cells CL difficult, which could cause a dispersion of discharge start voltage among discharge cells CL. In particular, if a panel structure of which discharge probability is very high is used, control of the wall charge distribution tends to be difficult. In such a case, it is preferable to use the charge adjustment pulse Pc shown in FIG. 19A, instead of the charge adjustment pulse Pc shown in FIG. 16A.

Figure 19A:
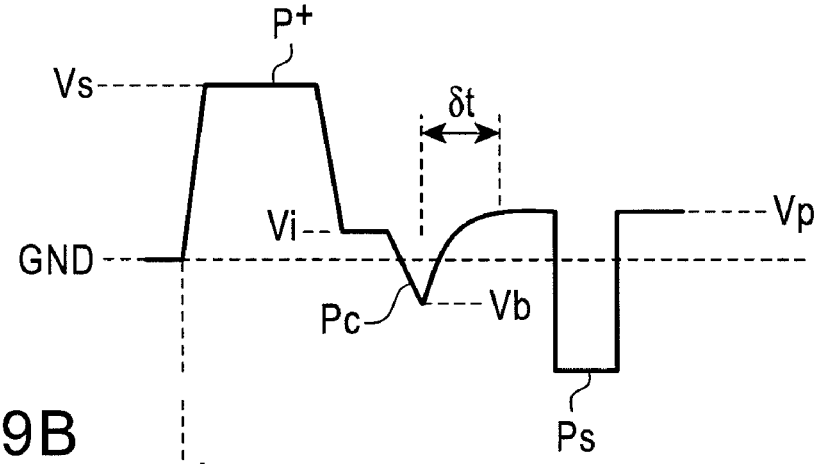
FIG. 19A is a flow chart depicting a waveform of a final applied pulse and a waveform of a charge adjustment pulse which continues therefrom.
Figure 19B:
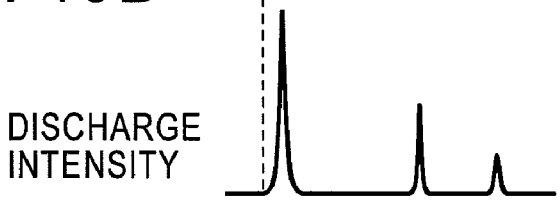
FIG. 19B is a graph depicting an intensity of a gas discharge generated in the discharge cell corresponding to the waveform of FIG. 19A.

The voltage waveform of the charge adjustment pulse Pc shown in FIG. 19A is acquired by gradually increasing the applied voltage between the scanning electrode $Y_j$ and the common electrode $X_j$ constituting each row electrode pair from the setting voltage Vb to the base voltage Vp, so that the charge adjustment pulse Pc rises gently. By this, the time required for the charge adjustment pulse Pc to reach from the setting voltage Vb to the base voltage Vp (=δt) increases, and the intensity of the rise discharge can be weakened enough to be ignored, as shown in FIG. 19B. For example, if the value of (Vp−Vb)/δt is 2 volts/μsec. or more, the intensity of the rise discharge can be weakened.

Figure 20A:
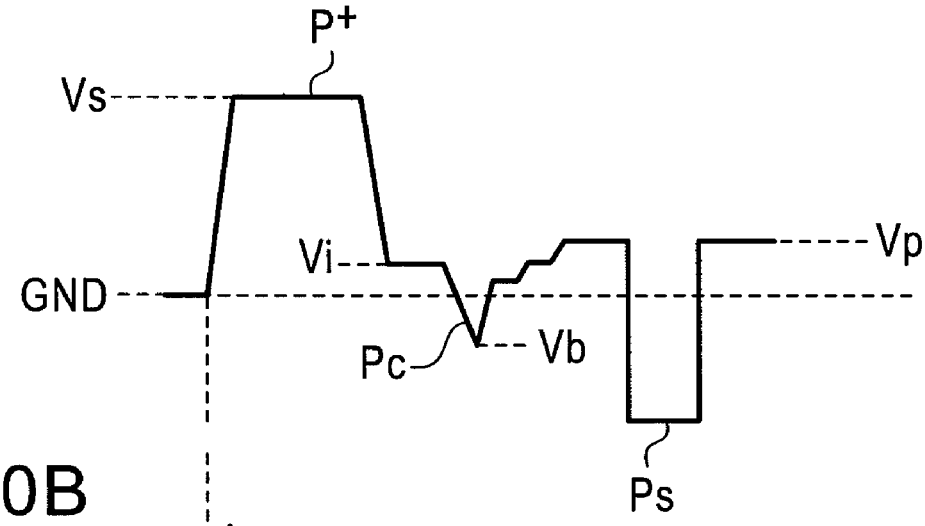
FIG. 20A is a flow chart depicting a waveform of a final applied pulse and a waveform of a charge adjustment pulse which continues therefrom.
Figure 20B:
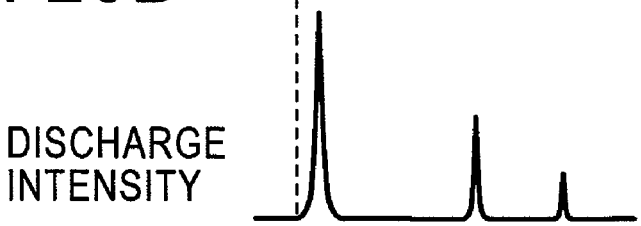
FIG. 20B is a graph depicting an intensity of a gas discharge generated in the discharge cell corresponding to the waveform of FIG. 20A.

Instead of the charge adjustment pulse Pc shown in FIG. 19A, the charge adjustment pulse Pc shown in FIG. 20A may be used. The voltage waveform of the charge adjustment pulse Pc shown in FIG. 20A can be acquired by increasing the applied voltage between the scanning electrode $Y_j$ and the common electrode $X_j$ constituting each row electrode pair from the setting voltage Vb to the base voltage Vp in steps (stepwise). By this, the time required for the voltage value of the charge adjustment pulse Pc to reach from the setting voltage Vb to the base voltage Vp increases, and the intensity of the rise discharge can be weakened enough to be ignored, as shown in FIG. 20B.

Second Embodiment

Figure 21:
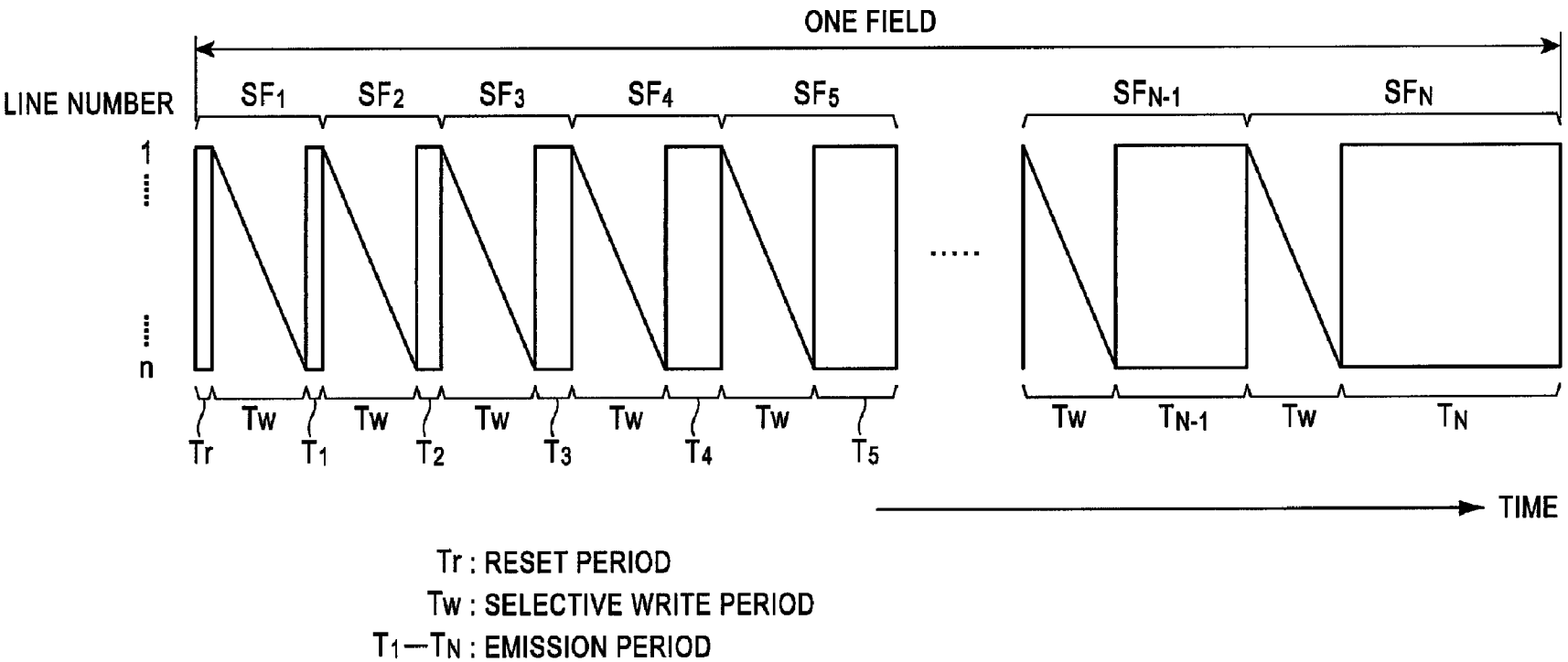
FIG. 21 is a diagram depicting a driving sequence according to the second embodiment of the present invention.
Figure 22:
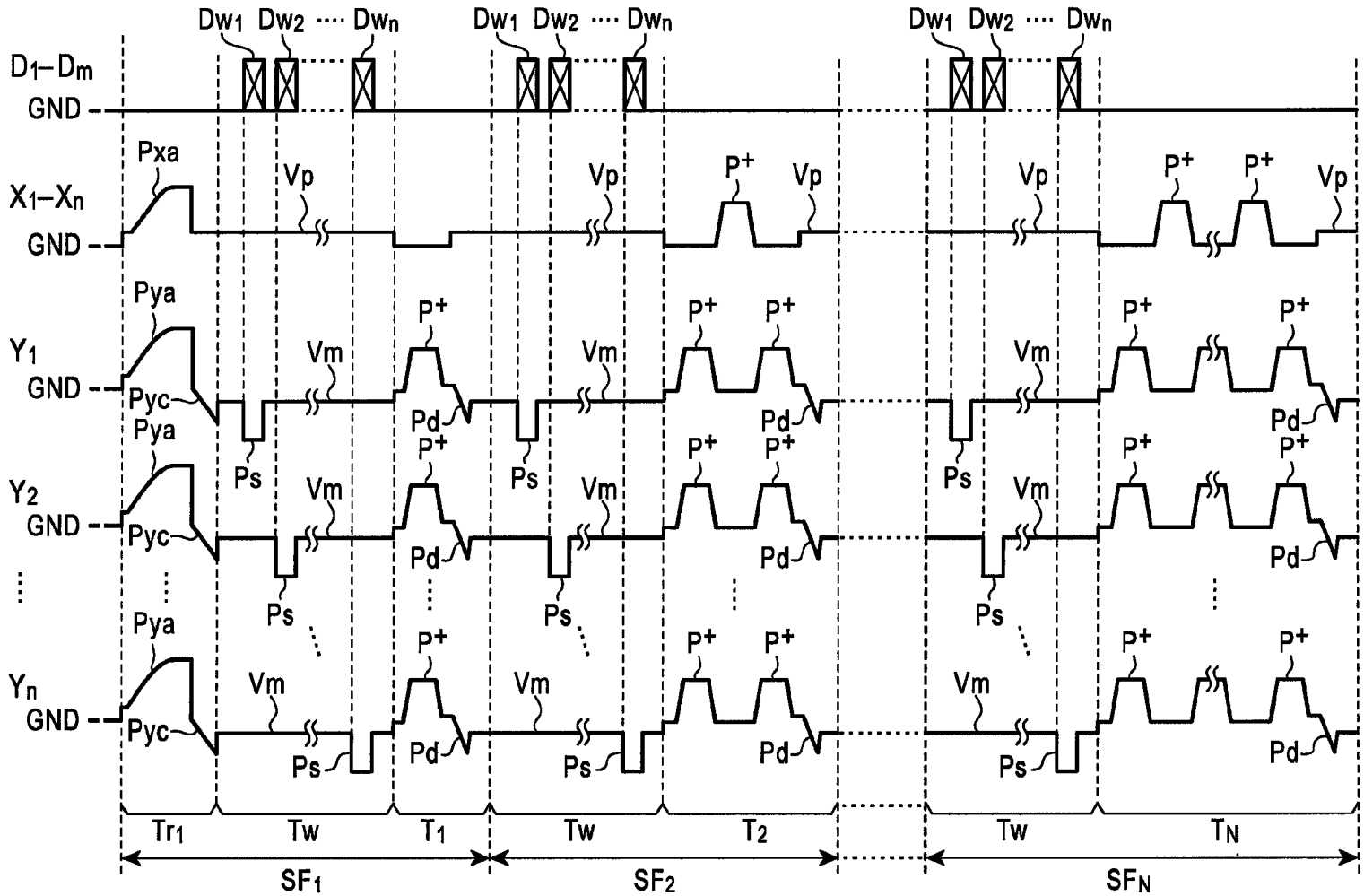
FIG. 22 is a timing chart depicting a waveform of a driving signal based on the driving sequence in FIG. 21.

Now a driving sequence according to a second embodiment of the present invention will be described. FIG. 21 is a diagram depicting the driving sequence according to the second embodiment. In this driving sequence, one field of a video signal is divided into N number (N is 2 or greater integer) of subfields $SF_1, \ldots, SF_N$, which are arrayed continuously in the display sequence. The plasma display device 1 displays these subfields $SF_1, \ldots, SF_N$ sequentially on the plasma display panel 2, whereby human eyes can recognize one multi-grayscale image. FIG. 22 is a timing chart depicting waveforms of driving signals according to the driving sequence in FIG. 21. FIG. 21 shows a signal waveform which is applied to the column electrodes $D_1$ to $D_n$, a signal waveform which is applied to the common electrodes $X_1$ to $X_n$, and a signal waveform which is applied to the scanning electrodes $Y_1, \ldots, Y_n$ respectively.

As FIG. 21 shows, in the display period of the first subfield $SF_1$, a reset period Tr, a selective write period (address period) Tw, and an emission period (discharge sustaining period) $T_1$ are set. In each display period of the second or later subfields $SF_2$ to $SF_N$, a selective write period (address period) Tw and emission period (discharge sustaining period) $T_q$ (q is an integer 2 to N) are set. The weight assignment section 10A in FIG. 1 assigns a respective weight of brightness to the subfields $SF_1$ to $SF_N$, and the lengths of the emission periods $T_1$ to $T_N$ of the subfields $SF_1$ to $SF_N$ are controlled to have a time length which is in proportion to the weight of brightness respectively.

As FIG. 22 shows, the signal waveforms in the reset period Tr and the selective write period Tw of the first subfield $SF_1$ are the same as the signal waveforms in the reset period Tr and the selective write period Tw of the first subfield $SF_1$ shown in FIG. 14, so a detailed description thereof is omitted here.

In the emission period (discharge sustaining period) $T_1$, following the selective write period Tw, the ground potential is applied to the column electrodes $D_1$ to $D_m$, and the ground potential is also applied to the common electrodes $X_1$ to $X_n$, as shown in FIG. 22. In this case, the first and second row electrode drive sections 16A and 16B apply a voltage pulse, of which anode is the scanning electrode $Y_j$ and cathode is the common electrode $X_j$, between the scanning electrode $Y_j$ and the common electrode $X_j$ constituting each row electrode pair as a discharge sustaining pulse $P^+$. By this, the surface discharge is generated between the scanning electrode $Y_j$ and the common electrode $X_j$, and a counter-discharge is generated between the scanning electrode $Y_j$ and the column electrode $D_k$. Ultraviolet generated by these gas discharges excites the excitons in the fluorescent layer 26, and allows visible light to be emitted. Out of the charged particles generated by these discharges, positive charge particles are attracted to the cathode $X_j$, and negative charge particles are attracted to the anode $Y_j$ and the column electrode $D_k$. As a result, the charge polarity of the wall face close to the common electrode $X_j$ and the charge polarity of the wall face close to the scanning electrode $Y_j$ are reversed.

In the emission period $T_1$, the second row electrode driving section 16B decreases the applied voltage between the scanning electrode $Y_j$ and the common electrode $X_j$ in steps (stepwise) when the discharge sustaining pulse $P^+$ falls, then decreases this applied voltage toward a predetermined setting voltage Vb having a polarity different from that of the maximum voltage of the discharge sustaining pulse $P^+$. After allowing this applied voltage to transit to the setting voltage Vb, the second row electrode driving section 16B increases this applied voltage to a negative polarity base voltage Vm, which is higher then the setting voltage Vb and which is lower than the ground potential, whereby an erase pulse Pd having a wedge type waveform is applied. While this erase pulse Pd is being applied, the first row electrode driving section 16A applies a positive polarity base voltage Vp, which is higher than the ground potential, to the common electrodes $X_1$ to $X_n$. As the erase pulse Pd is applied, a weak discharge is generated between the common electrode $X_j$ and scanning electrode $Y_j$ and between the scanning electrode $Y_j$ and column electrode $D_k$ in the discharge cells CL in the emission enable state respectively, and the discharge cells CL in the emission enable state are set to the non-emission state. The wall charge distribution in the discharge cells CL is adjusted to a distribution whereby a selective write discharge can be generated without error in the next selective write period Tw.

Here, just like the fall edge section (rear edge section) of the discharge sustaining pulse $P^+$ shown in FIG. 16A, the fall edge section of the discharge sustaining pulse $P^+$ has a first block where the applied voltage between the common electrode $X_j$ and the scanning electrode $Y_j$ changes from the maximum voltage Vs of the discharge sustaining pulse $P^+$ to the intermediate voltage Vi, a second block where this applied voltage is sustained at a roughly constant intermediate voltage Vi for a predetermined time (voltage sustaining block), and a third block where this applied voltage changes from the intermediate voltage Vi to the setting voltage Vb. The value of the intermediate voltage Vi in the second embodiment, however, need not be the same as the value of the intermediate voltage Vi shown in FIG. 16A. In this way, the intensity of the discharge generated due to the fall edge section can be suppressed by decreasing the fall edge section in steps. Therefore the dispersion of the wall charge distribution among the discharge cells CL can be suppressed.

In order to further suppress the dispersion of the wall charge distribution, the fall edge section of the discharge sustaining pulse $P^+$ may be two or more steps of voltage sustaining blocks. Specifically, just like the fall edge section of the discharge sustaining pulse $P^+$ shown in FIG. 18A, the fall edge section of the discharge sustaining pulse $P^+$ may have a first block where the applied voltage changes from the maximum voltage Vs of the final applied pulse $P^+$ to the intermediate voltage Vm, a second block where this applied voltage is sustained at a roughly constant intermediate voltage Vm for a predetermined time (first voltage sustaining block), a third block where this applied voltage changes from the intermediate voltage Vm to the intermediate voltage Vi, which is lower than the intermediate voltage Vm, a fourth block where this applied voltage is sustained at a roughly constant intermediate voltage Vi for a predetermined time (second voltage sustaining block), and a fifth block where this applied voltage changes from the intermediate voltage Vi to the setting voltage Vb. The values of the intermediate voltages Vi and Vm in the second embodiment need not be the same as the values of the intermediate voltages Vi and Vm shown in FIG. 18A. By creating a multi-step voltage sustaining block in the fall edge section, the dispersion of the wall charge distribution among the discharge cells CL can be suppressed, even if a panel structure having very high discharge probability is used.

Just like the rise edge section of the change adjustment pulse Pc shown in FIG. 19A or FIG. 20A, the rise edge section of the erase pulse Pd shown in FIG. 22 may be acquired by increasing the applied voltage between the scanning electrode $Y_j$ and the common electrode $X_j$ constituting each row electrode pair from the setting voltage Vb to the base voltage Vm gradually or in steps (stepwise). By this, the time required for the voltage value of the erase pulse Pd to reach from the setting voltage Vb to the base voltage Vm increases, and the intensity of the discharge which is generated at the rise of the erase pulse Pd can be weakened enough to be ignored. Hence the dispersion of wall charge distribution due to the rise edge section of the erase pulse Pd can be suppressed considerably.

In the emission period $T_1$, the number of discharge sustaining pulses $P^+$ is one, in order to improve the grayscale representation capability for low brightness images, but it is not limited to one. Just like the cases of other later mentioned emission periods, the discharge sustaining pulse $P^+$ may be applied repeatedly between the scanning electrodes $Y_j$ and the common electrode $X_j$ constituting each row electrode pair.

Then in each selective write period Tw of each display period of the subfields $SF_2$ to $SF_N$, a write discharge is selectively generated in the discharge cells CL, . . . , CL of the plasma display panel 2, and only the selected cells CL out of the discharge cells CL are set to the emission enable state (light ON mode), just like the case of the selective write period Tw of the first subfield $SF_1$. In the emission period $T_q$ (q is one of 2 to N) following the selective write period Tw, the ground potential is applied to the column electrodes $D_1$ to $D_m$. The first row electrode driving selection 16A applies a plurality of discharge sustaining pulses $P^+$ assigned to the subfield $SF_q$ between the scanning electrode $Y_j$ and the common electrode $X_j$ constituting each row electrode pair. For the discharge sustaining pulse $P^+$, two types of voltage pulses, that is a first discharge sustaining pulse of which cathode is the scanning electrode $Y_j$ and anode is the common electrode $X_j$, and a second discharge sustaining pulse of which anode is the scanning electrode $Y_j$ and cathode is the common electrode $X_j$ are generated. The first and second row electrode drive sections 16A and 16B alternately apply the first discharge sustaining pulse and the second discharge sustaining pulse between the scanning electrode $Y_j$ and the common electrode $X_j$ constituting each row electrode pair.

In the emission period $T_p$ (p is one of 3 to N−1) at the fall of the final applied pulse $P^+$ out of the charge sustaining pulses $P^+$ which are applied in the emission period $T_p$, the second row electrode driving section 16B decreases the applied voltage between the scanning electrode $Y_j$ and common electrode $X_j$ constituting each row electrode pair in steps (stepwise), then decreases this applied voltage toward the setting voltage Vb having a polarity different from that of the maximum voltage of the final applied pulse $P^+$, and applies the erase pulse Pd to the scanning electrodes $Y_1$ to $Y_n$. While this final applied pulse $P^+$ is being supplied, the positive polarity base voltage Vp is applied to the common electrodes $X_1$ to $X_n$. The waveforms of the fall edge section of the final applied pulse $P^+$ and erase pulse Pd are the same as each waveform of the discharge sustaining pulse $P^+$ and erase pulse Pd applied during the emission period $T_1$ of the first subfield $SF_1$.

In the reset period Tr of the first subfield $SF_1$, the reset pulse Pya, which suddenly drops at the fall, is applied to the scanning electrodes $Y_1$ to $Y_n$. After this reset pulse Pya, the charge adjustment pulse Pyc, of which inclination (time-based change rate of voltage) is roughly constant and which has negative voltage polarity, is applied. Instead of the reset pulse Pya and charge adjustment pulse Pyc, the reset pulse Pya, which has an inclination that gradually changes at the fall and which is smoothly connected with the waveform of the charge adjustment pulse Pyc, may be applied, and then the charge adjustment pulse Pyc, having an inclination that gradually changes, may be applied, as shown in FIG. 17.

According to the driving sequence of the second embodiment, a single or a plurality of discharge sustaining pulses $P^+$ are applied in each of the emission periods $T_1$ to $T_N$ of the subfields $SF_1$ to $SF_N$, and at the fall of the final applied pulse $P^+$ out of the discharge sustaining pulses $P^+$, the applied voltage between the scanning electrode $Y_j$ and common electrode $X_j$ constituting each row electrode pair decreases in steps. Hence just like the driving sequence according to the first embodiment, the intensity of the discharge, which is generated at the fall of the final applied pulse $P^+$, can be weakened. Therefore the dispersion of the wall charge distribution among the discharge cells CL can be suppressed, and wall charge distribution can be easily controlled.

Third Embodiment

Figure 23:
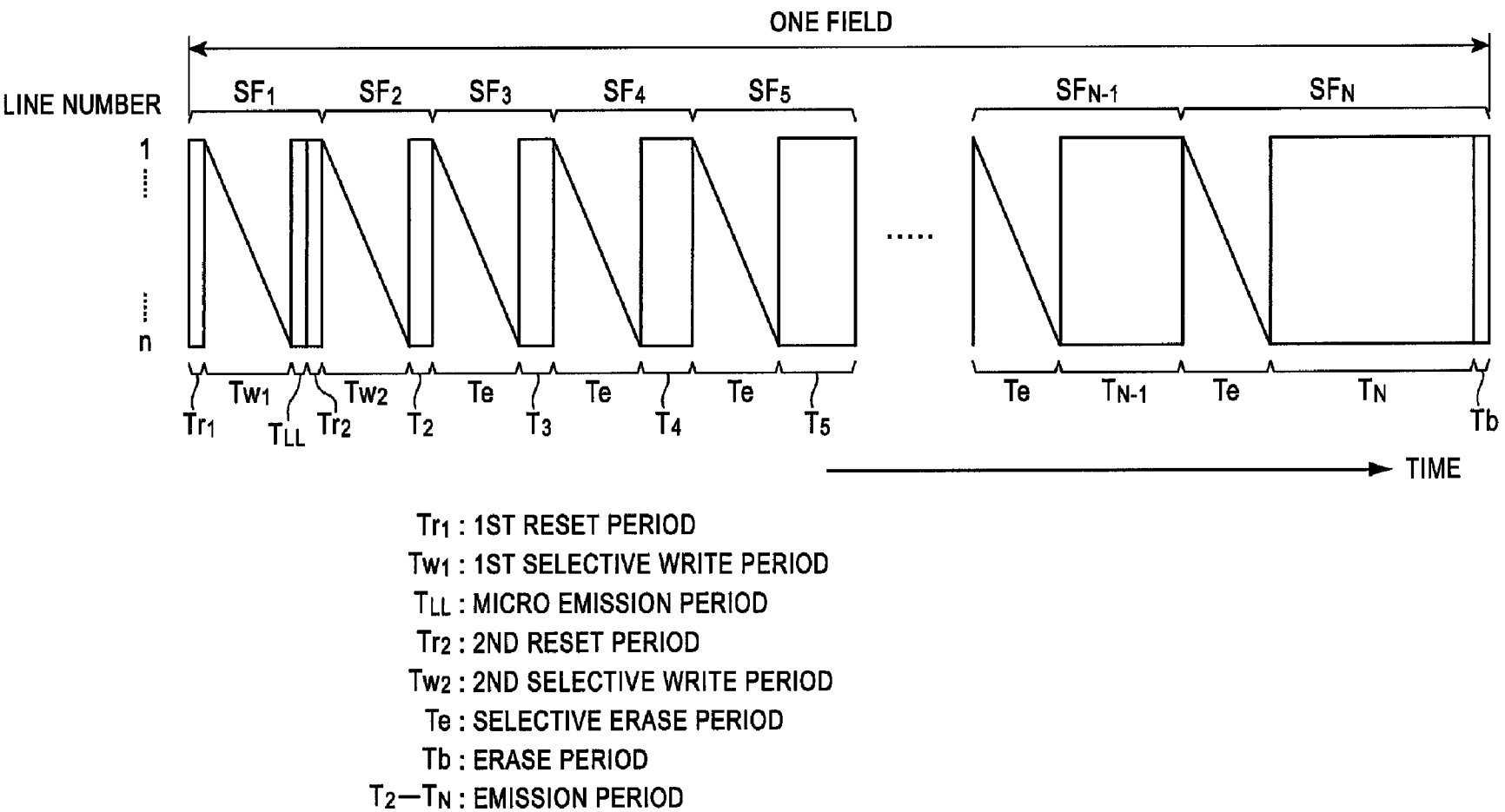
FIG. 23 is a diagram depicting a driving sequence according to the third embodiment of the present invention.
Figure 24:
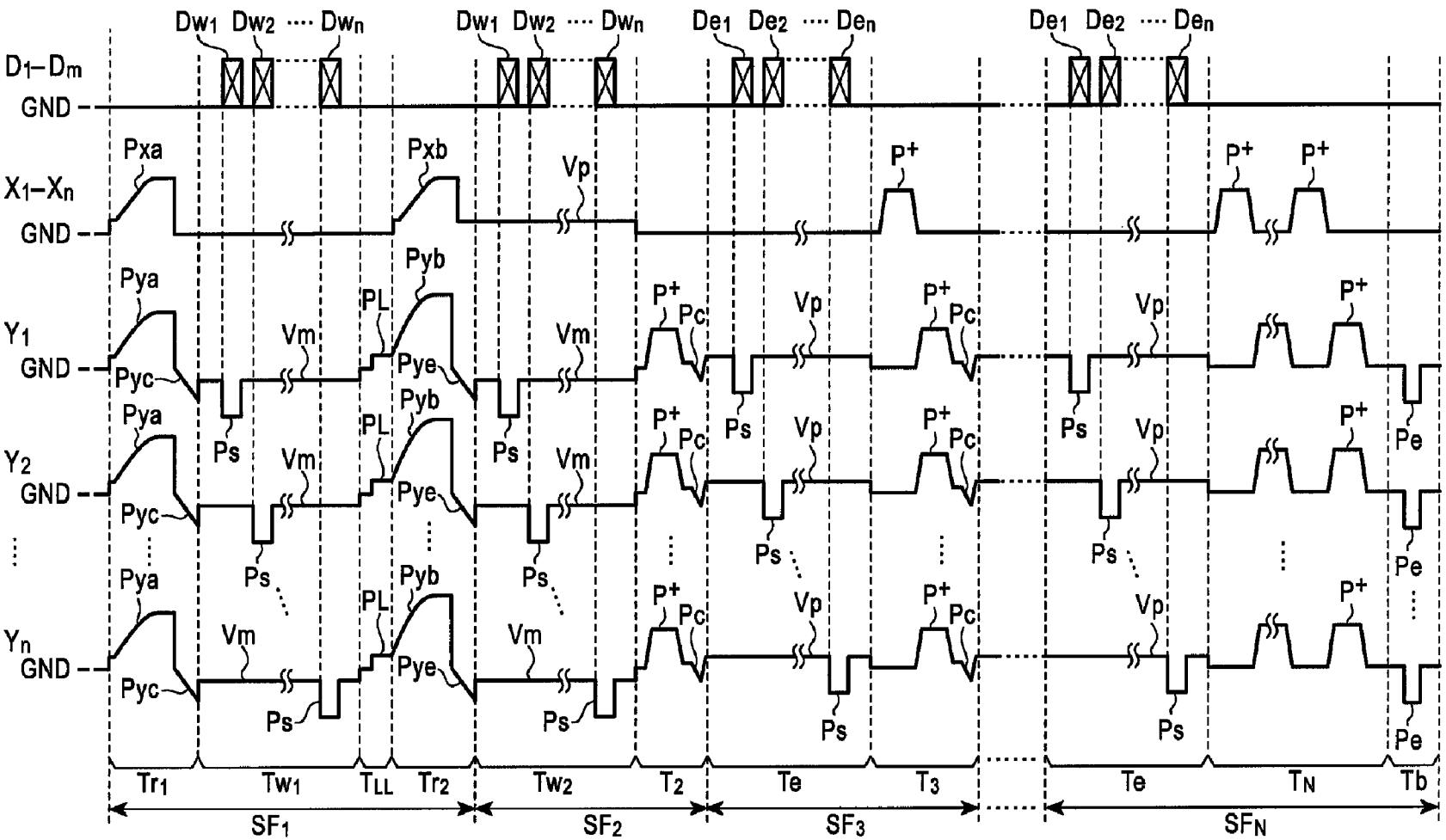
FIG. 24 is a timing chart depicting a waveform of a driving signal based on the driving sequence in FIG. 23.

Now a driving sequence according to a third embodiment of the present invention will be described. FIG. 23 is a diagram depicting the driving sequence according to the third embodiment. In this driving sequence, one field of a video signal is divided into N number (N is 2 or greater integer) of subfields $SF_1, \ldots, SF_N$, which are arrayed continuously in the display sequence. The plasma display device 1 displays these subfields $SF_1, \ldots, SF_N$ sequentially on the plasma display panel 2, whereby human eyes can recognize one multi-grayscale image. FIG. 24 is a timing chart depicting waveforms of driving signals according to the driving sequence in FIG. 23. FIG. 24 shows a signal waveform which is applied to the column electrodes $D_1$ to $D_n$, a signal waveform which is applied to the common electrodes $X_1$ to $X_n$, and a signal waveform which is applied to the scanning electrodes $Y_1, \ldots, Y_n$ respectively.

FIG. 25 is a diagram depicting an emission pattern of each discharge cell CL which can be implemented by the driving sequence in FIG. 23, and the conversion table. FIG. 25 shows the relationship between the grayscale level of the video signal and the corresponding emission pattern when each field of the video signal is divided into 14 subfields $SF_1$ to $SF_{14}$. The conversion table shows the 4-bit value of the grayscale adjustment signal VSb and 14-bit value of the driving data signal DD. The driving data generation section 13 converts the grayscale adjustment signal VSb into the driving data signal DD according to this conversion table.

As FIG. 23 shows, the display period of the first subfield $SF_1$ is divided into a first reset period $Tr_1$, a first selective write period (address period) $Tw_1$, micro-emission period $T_{LL}$, and second reset period $Tr_2$. The display period of the second subfield $SF_2$ is divided into a second selective write period (address period) $Tw_2$ and emission period (discharge sustaining period) $T_2$. The display period of each subsequent subfield $SF_q$ (q is an integer in the 3 to N−1 range) following the second subfield $SF_2$ is divided into a selective erase period Te and an emission period (discharge sustaining period) $T_q$. The display period of the final subfield $SF_N$ is divided into a selective erase period Te, emission period (discharge sustaining period) $T_N$ and erase period Tb. The weight assignment section 10A in FIG. 1 assigns a respective weight of brightness to the subsequent subfields $SF_2$ to $SF_N$ respectively, not the first subfield $SF_1$. The lengths of emission periods $T_2, \ldots, T_N$ of the subsequent subfields $SF_2, \ldots, SF_N$ are controlled to have a time length which is in proportion to the weight of brightness respectively.

As FIG. 24 shows, in the first reset period $Tr_1$ of the display period of the first subfield $SF_1$, the column electrode driving section 15 in FIG. 1 clamps the potentials of the column electrodes $D_1$ to $D_m$ to the ground potential (GND). In this case, the first row electrode driving section 16A gradually and gently increases the applied voltage to the common electrodes $X_1$ to $X_n$ from a predetermined level as time elapses, so that a reset pulse Pxa having positive voltage polarity is applied to the common electrodes $X_1$ to $X_n$. The second row electrode driving section 16B gradually and gently increases the applied voltage to the scanning electrodes $Y_1$ to $Y_n$ from a predetermined level as time elapses, so that a reset pulse Pya having positive voltage polarity is applied to the scanning electrodes $Y_1$ to $Y_n$. By this, a voltage of which anode is the scanning electrode $Y_j$ and cathode is the column electrode $D_k$ is applied between the scanning electrode $Y_j$ and column electrode $D_k$ in each discharge cell CL, and a reset discharge is generated in the discharge space DS of the discharge cell CL, thereby such charged particles as ions and electrons are generated. Out of the generated charged particles, positive charge particles are attracted to a wall face close to the cathode $D_k$, and negative charge particles are attracted to a wall face close to the anode $Y_j$, so current flows from the anode $Y_j$ to the cathode $D_k$, and the reset discharge stops. As a result, negative charge particles are stored on the wall face of the dielectric layer 23 close to the scanning electrodes $Y_1$ to $Y_n$, and positive charge particles are stored on the wall face of the fluorescent layer 26 (FIG. 3 or FIG. 5) close to the column electrodes $D_1$ to $D_m$.

The time-based change rates of the voltage level of the reset pulses Pxa and Pya at a rise are lower and gentler than the later mentioned time-based change rate of the voltage level of the discharge sustaining pulse $P^+$ at a rise. Therefore the reset discharge is weaker than the sustaining discharge, and the influence of the light generated by a reset discharge on background emission brightness is small enough to be ignored. The maximum voltages of these reset pulses Pxa and Pya are lower than the maximum voltage of the discharge sustaining pulse $P^+$, but may be the same or higher than the maximum voltage of the discharge sustaining pulse $P^+$.

When a surface discharge is not generated between the common electrode $X_j$ and scanning electrode $Y_j$ even if the reset pulse Pxa is not applied, the first row electrode driving section 16A may apply a predetermined voltage, such as the ground potential (GND), to the common electrodes $X_1$ to $X_n$ without applying the reset pulse Pxa.

In the remaining time of the reset period $Tr_1$, ground potential is applied to the common electrodes $X_1$ to $X_n$ and column electrodes $D_1$ to $D_m$. In this state, the second row electrode driving section 16B applies a negative voltage polarity charge adjustment pulse Pyc having a waveform, of which voltage level gradually decreases as time elapses, to the scanning electrodes $Y_1, \ldots, Y_n$. The minimum voltage of the charge adjustment pulse Pyc is adjusted so as to be higher than the later mentioned minimum voltage of the scanning pulse Ps, and have a level close to the ground potential, and the voltage amplitude of the charge adjustment pulse Pyc is smaller than the voltage amplitude of the scanning pulse Ps. By applying the charge adjustment pulse Pyc, migration of charged particles or a weak discharge between the scanning electrode $Y_j$ and column electrode $D_k$ is generated in the discharge cell CL, and wall charge distribution is adjusted. As a result, all the discharge cells CL are set to the non-emission state (light OFF mode), and have wall charge distribution which can cause an address discharge with certainty in the later mentioned first selective write period $Tw_1$.

In the first selective write period $Tw_1$ following the first reset period Tr, the first row electrode driving section 16A clamps the potential of the common electrodes $X_1$ to $X_n$ to the ground potential, and the second row electrode driving section 16B applies a negative polarity base voltage Vm, which is lower than the ground potential, to the scanning electrodes $Y_1$ to $Y_n$. In this state, the second row electrode driving section 16B sequentially applies a scanning pulse Ps, which is superimposed on the base voltage Vm, to the scanning electrodes $Y_1, \ldots, Y_n$. The column electrode driving section 15 applies write pulse group $Dw_1, \ldots, Dw_n$ having a positive voltage polarity to the column electrodes $D_1, \ldots, D_m$, synchronizing with each scanning pulse Ps respectively. By applying the write pulse group $Dw_1, \ldots, Dw_n$, a write discharge is selectively generated in the discharge cells CL, . . . , CL of the plasma display panel 2, and only selected cells CL, out of the discharge cells CL, are set to the emission enable state (light ON mode).

Specifically, when the write pulse synchronizing with the scanning pulse Ps applied to the scanning electrode $Y_j$ is applied to the column electrode $D_k$, voltage, of which cathode is the scanning electrode $Y_j$ and anode is the column electrode $D_k$, is applied between the scanning electrode $Y_j$ and the column electrode $D_k$, thereby a write discharge is generated in the discharge space DS, and such charged particles as ions and electrons are generated. Out of the generated charged particles, positive charge particles are attracted to a wall face close to the cathode $Y_j$, and negative charge particles are attracted to a wall face close to the anode $D_k$, and the write charge stops. As a result, charged particles, that is wall charges having a different charged polarity from each other, are stored on the wall face close to the common electrode $X_j$ and the wall face close to the scanning electrode $Y_j$. The discharge cells CL having such a wall charge distribution are set to the emission enable state (light ON mode). In the discharge cells CL where the write pulse synchronizing with the scanning pulse Ps is not applied to the column electrode $D_k$, a write discharge is not generated. Such a discharge cell CL is in the non-emission state.

In the micro-emission period $T_{LL}$ following the first selective write period $Tw_1$, the ground potential is applied to the column electrodes $D_1$ to $D_m$ and common electrodes $X_1$ to $X_n$. In this state, the second row electrode driving section 16B applies a voltage pulse PL which rises sharply, as shown in FIG. 24, to the scanning electrodes $Y_1, \ldots, Y_n$. In other words, in each discharge cell CL, the voltage pulse PL, of which cathode is the column electrode $D_k$ and anode is the scanning electrode $Y_j$, is applied between the column electrode $D_k$ and the scanning electrode $Y_j$. By applying this voltage pulse PL, a micro-discharge is generated between the column electrode $D_k$ and scanning electrode $Y_j$ in the discharge cells CL in the emission enable state, and ultraviolet generated by this micro-discharge excites the excitons in the fluorescent layer 26, and allows visible light to be emitted.

As FIG. 24 shows, the maximum voltage of the voltage pulse PL is lower than the later mentioned maximum voltage of the discharge sustaining pulse $P^+$, which is applied in the display period of the subfields $SF_2$ to $SF_N$. The maximum voltage of the voltage pulse PL can be set to roughly the same level as the later mentioned base voltage Vp, which is applied in the selective erase period Te. By applying this voltage pulse PL, a micro-discharge, of which intensity is lower than the intensity of the sustaining discharge generated by the discharge sustaining pulse $P^+$, can be generated. While the sustaining discharge generated by the discharge sustaining pulse $P^+$ is a surface discharge between the common electrode $X_j$ and scanning electrode $Y_j$, the micro-discharge generated by the voltage pulse PL is discharged between the column electrode $D_k$ and scanning electrode $Y_j$. Therefore the emission brightness, due to this micro-discharge, is lower than the emission brightness due to the sustaining discharge.

Compared with a waveform of the reset pulse Pya applied in the first reset period $Tr_1$, of which voltage level rises gently, the voltage pulse PL rises sharply. In other words, the time-based change rate of the voltage level of the voltage pulse PL in the rise block is greater than the time-based change rate of the voltage level of the reset pulse Pya in the rise block, where the voltage level rises gently. By this, a micro-discharge having an intensity that is greater than the intensity of the reset discharge generated in the first reset period $Tr_1$ is generated.

In the above mentioned selective write period $Tw_1$ and the first reset period $Tr_1$, the address discharge and micro-discharge are generated in the discharge cells CL in the emission enable state, and no gas discharge is generated in the discharge cells CL in the non-emission state. Ultraviolet generated by this address discharge excites the fluorescent layer 26, and allows visible light to be emitted. In such a case, the light emitted by the address discharge also contributes to the display brightness.

In the second reset period $Tr_2$ following the micro-emission period $T_{LL}$, a GND voltage is applied to the column electrodes $D_1$ to $D_m$. In this state, the first row electrode driving section 16A applies the reset pulse Pxa having a waveform, of which voltage level gradually and gently rises from a predetermined level, to the common electrodes $X_1$ to $X_n$. At the same time, the second row electrode driving section 16B applies the reset pulse Pyb having a waveform, of which voltage level gradually and gently rises from a predetermined level (maximum voltage of the pulse PL, in the case of this embodiment), to the scanning electrodes $Y_1, \ldots, Y_n$. The maximum voltage of the reset pulse Pyb is higher than the maximum voltage of the reset pulse Pya in the first reset period $Tr_1$. Therefore the reset pulse Pya, of which cathode is the column electrode $D_k$ and anode is the scanning electrode $Y_j$, is applied between the column electrode $D_k$ and the scanning electrode $Y_j$, and a reset discharge is generated in the discharge cells CL.

Compared with the waveform of the voltage pulse PL, of which voltage level sharply rises at rise time, the reset pulse Pyb which is applied in the second reset period $Tr_2$ has a waveform, of which voltage level rises gently. In other words, the time-based change rate in the voltage level rise block of the reset pulse Pyb is smaller than the time-based change rate of the pulse PL in the voltage level rise block. Therefore the intensity of the reset discharge generated in the second reset period $Tr_2$ is smaller than the intensity of the micro-discharge generated by the pulse PL. While the micro-discharge is generated in the micro-emission period $T_{LL}$ in the discharge cells CL in the emission enable state, a discharge is not generated in the micro-emission period $T_{LL}$ in the discharge cells CL in the non-emission state, but a discharge is generated in the second reset period $Tr_2$ immediately after this. In other words, a discharge is generated between the column electrode $D_k$ and scanning electrode $Y_j$ in all the discharge cells CL throughout the micro-emission period $T_{LL}$ and the second reset period $Tr_2$.

If a surface discharge is not generated between the common electrode $X_j$ and the scanning electrode $Y_j$ even if the reset pulse Pxa is not applied, a predetermined voltage, such as ground potential, may be applied to the common electrodes $X_1$ to $X_n$ without applying the reset pulse Pxa.

In the remaining time of the second reset period $Tr_2$, the first row electrode driving section 16A applies a positive polarity base voltage Vp, which is higher than the ground potential, to the common electrodes $X_1$ to $X_n$, and the column electrode driving section 15 clamps the potential of the column electrodes $D_1$ to $D_m$ to the ground potential. In this state, the second row electrode driving section 16B applies a negative polarity adjustment pulse Pye having a waveform, of which voltage level gradually decreases as time elapses, to the scanning electrodes $Y_1, \ldots, Y_n$. The minimum peak voltage of the adjustment pulse Pye is adjusted so as to be higher than the later mentioned minimum peak voltage of the scanning pulse Ps, and the voltage amplitude of the adjustment pulse Pyd is adjusted so as to be smaller than the voltage amplitude of the scanning pulse Ps. By applying the adjustment pulse Pye, a weak discharge is generated between the scanning electrode $Y_j$ and the column electrode $D_k$, and wall charge distribution is adjusted. As a result, all the discharge cells CL are set to the non-emission state (light OFF mode), and have wall charge distribution, which can cause a selective write discharge (address discharge) with certainty in the later mentioned second selective write period $Tw_2$.

Then in the second selective write period $Tw_2$ of the subfield $SF_2$, the first row electrode driving section 16A applies a positive polarity base voltage Vp, which is higher than the ground potential to the common electrodes $X_1$ to $X_n$, and the second row electrode driving section 16B applies a negative polarity base voltage Vm, which is lower than the ground potential, to the scanning electrodes $Y_1$ to $Y_n$. In this state, the second row electrode driving section 16B sequentially applies a scanning pulse Ps, which is superimposed on the base voltage Vm, to the scanning electrodes $Y_1, \ldots, Y_n$. The column electrode driving section 15 applies the write pulse group $Dw_1, \ldots, Dw_n$ having a positive voltage polarity, to the column electrodes $D_1, \ldots, D_m$, synchronizing with each scanning pulse Ps respectively. By this, the write discharge is selectively generated in the discharge cells CL, . . . , CL of the plasma display panel 2, and only the selected cells CL out of the discharge cells CL are set to the emission enable state (light ON mode). In the second selective write period $Tw_2$, the negative polarity base voltage Vm is applied to the scanning electrodes $Y_1$ to $Y_n$, and a positive polarity base voltage Vp is applied to the common electrodes $X_1$ to $X_n$, so a surface discharge is generated between the common electrode $X_j$ and the scanning electrode $Y_j$ in the discharge space DS only in the selected cells CL, induced by the write discharge which is generated when the scanning pulse Ps is applied. Such a surface discharge is not generated in the first selective write period $Tw_1$, where the negative polarity base voltage Vm is not applied to the scanning electrodes $Y_1$ to $Y_n$. After the second selective write period $Tw_2$ ends, charged particles (wall charges), of which charge polarities are different from each other, are stored in the wall face close to the common electrode $X_j$ and the wall face close to the scanning electrode $Y_j$ in the selected cells CL.

In the emission period $T_2$ following the second selective write period $Tw_2$, the ground potential is applied to the column electrodes $D_1$ to $D_m$, and the ground potential is also applied to the common electrodes $X_1$ to $X_n$, as shown in FIG. 24. In this state, the first and second row electrode drive sections 16A and 16B apply a voltage pulse, of which anode is the scanning electrode $Y_j$ and cathode is the common electrode $X_j$, between the scanning electrode $Y_j$ and the common electrode $X_j$ constituting each row electrode pair, as a discharge sustaining pulse $P^+$. By this, the surface discharge is generated between the scanning electrode $Y_j$ and the common electrode $X_j$, and a counter-discharge is generated between the scanning electrode $Y_j$ and the column electrode $D_k$. Ultraviolet generated by these gas discharges excites the excitons in the fluorescent layer 26, and allow visible light to be emitted. Out of the charged particles generated by these discharges, positive charge particles are attracted to the cathode $X_j$, and negative charge particles are attracted to the anode $Y_j$ and the column electrode $D_k$. As a result, the charge polarity of the wall face close to the common electrode $X_j$ and the charge polarity of the wall face close to the scanning electrode $Y_j$ are reversed.

In the emission period $T_2$, the second row electrode driving section 16B decreases the applied voltage between the scanning electrode $Y_j$ and the common electrode $X_j$ constituting each row electrode pair in steps (stepwise) when the discharge sustaining pulse $P^+$ falls, then decreases this applied voltage toward a predetermined setting voltage Vb having a polarity different from that of the maximum voltage of the discharge sustaining pulse $P^+$. After allowing this applied voltage to transit to the setting voltage Vb, the second row electrode driving section 16B increases this applied voltage to a positive polarity base voltage Vp, which is higher than the ground potential, whereby a charge adjustment pulse Pc having a wedge type waveform is applied. While this charge adjustment pulse Pc is being applied, the first row electrode driving section 16A clamps the potentials of the common electrodes $X_1$ to $X_n$ to the ground potential. As the charge adjustment pulse Pc is applied, a weak discharge is generated between the common electrode $X_j$ and the scanning electrode $Y_j$, and between the scanning electrode $Y_j$ and the common electrode $D_k$ respectively in the discharge cells CL in the emission enable state. Therefore the wall charge distribution in the discharge cells CL is adjusted to a distribution whereby an erase discharge can be generated without error in the next selective erase period Te.

Here, just like the fall edge section (rear edge section) of the discharge sustaining pulse $P^+$ shown in FIG. 16A, the fall edge section of the discharge sustaining pulse $P^+$ has a first block where the applied voltage between the common electrode $X_j$ and the scanning electrode $Y_j$ changes from the maximum voltage Vs of the discharge sustaining pulse $P^+$ to the intermediate voltage Vi, a second block where this applied voltage is sustained at a roughly constant intermediate voltage Vi for a predetermined time (voltage sustaining block), and a third block where this applied voltage changes from the intermediate voltage Vi to the setting voltage Vb. The value of the intermediate voltage Vi in the third embodiment, however, need not be the same as the value of the intermediate voltage Vi shown in FIG. 16A. In this way, the intensity of the discharge generated due to the fall edge section can be suppressed by decreasing the fall edge section in steps. Therefore the dispersion of the wall charge distribution among the discharge cells CL can be suppressed.

In order to further suppress the dispersion of the wall charge distribution, the fall edge section of the discharge sustaining pulse $P^+$ may have two or more steps of voltage sustaining blocks. Specifically, just like the fall edge section of the discharge sustaining pulse $P^+$ shown in FIG. 18A, the fall edge section of the discharge sustaining pulse $P^+$ may have a first block where the applied voltage changes from the maximum voltage Vs of the final applied pulse $P^+$ to the intermediate voltage Vm, a second block where this applied voltage is sustained at a roughly constant intermediate voltage Vm for a predetermined time (first voltage sustaining block), a third block where this applied voltage changes from the intermediate voltage Vm to the intermediate voltage Vi, which is lower than the intermediate voltage Vm, a fourth block where this applied voltage is sustained at a roughly constant intermediate voltage Vi for a predetermined time (second voltage sustaining block), and a fifth block where this applied voltage changes from the intermediate voltage Vi to the setting voltage Vb. The values of the intermediate voltages Vi and Vm in the third embodiment need not be the same values of the intermediate voltages Vi and Vm shown in FIG. 18A. By creating a multi-step voltage sustaining block in the fall edge section, the dispersion of the wall charge distribution among the discharge cells CL can be suppressed even if a panel structure having very high discharge probability is used.

Just like the rise edge section of the charge adjustment pulse Pc shown in FIG. 19A or FIG. 20A, the rise edge section of the charge adjustment pulse Pc shown in FIG. 24 may be acquired by increasing the applied voltage between the scanning electrode $Y_j$ and the common electrode $X_j$ constituting each row electrode pair from the setting voltage Vb to the base voltage Vm gradually or in steps (stepwise). By this, the time required for the voltage value of the charge adjustment pulse Pc to reach from the setting voltage Vb to the base voltage Vm increases, and the intensity of the discharge which is generated at the rise of the charge adjustment pulse Pc can be weakened enough to be ignored. Hence the dispersion of wall charge distribution due to the rise edge section of the charge adjustment pulse Pc can be suppressed considerably.

In the emission period $T_2$, the number of discharge sustaining pulses $P^+$ is only one, in order to improve the grayscale representation capability for low brightness images, but is not limited to one. Just like the cases of other later mentioned emission periods, the discharge sustaining pulse $P^+$ may be repeatedly applied between the scanning electrode $Y_j$ and the common electrode $X_j$ constituting each row electrode pair.

Then in each selective erase period Te of the display periods of the subfields $SF_3$ to $SF_N$, the first row electrode driving section 16A applies the ground potential to the common electrodes $X_1$ to $X_n$, and the second row electrode driving section 16B applies the positive polarity base voltage Vp, which is higher than the ground potential, to the scanning electrodes $Y_1$ to $Y_n$. In this state, the second row electrode driving section 16B sequentially applies the scanning pulse Ps, which is superimposed on the base voltage Vp, to the scanning electrodes $Y_1, \ldots, Y_n$. The column electrode driving section 15 applies each of the erase pulse group $De_1, \ldots, De_n$ having positive voltage polarity to the column electrodes $D_1$ to $D_m$ synchronizing with each scanning pulse Ps. By this, an erase discharge (address discharge) is selectively generated in the selected cells CL out of the discharge cells CL, . . . , CL in the emission enable state, and the selected cells CL are set to the non-emission state (light OFF mode). As FIG. 24 shows, while the scanning pulse Ps is sequentially being applied, the base voltage Vp is applied to all the scanning electrodes $Y_1$ to $Y_n$, so when the scanning pulse Ps is being applied to a certain scanning electrode $Y_j$, an erase discharge is generated only in the discharge cells CL on this scanning electrode $Y_j$, and the generation of a discharge error is prevented in the discharge cells CL on the other scanning electrodes $Y_j$ to which the scanning pulse Ps is not applied.

In the emission period (discharge sustaining period) $T_q$ (q is one of 3 to N), following each selective erase period Te, the ground potential is applied to the column electrodes $D_1$ to $D_m$. The first row electrode driving section 16A applies an even number of discharge sustaining pulses $P^+$ assigned to the subfields $SF_q$ between the scanning electrode $Y_j$ and the common electrode $X_j$ constituting each row electrode pair. For the discharge sustaining pulse $P^+$, two types of voltage pulses, that is a first discharge sustaining pulse of which cathode is the scanning electrode $Y_j$ and anode is the common electrode $X_j$, and a second discharge sustaining pulse of which anode is the scanning electrode $Y_j$ and cathode is the common electrode $X_j$, are generated. The first and second row electrode driving sections 16A and 16B alternately apply the first discharge sustaining pulse and the second discharge sustaining pulse between the scanning electrode $Y_j$ and the common electrode $X_j$ constituting each row electrode pair.

In the emission period $T_q$, the second row electrode driving section 16B decreases the applied voltage between the scanning electrode $Y_j$ and the common electrode $X_j$ constituting each row electrode pair in steps at the fall of the final applied pulse $P^+$ out of the discharge sustaining pulses $P^+$ applied in the emission period $T_q$, then decreases this applied voltage toward the setting voltage Vb having a polarity different from that of the maximum voltage of the final applied pulse $P^+$, and applies the charge adjustment pulse Pc to the scanning electrodes $Y_1$ to $Y_n$. The waveforms of the fall edge section of the final applied pulse $P^+$ and the charge adjustment pulse Pc are the same as each waveform of the discharge sustaining pulse $P^+$ and the charge adjustment pulse Pc applied in the emission period $T_2$ of the subfield $SF_2$.

After the emission period $T_N$ of the final subfield $SF_N$ ends, the second row electrode driving section 16B applies the erase pulse Pe having negative polarity minimum voltage to all the scanning electrodes $Y_1$ to $Y_n$ in the erase period Tb. As this erase pulse Pe is applied, an erase discharge is generated only in the discharge cells CL in the emission enable state. By this erase discharge, the discharge cells CL in the emission enable state transit to the non-emission state.

In the first reset period $Tr_1$, the reset pulse Pya, which drops sharply at the fall, is applied to the scanning electrodes $Y_1$ to $Y_n$. After this reset pulse Pya, the charge adjustment pulse Pyc, of which inclination (time-based change rate of voltage) is roughly constant and which has negative voltage polarity, is applied. Instead of this reset pulse Pya and charge adjustment pulse Pyc, the reset pulse Pya, which has an inclination that gradually changes at the fall and which is smoothly connected with the waveform of the charge adjustment pulse Pyc, may be applied, and then the charge adjustment pulse Pyc having an inclination that gradually changes, may be applied, as shown in FIG. 17.

By the driving sequence according to the third embodiment, the emission pattern shown in FIG. 25 can be implemented. In FIG. 25, the symbol "□" indicates that the selective write discharge is generated in the first selective write period $Tw_1$ in the first subfield $SF_1$, and a micro-discharge is generated in the micro-emission period $T_{LL}$, the symbol "◎" indicates that the selective write discharge is generated in the second selective write period $Tw_2$ of the second subfield $SF_2$, and a sustaining discharge is generated in the discharge sustaining period $T_2$, the symbol "○" indicates that the sustaining discharge is generated in one of the discharge sustaining periods $T_3$ to $T_{14}$ of the subfields $SF_3$ to $SF_{14}$, and the symbol "●" indicates that a selective erase discharge is generated in one of the selective erase periods Te of the subfields $SF_3$ to $SF_{14}$.

If the display brightness of the grayscale level g of the video signal is $L_2(g)$, then the display brightness $L_2(g)$ is given by the following expression.

$$L_2(g) = B(g;1)x\alpha + \sum_{i=2}^{N} B(g;i)xW(i) \quad \text{[Expression 2]}$$

Here N is a total number of subfields $SF_1$ to $SF_N$, and is N=14 in the case of FIG. 25. B(g;i) is a value "1" if the discharge cell CL is set to the emission enable state in the i-th subfield $SF_i$ for a grayscale level g, and is a value "0" if the discharge cell CL is set to the non-emission state. α is a weight of brightness assigned to the first subfield $SF_1$, and W(i) is a weight of brightness assigned to the i-th subfield $SF_i$. For example, If the weight of brightness is set as W(2)=1, W(3)=2, W(4)=6, W(5)=8, W(6)=10, W(7)=12, W(8)=16, W(9)=22, W(10)=26, W(11)=30, W(12)=36, W(13)=40 and W(14)=46, then the display brightness $L_2(g)$ shown in the table in FIG. 25 is implemented.

The display brightness corresponding to the weight of brightness α assigned to the first subfield $SF_1$ is acquired by the micro-discharge, so [the display brightness] has a value smaller than the weight of brightness (=1) assigned to the second subfield $SF_2$. Therefore the display brightness (=α), which indicates the second grayscale level, is higher than the first grayscale level which indicates the black level (=0), and is lower than the display brightness (=1) of the third grayscale level. As FIG. 24 shows, the number of discharge sustaining pulses $P^+$ to be applied to the emission period $T_2$ of the subfield $SF_2$ is only one, which corresponds to the weight of brightness (=1) assigned to the second subfield $SF_2$. Therefore the grayscale representation when a low brightness image is displayed improves, and a low brightness image having a smooth gradation can be displayed. Also in the emission pattern shown in FIG. 25, the emission enable state of the discharge cells CL, which emit in the fourth grayscale level to sixteenth grayscale level, is continuous in one field of a display period, and the discharge cell CL, which is set once to the non-emission state, is never set to the emission enable state again, so the generation of a dynamic pseudo-contour is suppressed.

As FIG. 25 shows, a micro-discharge is generated in the display period of the first subfield $SF_1$ for all the grayscale levels except for the first and third grayscale levels, but a micro-discharge need not be generated in the display period of the first subfield $SF_1$ for the fourth or higher grayscale levels. This is because when the discharge cells CL emit in the fourth or higher grayscale levels, brightness (=α), due to a micro-discharge, is much lower than the brightness due to the sustaining discharge, so the ratio of the brightness due to a micro-discharge to the display brightness is low, and this is hardly recognized by human eyes.

The above mentioned driving sequence according to the third embodiment can be applied to any of the first panel structure shown in FIG. 3 and FIG. 4, the second panel structure shown in FIG. 5 and FIG. 6, and the third panel structure shown in FIG. 7 or FIG. 8. As mentioned above, the second panel structure improves the discharge delay by the priming effect, so a wide margin of driving voltage can be secured. If both the second panel structure and the third panel structure are used, a further improvement of the discharge delay and a wider margin of driving voltage can be implemented.

According to the driving sequence of the third embodiment, a single or a plurality of discharge sustaining pulses $P^+$ are applied in each of the emission periods $T_2$ to $T_{N-1}$ of the subfields $SF_2$ to $SF_{N-1}$, and at the fall of the final applied pulse $P^+$ out of the discharge sustaining pulses $P^+$, the applied voltage between the scanning electrode $Y_j$ and the common electrode $X_j$ constituting each row electrode pair decreases in steps. Hence just like the driving sequence according to the first embodiment, the intensity of the discharge which is generated at the fall of the final applied pulse $P^+$ can be weakened. Therefore the dispersion of the wall charge distribution among the discharge cells CL can be suppressed, and wall charge distribution can be controlled easily.

Also in the first reset period $Tr_1$, a reset discharge is generated between the column electrode $D_k$ which is a cathode and the scanning electrode $Y_j$ which an anode by applying the reset pulse Pya, then a weak discharge is generated by applying the charge adjustment pulse Pyc, and wall charge distribution is initialized. In the second reset period $Tr_2$, a reset discharge is generated between the column electrode $D_k$ which is a cathode and the scanning electrode $Y_j$ which is an anode by applying the reset pulse Pyb, then a weak discharge is generated by applying the adjustment pulse Pyd, and wall charge distribution is initialized. If the panel structure in FIG. 7 or FIG. 8 is used, positive charged particles migrate from the anode $Y_j$ to the cathode $D_k$ when such a reset discharge is generated, and collide with electron emission film 26*a* or crystal particles 26*e* shown in FIG. 7 or FIG. 8, whereby ion-induced secondary electrons (priming particles) are emitted from the electron emission film 26*a* or the crystal particles 26*e*, and the discharge start voltage drops. Therefore a relatively weak reset discharge can be generated. Hence weakening the reset discharge drops the background emission brightness due to this discharge, so the dark room contrast, when a low brightness image is displayed, can be improved.

Figure 26A:
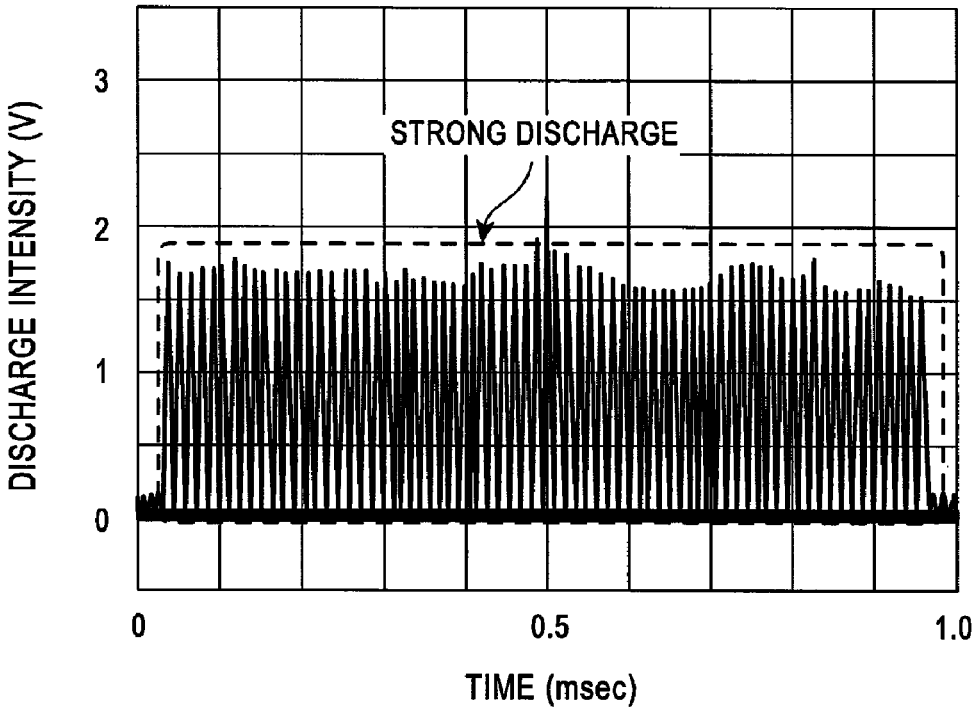
FIG. 26A depicts the measurement values of a gas discharge which is generated between the scanning electrode and the column electrode when a reset pulse is applied.
Figure 26B:
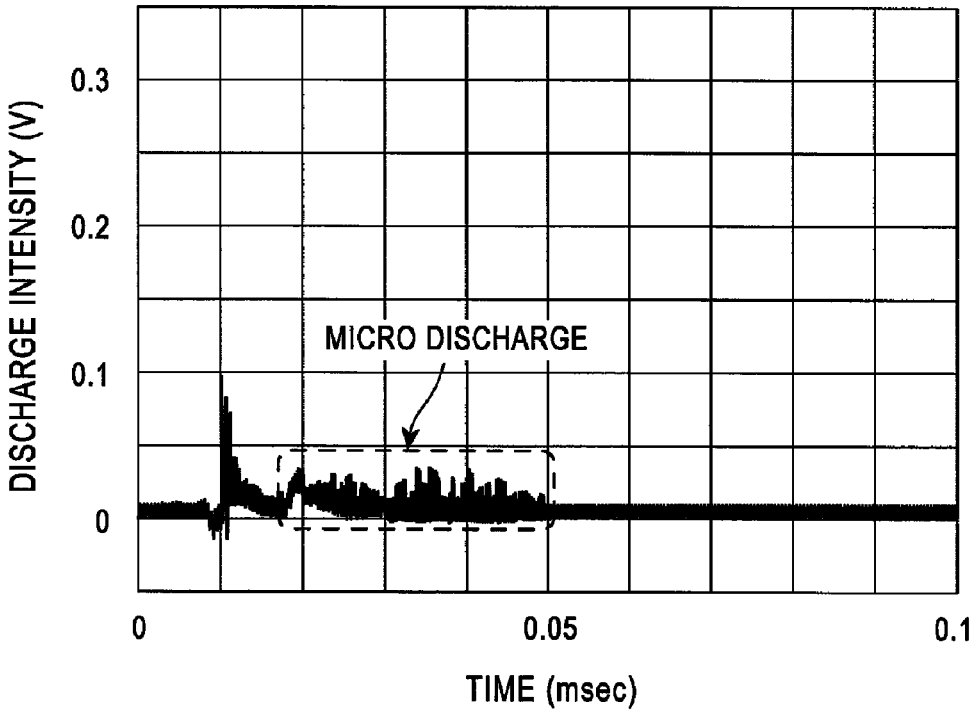
FIG. 26B depicts the measurement values of a gas discharge which is generated between the scanning electrode and the column electrode when a reset pulse is applied.

FIG. 26A and FIG. 26B are graphs depicting the measured values of the intensity of a gas discharge generated between the scanning electrode $Y_j$ and the column electrode $D_k$ when the reset pulse Pya is applied in the first reset period $Tr_1$. FIG. 26A shows a graph when the plasma display device 1 having the first panel structure (FIG. 5 and FIG. 6) is used, and FIG. 26B shows a graph when the fluorescent layer 26, containing the crystal particles 26*e* shown in FIG. 8, is used in addition to the first panel structure. According to the graph in FIG. 26A, a relatively strong reset discharge is continuously generated for more than 1 milliseconds when the reset pulse Pya is applied. On the other hand, according to FIG. 26B, a relatively weak reset discharge is generated and ends within about 0.04 milliseconds when the reset pulse Pya is applied. Therefore by using the third panel shown in FIG. 8 in addition to the first panel structure, the discharge delay can be improved considerably. Also the reset discharge can be weakened, so the dark room contrast can be improved considerably.

The above mentioned reset discharge is generated between the anode $Y_j$ and the cathode $D_k$, so compared with the case of generating a reset discharge between the common electrode $X_j$ and the scanning electrode $Y_j$, which are formed more toward the front substrate 22 side than the column electrode $D_k$, the light quantity emitted outside from the front substrate 22 decreases, therefore the dark room contrast can be further improved.

As FIG. 24 shows, only the discharge generated in the discharge cells CL which display the first grayscale level (black level) in one field of a display period is the reset discharge in the first reset period $Tr_1$. Also as FIG. 24 shows, in the display period of the first subfield $SF_1$, the maximum peak voltage of the reset pulse Pya, which is applied in the first reset period $Tr_1$, is lower than the maximum peak voltage of the reset pulse Pyb, which is applied in the second reset period $Tr_2$. Therefore even if a reset discharge is generated in all the discharge cells CL at the same time in the first reset period $Tr_1$, the light quantity generated by this reset discharge is very low. Hence the background emission brightness due to this reset discharge is small enough to be ignored, and an improvement of the dark room contrast can be implemented.

In the emission period $T_2$ of the subfield $SF_2$, not only the surface discharge between the common electrode $X_j$ and scanning electrode $Y_j$, but also the discharge between the scanning electrode $Y_j$, which is the anode, and the column electrode $D_k$, which is the cathode, is generated. As a result, negative polarity wall charges are stored in the wall face close to the scanning electrode $Y_j$, and positive polarity wall charges are stored in the wall face close to the column electrode $D_k$. By this, the selective erase discharge can be easily generated between the scanning electrode $Y_j$ which is a cathode and the column electrode $D_k$ which is the anode in the selective erase period Te of the next subfield $SF_3$. In the emission periods $T_3$ to $T_{N-1}$ of the subfields $SF_3$ to $SF_{N-1}$, a number of discharge sustaining pulses $P^+$ to be applied to each row electrode pair is set to an even number. Therefore immediately after each emission period of the subfields $SF_3$ to $SF_{N-1}$ is over, the negative polarity wall charges are stored in the wall face close to the scanning electrode $Y_j$, and positive polarity wall charges are stored in the wall face close to the column electrode $D_k$. Because of this, in the selective erase period Te following each emission period of the subfields $SF_3$ to $SF_{N-1}$, a selective erase discharge can be easily generated between the scanning electrode $Y_j$ which is the cathode and the column electrode $D_k$ which is the anode. Since it is sufficient to apply only the positive polarity pulses to the column electrode $D_k$ during one field of a display period, the circuit configuration of the column electrode driving section 15 can be simplified, and the manufacturing cost can be suppressed.

Fourth Embodiment

Figure 27:
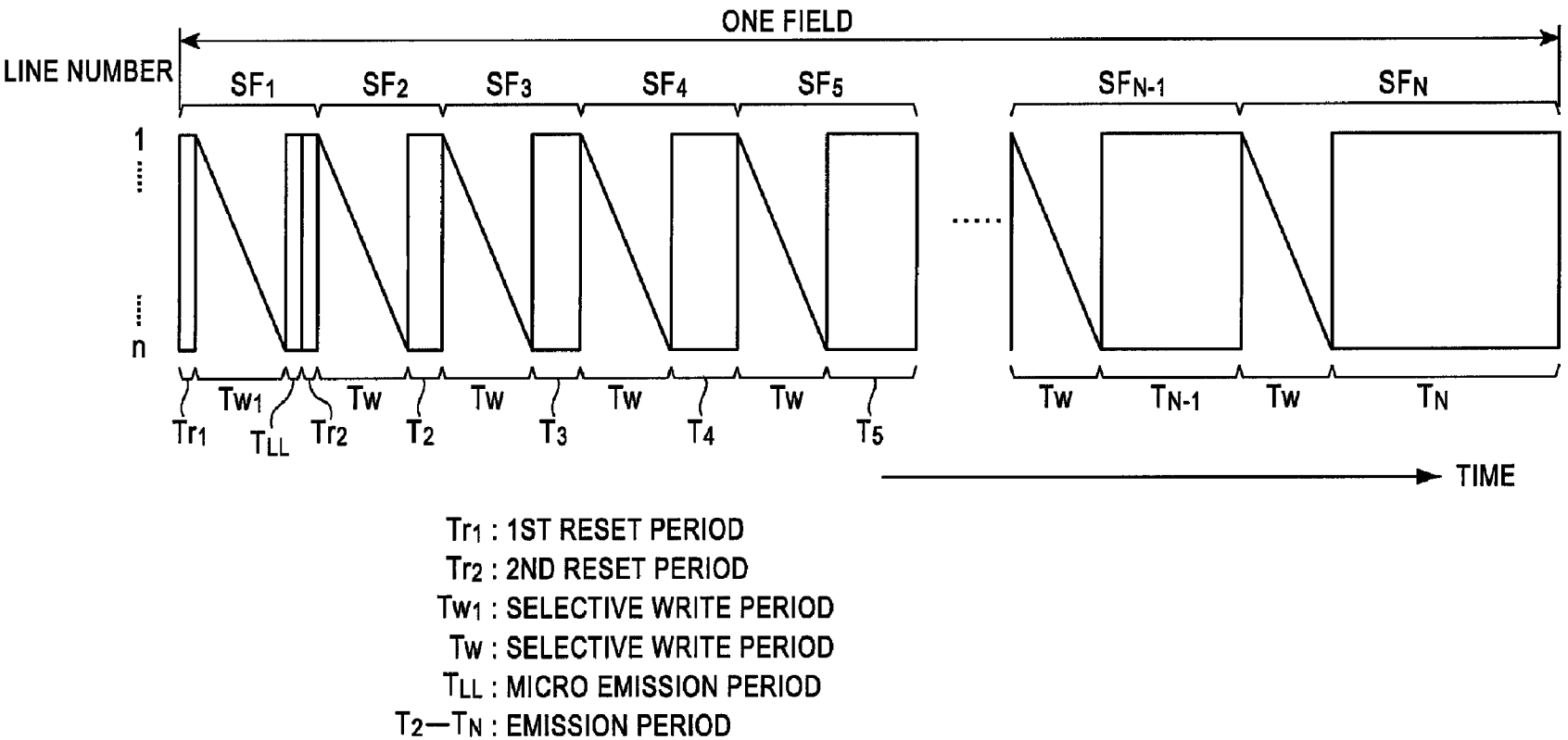
FIG. 27 is a diagram depicting a driving sequence according to the fourth embodiment of the present invention.
Figure 28:
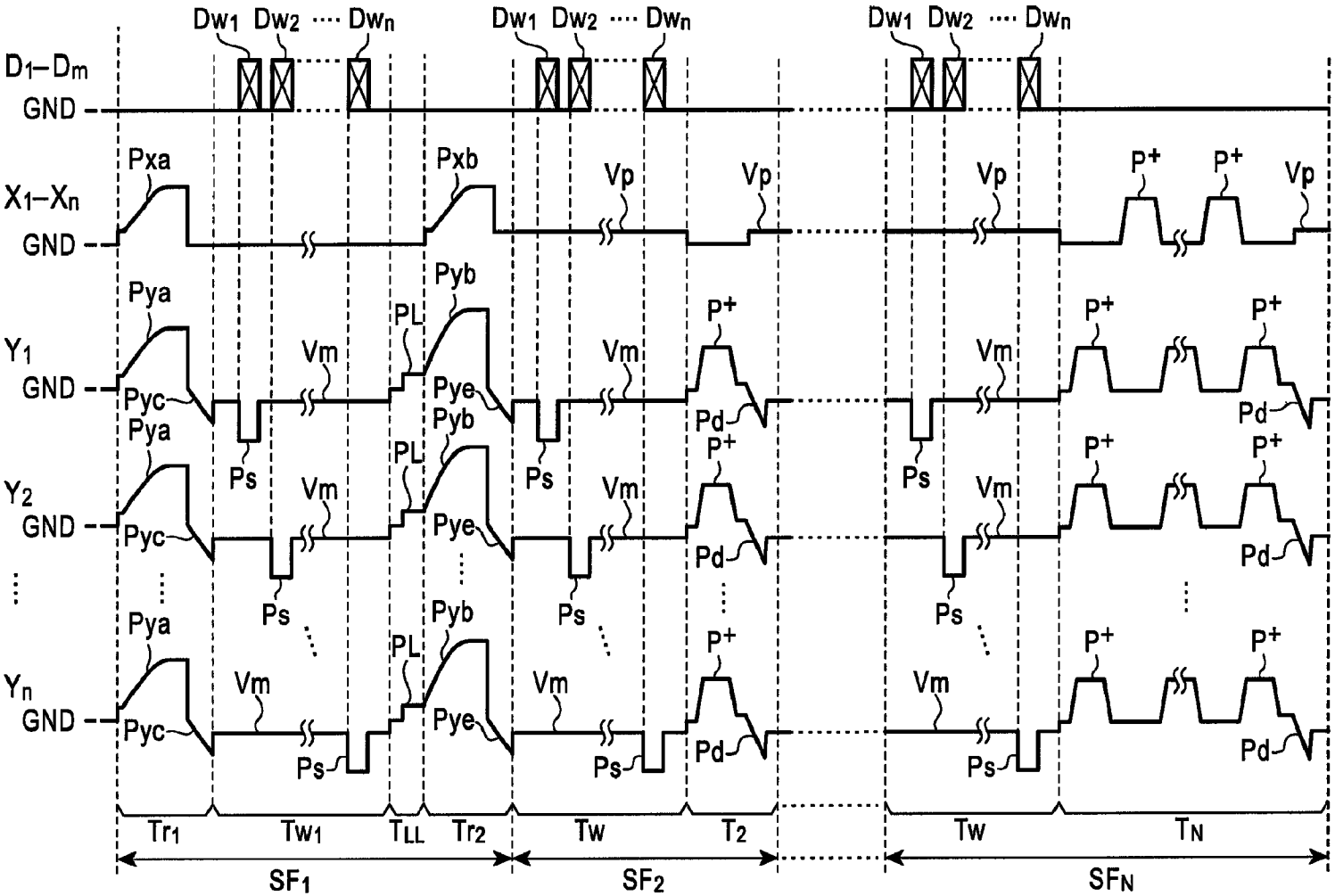
FIG. 28 is a timing chart depicting a waveform of the driving signal based on the driving sequence in FIG. 27.

Now a driving sequence according to a fourth embodiment of the present invention will be described. FIG. 27 is a diagram depicting the driving sequence according to the fourth embodiment. In this driving sequence, one field of the video signal is divided into N number (N is 2 or greater integer) of subfields $SF_1$ to $SF_N$, which are arrayed continuously in the display sequence. FIG. 28 is a timing chart depicting waveforms of driving signals according to the driving sequence in FIG. 27. FIG. 28 shows a signal waveform which is applied to the column electrodes $D_1$ to $D_n$, a signal waveform which is applied to the common electrodes $X_1$ to $X_n$, and a signal waveform which is applied to the scanning electrodes $Y_1, \ldots, Y_n$ respectively.

The driving signals in the display period of the first subfield $SF_1$ shown in FIG. 28 are the same as the driving signals in the display period of the first subfield $SF_1$ shown in FIG. 24, so a detailed description thereof is omitted. The driving signals in the selective write period Tw of the subfields $SF_2$ to $SF_N$ shown in FIG. 28 are also the same as the driving signals in the second selective write period $Tw_2$ shown in FIG. 24, so a detailed description thereof is omitted.

As FIG. 28 shows, only the selected cells CL to be turned ON are set to emission enable state, immediately after each selective write period Tw of the subfields $SF_2$ to $SF_N$. In other words, in the selected cells CL, negative polarity wall charges are stored on the wall face close to the column electrode $D_k$, positive polarity wall charges are stored on the wall face of the scanning electrode $Y_j$, and negative polarity wall charges are stored on the wall face close to the common electrode $X_j$.

As FIG. 28 shows, in the emission period $T_2$ of the subfield $SF_2$, the potentials of the column electrodes $D_1$ to $D_m$ are clamped to the ground potential, and the potentials of the common electrodes $X_1$ to $X_n$ are also clamped to the ground potential. In this state, the second row electrode driving section 16B applies the voltage pulse of which anode is the scanning electrode $Y_j$ and cathode is the common electrode $X_j$ between the scanning electrode $Y_j$ and the common electrode $X_j$ constituting each row electrode pair, as the discharge sustaining pulse $P^+$. This discharge sustaining pulse $P^+$ is superimposed on the voltage generated by existing wall charges in the discharge cells CL in the emission enable state. By this, a surface discharge is generated between the scanning electrode $Y_j$ and the common electrode $X_j$, and at the same time, a counter-discharge is generated between the scanning electrode $Y_j$ and the column electrode $D_k$. Ultraviolet generated by these gas discharges excites the excitons in the fluorescent layer 26, and allows visible light to emit. Out of the charged particles generated by these gas discharges, positive charge particles are attracted to the cathode $X_j$ and negative charge particles are attracted to the anode $Y_j$ and the column electrode $D_k$. As a result, the charge polarity of the wall face close to the common electrode $X_j$ and the charge polarity of the wall face close to the scanning electrode $Y_j$ are reversed.

In the emission period $T_2$, the second row electrode driving section 16B decreases the applied voltage between the scanning electrode $Y_j$ and the common electrode $X_j$ in steps (stepwise) when the discharge sustaining pulse $P^+$ falls, then decreases this applied voltage toward a predetermined setting voltage Vb having a polarity different from that of the maximum voltage of the discharge sustaining pulse $P^+$. After allowing this applied voltage to transit to the setting voltage Vb, the second row electrode driving section 16B increases this applied voltage to a negative polarity base voltage Vm, which is higher than the setting voltage Vb and lower than the ground potential, whereby an erase pulse Pd having a wedge type waveform is applied. While this erase pulse Pd is being applied, the first row electrode driving section 16A applies a positive polarity base voltage Vp, which is higher than the ground potential, to the common electrodes $X_1$ to $X_n$. As the erase pulse Pd is applied, a weak discharge is generated between the common electrode $X_j$ and the scanning electrode $Y_j$, and between the scanning electrode $Y_j$ and the column electrode $D_k$ respectively in the discharge cells CL in the emission enable state, and the discharge cells CL in the emission enable state are set in the non-emission state. The wall charge distribution in the discharge cells CL is adjusted to a distribution with which a selective write discharge can be generated without error in the next selective erase period Tw.

Here, just like the fall edge section (rear edge section) of the discharge sustaining pulse $P^+$ shown in FIG. 16A, the fall edge section of the discharge sustaining pulse $P^+$ has a first block where the applied voltage between the common electrode $X_j$ and the scanning electrode $Y_j$ changes from the maximum voltage Vs of the discharge sustaining pulse $P^+$ to the intermediate voltage Vi, a second block where this applied voltage is sustained at a roughly constant intermediate voltage Vi for a predetermined time (voltage sustaining block), and a third block where this applied voltage changes from the intermediate voltage Vi to the setting voltage Vb. The value of the intermediate voltage Vi in the fourth embodiment, however, need not be the same as the value of the intermediate voltage Vi shown in FIG. 16A. In this way, the intensity of the discharge generated due to the fall edge section can be suppressed by decreasing the fall edge section in steps. Therefore the dispersion of the wall charge distribution among discharge cells CL can be suppressed.

In order to further suppress the dispersion of the wall charge distribution, the fall edge section of the discharge sustaining pulse $P^+$ may have two or more steps of voltage sustaining blocks. Specifically, just like the fall edge section of the discharge sustaining pulse $P^+$ shown in FIG. 18A, the fall edge section of the discharge sustaining pulse $P^+$ may have a first block where the applied voltage changes from the maximum voltage Vs of the final applied pulse $P^+$ to the intermediate voltage Vm, a second block where this applied voltage is sustained at a roughly constant intermediate voltage Vm for a predetermined time (first voltage sustaining block), a third block where this applied voltage changes from the intermediate voltage Vm to the intermediate voltage Vi, which is lower than the intermediate voltage Vm, a fourth block where this applied voltage is sustained at a roughly constant intermediate voltage Vi for a predetermined time (second voltage sustaining block), and a fifth block where this applied voltage changes from the intermediate voltage Vi to the setting voltage Vb. The values of the intermediate voltages Vi and Vm in the fourth embodiment need not be the same as the values of the intermediate voltages Vi and Vm shown in FIG. 18A. By creating a multi-step voltage sustaining block in the fall edge section, a dispersion of the wall charge distribution among the discharge cells CL can be suppressed even if a panel structure having very high discharge probability is used.

Just like the rise edge section of the charge adjustment pulse Pc shown in FIG. 19A or FIG. 20A, the rise edge section of the erase pulse Pd shown in FIG. 28 may be acquired by increasing the applied voltage between the scanning electrode $Y_j$ and the common electrode $X_j$ constituting each row electrode pair from the setting voltage Vb to the base voltage Vm gradually or in steps (stepwise). By this, the time required for the voltage value of the erase pulse Pd to reach from the setting voltage Vb to the base voltage Vm increases, and the intensity of the discharge which is generated at the rise of the erase pulse Pd can be weakened enough to be ignored. Hence the dispersion of wall charge distribution due to the rise edge section of the erase pulse Pd can be suppressed considerably.

In the emission period $T_2$, the number of discharge sustaining pulses $P^+$ is only one, in order to improve the grayscale representation capability for low brightness images, but is not limited to one. Just like the cases of the other later mentioned emission periods, the discharge sustaining pulse $P^+$ may be repeatedly applied between the scanning electrode $Y_j$ and the common electrode $X_j$ constituting each row electrode pair.

Then in each selective write period Tw of the display period of the subfields $SF_3$ to $SF_N$, a write discharge is selectively generated in the discharge cells CL, . . . , CL of the plasma display panel 2, and only the selected cells CL out of the discharge cells CL are set to the emission enable state (Light ON mode), just like the case of the selective write period Tw of the subfield $SF_2$.

In the emission period $T_q$ (q is one of 3 to N) following the selective write period Tw, the potentials of the column electrodes $D_1$ to $D_m$ are clamped to the ground potential. In this state, the first row electrode driving section 16A applies an odd number of discharge sustaining pulses $P^+$ assigned to the subfield $SF_q$ between the scanning electrode $Y_j$ and the common electrode $X_j$ constituting each row electrode pair. For the discharge sustaining pulse $P^+$, two types of voltage pulses, that is a first discharge sustaining pulse of which cathode is the scanning electrode $Y_j$ and anode is the common electrode $X_j$, and a second discharge sustaining pulse of which anode is the scanning electrode $Y_j$ and cathode is the common electrode $X_j$, are generated. The first and the second row electrode driving sections 16A and 16B alternately apply the first discharge sustaining pulse and the second discharge sustaining pulse between the scanning electrode $Y_j$ and the common electrode $X_j$ constituting each row electrode pair.

In the emission period $T_q$ (q is one of 3 to N−1), the second row electrode driving section 16B decreases the applied voltage between the scanning electrode $Y_j$ and the common electrode $X_j$ constituting each row electrode pair in steps (stepwise) at the fall of the final applied pulse $P^+$ out of the discharge sustaining pulses $P^+$ applied in the emission period $T_q$, then decreases this applied voltage toward the setting voltage Vb having a polarity different from that of the maximum voltage of the final applied pulse $P^+$, and applies the erase pulse Pd to the scanning electrodes $Y_1$ to $Y_n$. While this final applied pulse $P^+$ is being supplied, the positive polarity base voltage Vp is applied to the common electrodes $X_1$ to $X_n$.

The waveforms of the fall edge section of the final applied pulse $P^+$ and the erase pulse Pd are the same as each waveform of the discharge sustaining pulse $P^+$ and the erase pulse Pd applied in the emission period $T_2$ of the subfield $SF_2$.

When the erase pulse Pd is applied, a weak discharge is generated between the common electrode $X_j$ and the scanning electrode $Y_j$, and between the scanning electrode $Y_j$ and the column electrode $D_k$ respectively, in the discharge cells CL in the emission enable state, and the discharge cells CL in the emission enable state are set to the non-emission state. The wall charge distribution in the discharge cells CL is adjusted to the distribution with which a selective write discharge can be generated without error in the next selective write period Tw.

In the reset period Tr of the first subfield $SF_1$, the reset pulse Pya, which drops sharply at the fall, is applied to the scanning electrodes $Y_1$ to $Y_n$, and after this reset pulse Pya, the charge adjustment pulse Pyc, of which inclination (time-based change rate of voltage) is roughly constant and which has negative voltage polarity, is applied. Instead of the reset pulse Pya and the charge adjustment pulse Pyc, the reset pulse Pya which has an inclination that gradually changes at the fall and which is smoothly connected with the waveform of the charge adjustment pulse Pyc may be applied, and then the charge adjustment pulse Pyc having an inclination that gradually changes may be applied, as shown in FIG. 17.

According to the driving sequence of the fourth embodiment, a single or a plurality of discharge sustaining pulses $P^+$ are applied in each of the emission periods $T_2$ to $T_N$ of the subfields $SF_2$ to $SF_N$, and at the fall of the final applied pulse $P^+$ out of the discharge sustaining pulses $P^+$, the applied voltage between the scanning electrode $Y_j$ and the common electrode $X_j$ constituting each row electrode pair decreases in steps. Hence, just like the driving sequence according to the first embodiment, the intensity of the discharge which is generated at the fall of the final applied pulse $P^+$ can be weakened. Therefore the dispersion of the wall charge distribution among the discharge cells CL can be suppressed, and wall charge distribution can be easily controlled.

In the driving sequence according to the fourth embodiment, the display brightness indicating the second grayscale level (=α) is acquired by a micro-discharge which is generated in the emission period $T_{LL}$ of the first subfield $SF_1$, just like the above mentioned third embodiment. This display brightness (=α) can be higher than the first grayscale level which indicates the black level, and can be lower than the display brightness corresponding to the third grayscale level acquired by the sustaining discharge which is generated in the emission period $T_2$ of the subfield $SF_3$. Therefore the grayscale representation capability when a low brightness image is displayed can be improved, and a low brightness image having smooth gradation can be displayed.

<Modifications>

As FIG. 24 and FIG. 28 show, in the first reset period $Tr_1$, the first row electrode driving section 16A applies the reset pulse Pxa having positive voltage polarity to the common electrodes $X_1$ to $X_n$, and at the same time, the second row electrode driving section 16B applies the reset pulse Pya having positive voltage polarity to the scanning electrodes $Y_1$ to $Y_n$. A major purpose of applying the reset pulses Pxa and Pya is to generate a reset discharge between the cathode $D_k$ and the anode $Y_j$, and to allow priming particles to emit from the secondary emission material so as to stabilize the address discharge in the selective write period $Tw_1$.

However, as FIG. 7 and FIG. 8 show, if the above mentioned electron emission film 26*a* containing magnesium oxide crystals is formed on the fluorescent layer 26, or if the above mentioned magnesium oxide crystalline particles 26*e* are scattered in the fluorescent layer 26, the priming effect increases considerably compared with the case of not using the panel structure shown in FIG. 7 and FIG. 8, so the address discharge in the selective write period $Tw_1$ can be further improved. In this case, a driving sequence in which a reset discharge is not generated in the selective write period $Tw_1$ can be used.

Figure 29:
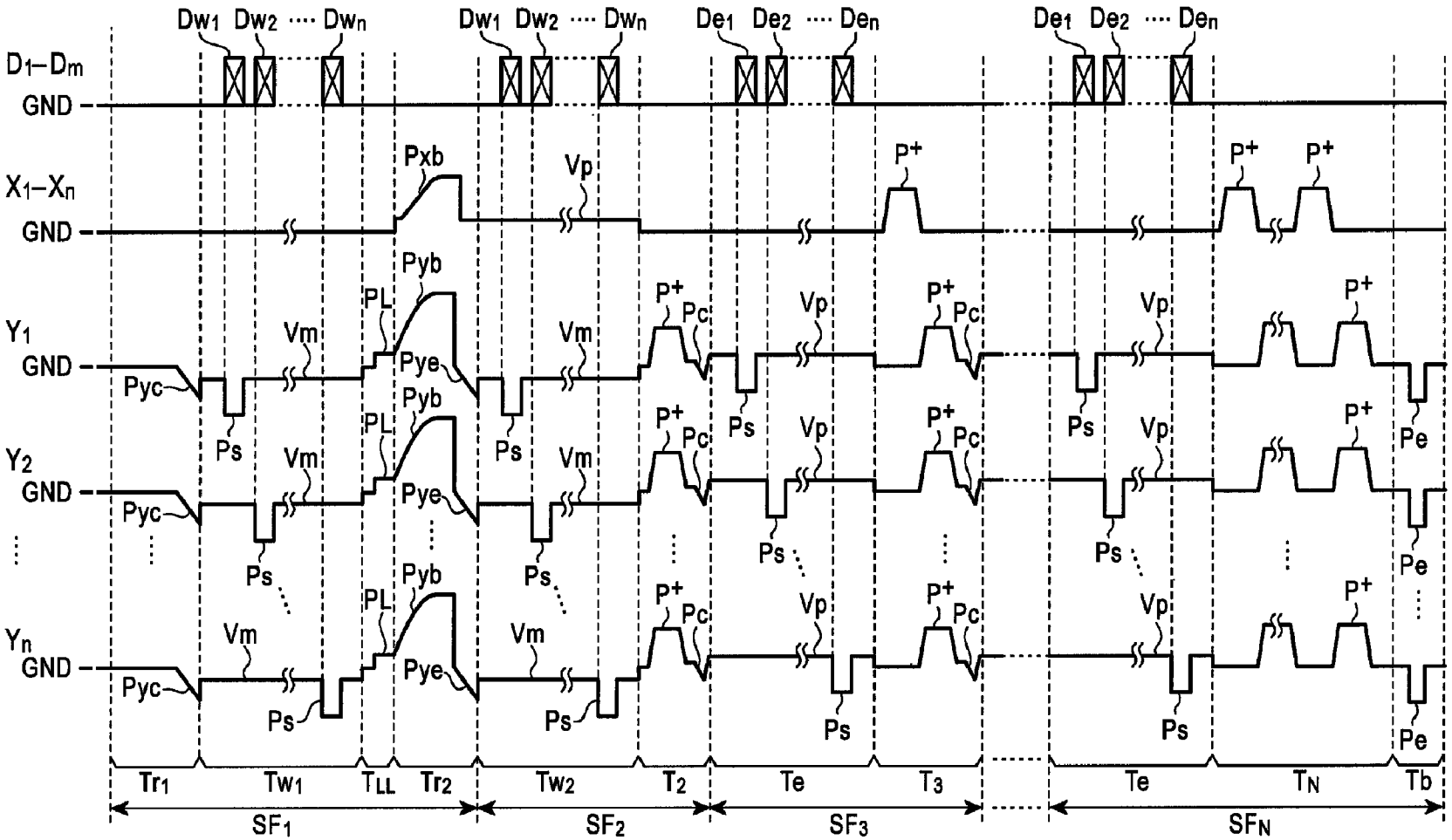
FIG. 29 is a timing chart depicting a waveform of the driving signal based on a variant form of the driving sequence in FIG. 24.
Figure 30:
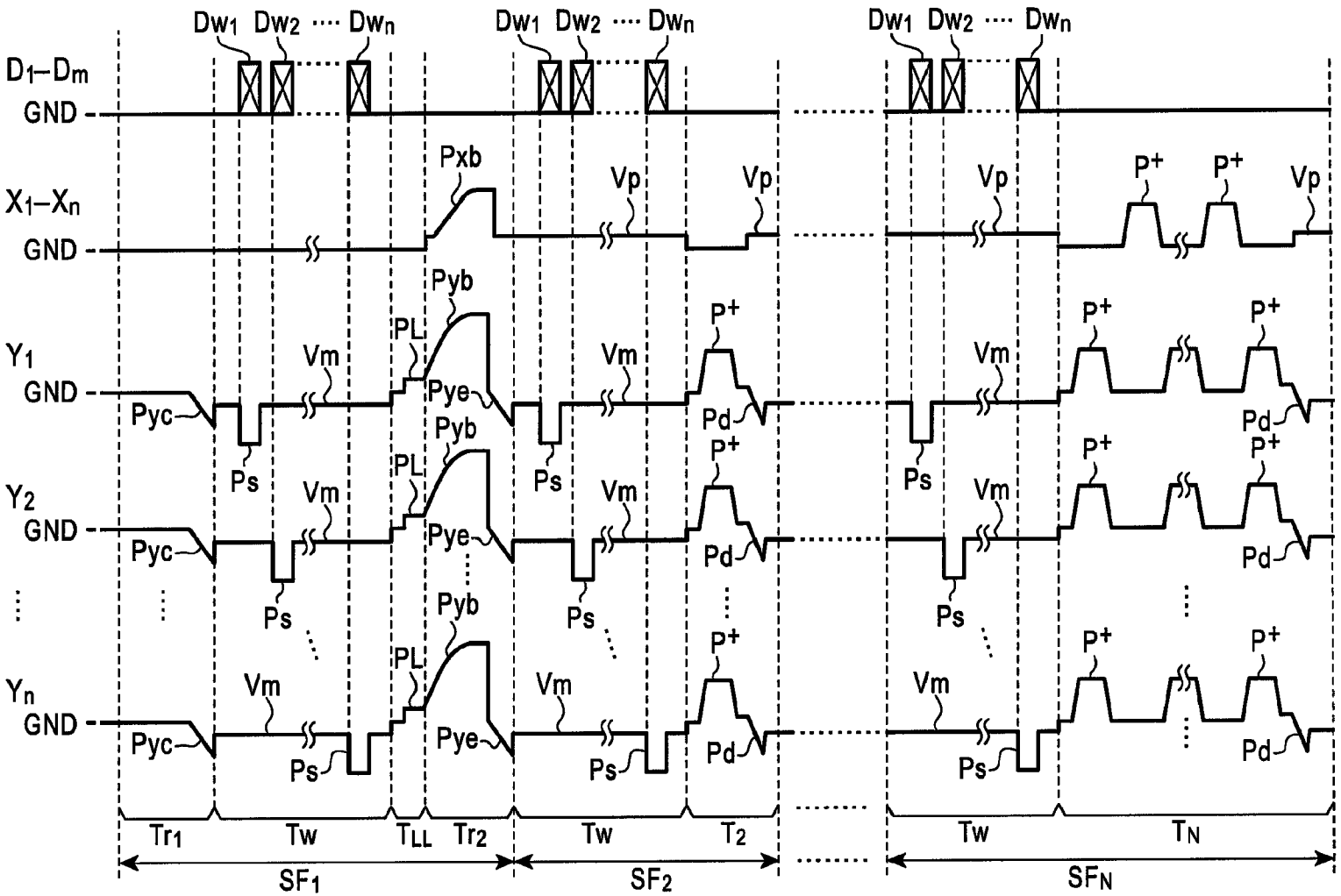
FIG. 30 is a timing chart depicting a waveform of the driving signal based on a variant form of the driving sequence in FIG. 28.

In this way, if the address discharge in the selective write period $Tw_1$ can be stabilized without applying the reset pulses Pxa and Pya, then the potentials of the common electrodes $X_1$ to $X_n$ may be clamped to the ground potential, and the potentials of the scanning electrodes $Y_1$ to $Y_n$ may be clamped to the ground potential as shown in FIG. 29, instead of the driving signal waveforms shown in FIG. 24. In the same way, the potentials of the common electrodes $X_1$ to $X_n$ may be clamped to the ground potential, and the potentials of the scanning electrodes $Y_1$ to $Y_n$ may be clamped to the ground potential as shown in FIG. 30, instead of the driving signal waveforms shown in FIG. 28. After the generation of the erase discharge in the erase period Tb of the previous field period (FIG. 29) or after the generation of the erase discharge in the display period of the previous final subfields $SF_N$ (FIG. 30), a discharge is generated in the first reset period $Tr_1$ by applying the charge adjustment pulse Pyc, so all the discharge cells CL immediately after the first reset period $Tw_1$ is over are in the non-emission state.

As shown in FIG. 24 and FIG. 28, in the second reset period $Tr_2$, the reset pulse Pxb is applied to the common electrodes $X_1$ to $X_n$ and the reset pulse Pyb is applied to the scanning electrodes $Y_1$ to $Y_n$, in order to stabilize the address discharge in the subsequent selective write period $Tw_2$ or Tw. By applying the reset pulses Pxb and Pyb, a reset charge is generated and the priming particles are generated. It is preferable not to omit the reset discharge in the second reset period $Tr_2$. This is because if this reset discharge is omitted, an address discharge is not generated in the selective write period $Tw_2$ or Tw, and discharge cells CL may fail to transit to the emission enable state, then a sustaining discharge is not generated and emission is not generated in the discharge cells CL in all the emission periods $T_2$ to $T_N$. For the same reason, it is preferable not to omit applying reset pulses Pxa and Pya in the reset period Tr as well, as shown in FIG. 14.

This application is based on Japanese Patent Application No. 2007-68194 filed on Mar. 16, 2007 and the entire disclosure thereof is incorporated herein by reference.

What is claimed is:

1. A driving method for a plasma display panel which has a plurality of row electrode pairs, a plurality of column electrodes formed so as to face the row electrode pairs via discharge spaces, and a plurality of discharge cells formed in areas where the plurality of row electrode pairs and the plurality of column electrodes cross respectively, wherein discharge gas is sealed in each discharge cell and both a fluorescent layer and a secondary emission material, which contacts the discharge space, are formed on each column electrode, the driving method comprising:

dividing a display period in each field of an input video signal into a plurality of subfield periods;

generating an address discharge in selected cells out of the discharge cells and setting the selected cells to either an emission enable state or a non-emission state, in an address period which is set in each subfield period;

generating a sustaining discharge in a discharge space of discharge cells being set to the emission enable state, by applying at least one discharge sustaining pulse between a scanning electrode and a common electrode constituting each row electrode pair, in a discharge sustaining period following the address period; and decreasing the applied voltage between the scanning electrode and common electrode in steps when a final applied pulse out of the discharge sustaining pulses falls, and then decreasing the applied voltage toward a predetermined voltage having a polarity different from that of the maximum voltage of the final applied pulse.

2. The driving method according to claim 1, wherein a fall edge section of the final applied pulse comprises a first block where the applied voltage changes from a maximum voltage of the final applied pulse to a first intermediate voltage, a second block where the applied voltage is sustained at the first intermediate voltage for a predetermined time, and a third block where the applied voltage changes from the first intermediate voltage to the predetermined voltage.

3. The driving method according to claim 2, wherein the first intermediate voltage is higher than a ground potential, and the predetermined voltage is lower than the ground potential.

4. The driving method according to claim 2, wherein the first block comprises a block where the applied voltage changes from the maximum voltage of the final applied pulse to a second intermediate voltage which is lower than the maximum voltage and is higher than the first intermediate voltage, a block where the applied voltage is sustained at the second intermediate voltage for a predetermined time, and a block where the applied voltage changes from the second intermediate voltage to the first intermediate voltage.

5. The driving method according to claim 2, wherein the applied voltage is decreased in steps by sustaining an applied voltage between the scanning electrode and common electrode at a second intermediate voltage which is lower than the maximum voltage of the final applied pulse and is higher than the first intermediate voltage for a predetermined time when the final applied pulse falls, then decreasing the applied voltage toward the first intermediate voltage.

6. The driving method according to claim 1, wherein the applied voltage is decreased in steps by sustaining the applied voltage at a first intermediate voltage which is lower than the maximum voltage of the final applied pulse for a predetermined time when the final applied pulse falls, then decreasing the applied voltage toward the predetermined voltage which is lower than the first intermediate voltage and has a polarity different from that of the first intermediate voltage.

7. The driving method according to claim 1, wherein in the address period, an address discharge is selectively generated in the discharge cells by sequentially applying a scanning pulse, on which a positive polarity or a negative polarity base voltage is superimposed, to scanning electrodes constituting the row electrode pairs, and applying a voltage pulse synchronizing with each scanning pulse to the column electrodes, so as to set the selected cells to either the emission enable state or the non-emission state, and in the discharge sustaining period, immediately after the applied voltage between the scanning electrode and common electrode reaches the predetermined voltage, the applied voltage is changed to a base voltage which is to be applied in the address period of the next subfield following the discharge sustaining period.

8. The driving method according to claim 7, wherein the applied voltage is changed to the base voltage by gradually increasing the applied voltage between the scanning electrode and common electrode toward the base voltage.

9. The driving method according to claim 7, wherein the applied voltage is changed to the base voltage by increasing the applied voltage between the scanning electrode and common electrode toward the base voltage in steps.

10. The driving method according to claim 1, further comprising initializing the discharge cells to either the emission enable state or the non-emission state in a reset period which is set in one subfield period out of the plurality of subfield periods.

11. The driving method according to claim 10, wherein in the reset period, a reset discharge is generated and the discharge cells are initialized by applying a voltage, of which anode is the scanning electrode and cathode is the column electrode, between at least the scanning electrode out of the scanning electrode and common electrode constituting each row electrode pair, and the column electrode.

12. The driving method according to claim 10, wherein each subfield period has the address period and the discharge sustaining period, and the one subfield period is a first subfield period at the beginning of the plurality of subfield periods, and the reset period is set only for the first subfield period.

13. The driving method according to claim 1, further comprising:

initializing the discharge cells to either an emission enable state or a non-emission state in a first reset period which is set in a first subfield at the beginning of the plurality of subfield periods;

generating an address discharge in selected cells out of the discharge cells so as to set the selected cells to either the emission enable state or the non-emission state, in a first address period which is set after the first reset period in the first subfield period; and initializing the discharge cells to either the emission enable state or the non-emission state, in a second reset period which is set after the first address period in the first subfield period, wherein each of subsequent subfield periods out of the plurality of subfield periods, excluding the first subfield period, has the address period and the discharge sustaining period.

14. The driving method according to claim 13, wherein in the first reset period, a first reset discharge is generated and the discharge cells are initialized by applying a voltage, of which anode is at least one of the scanning electrode and common electrode constituting each row electrode pair and cathode is the column electrode, between the at least one electrode and the column electrode.

15. The driving method according to claim 13, wherein in the second reset period, a second reset discharge is generated and the discharge cells are initialized by applying a voltage, of which anode is at least one of the scanning electrode and common electrode constituting each row electrode pair and cathode is the column electrode, between the at least one electrode and the column electrode.

16. The driving method according to claim 13, further comprising generating a micro discharge in the discharge cells which are set to the emission enable state, by applying a voltage, of which anode is the scanning electrode constituting each row electrode pair and cathode is the column electrode, between the scanning electrode and the column electrode, in a micro emission period which is set after the first address period and before the second reset period in the first subfield period.

17. The driving method according to claim 16, wherein by the micro discharge, the fluorescent layer in the discharge cell emits light corresponding to a grayscale level which is one level higher than the grayscale level to indicate a black level.

18. The driving method according to claim 1, wherein the secondary emission material includes a material which emits electrons into the discharge space upon reception of an electric field.

19. The driving method according to claim 1, wherein each discharge cell includes a dielectric layer which covers the row electrode pair, and an electron emission layer which is formed of a secondary emission material and which covers the dielectric layer.

20. The driving method according to claim 1, wherein each discharge cell includes an electron emission layer which is formed of the secondary emission material and which covers the fluorescent layer.

21. The driving method according to claim 20, wherein the secondary emission material contains magnesium oxide crystal, that is a cathode luminescence material which is excited by electron beam irradiation and has an emission peak in the wavelength range of 200 to 300 nano meter.

22. The driving method according to claim 21, wherein the emission peak of the cathode luminescence material exists in the wavelength range of 230 to 250 nano meter.

23. The driving method according to claim 22, wherein particles generated by vapor phase oxidation reaction of metal magnesium vapor and oxygen is used as the magnesium oxide crystal.

24. The driving method according to claim 1, wherein crystal particles of the secondary emission material scatter in the fluorescent layer in a state of being exposed to the discharge space.

25. A driving method for a plasma display panel which has a plurality of row electrode pairs, a plurality of column electrodes formed so as to face the row electrode pairs via discharge spaces, and a plurality of discharge cells formed in areas where the plurality of row electrode pairs and the plurality of column electrodes cross respectively, wherein discharge gas is sealed and a fluorescent layer is formed in each discharge cell, the driving method comprising:

dividing a display period in each field of an input video signal into a plurality of subfield periods;

generating an address discharge in selected cells out of the discharge cells and setting the selected cells to either an emission enable state or a non-emission state, in an address period which is set in each subfield period;

generating a sustaining discharge in a discharge space of discharge cells being set to the emission enable state, by applying at least one discharge sustaining pulse between a scanning electrode and common electrode constituting each row electrode pair, in a discharge sustaining period following the address period; and decreasing the applied voltage between the scanning electrode and common electrode in steps when a final applied pulse out of the discharge sustaining pulses falls, and then decreasing the applied voltage toward a predetermined voltage having a polarity different from that of the maximum voltage of the final applied pulse, wherein a fall edge section of the final applied pulse comprises a first block where the applied voltage changes from a maximum voltage of the final applied pulse to a first intermediate voltage, a second block where the applied voltage is sustained at the first intermediate voltage for a predetermined time, and a third block where the applied voltage changes from the first intermediate voltage to the predetermined voltage, and the first block comprises a block where the applied voltage changes from the maximum voltage of the final applied pulse to a second intermediate voltage which is lower than the maximum voltage, and is higher than the first intermediate voltage, a block where the applied voltage is sustained at the second intermediate voltage for a predetermined time, and a block where the applied voltage changes from the second intermediate voltage to the first intermediate voltage.

26. The driving method according to claim 25, further comprising increasing the applied voltage between the scanning electrode and the common electrode from the predetermined voltage in steps after the applied voltage reaches the predetermined voltage.

27. A driving method for a plasma display panel which has a plurality of row electrode pairs, a plurality of column electrodes formed so as to face the row electrode pairs via discharge spaces, and a plurality of discharge cells formed in areas where the plurality of row electrode pairs and the plurality of column electrodes cross respectively, wherein discharge gas is sealed and a fluorescent layer is formed in each discharge cell, the driving method comprising:

dividing a display period in each field of an input video signal into a plurality of subfield periods;

selectively generating an address discharge in the discharge cells by sequentially applying a scanning pulse, on which a positive polarity or a negative polarity base voltage is superimposed, to scanning electrodes constituting the row electrode pairs, and applying a voltage pulse synchronizing with each scanning pulse to the column electrodes in an address period which is set in each subfield period, so as to generate an address discharge in selected cells out of the discharge cells and set the selected cells to either an emission enable state or a non-emission state;

generating a sustaining discharge in a discharge space of discharge cells being set to the emission enable state, by applying at least one discharge sustaining pulse between a scanning electrode and common electrode constituting each row electrode pair, in a discharge sustaining period following the address period;

decreasing the applied voltage between the scanning electrode and common electrode in steps when a final applied pulse out of the discharge sustaining pulses falls, and then decreasing the applied voltage toward a predetermined voltage having a polarity different from that of the maximum voltage of the final applied pulse; and increasing gradually the applied voltage toward a base voltage, which is to be applied in the address period of the next subfield period following the discharge sustaining period, immediately after the applied voltage reaches the predetermined voltage.

28. A driving method for a plasma display panel which has a plurality of row electrode pairs, a plurality of column electrodes formed so as to face the row electrode pairs via discharge spaces, and a plurality of discharge cells formed in areas where the plurality of row electrode pairs and the plurality of column electrodes cross respectively, wherein discharge gas is sealed and a fluorescent layer is formed in each discharge cell, the driving method comprising:

dividing a display period in each field of an input video signal into a plurality of subfield periods;

selectively generating an address discharge in the discharge cells by sequentially applying a scanning pulse, on which a positive polarity or a negative polarity base voltage is superimposed, to scanning electrodes constituting the row electrode pairs, and applying a voltage pulse synchronizing with each scanning pulse to the column electrodes in an address period which is set in each subfield period, so as to generate an address discharge in selected cells out of the discharge cells, and set the selected cells to either an emission enable state or a non-emission state;

generating a sustaining discharge in a discharge space of discharge cells being set to the emission enable state, by applying at least one discharge sustaining pulse between a scanning electrode and a common electrode constituting each row electrode pair, in a discharge sustaining period following the address period;

decreasing the applied voltage between the scanning electrode and common electrode in steps when a final applied pulse out of the discharge sustaining pulses falls, and then decreasing the applied voltage toward a predetermined voltage having a polarity different from that of the maximum voltage of the final applied pulse; and increasing the applied voltage toward a base voltage which is to be applied in the address period of the next subfield period following the discharge sustaining period in steps, immediately after the applied voltage reaches the predetermined voltage.

29. The driving method according to claim 28, wherein the applied voltage is sustained at an intermediate voltage, which is higher than the predetermined voltage and is lower than the base voltage, for a predetermined time, when the applied voltage increases from the predetermined voltage toward the base voltage in steps.

* * * * *